US008493274B2

(12) United States Patent
Raura

(10) Patent No.: US 8,493,274 B2
(45) Date of Patent: Jul. 23, 2013

(54) SLOT ANTENNA AND PORTABLE WIRELESS TERMINAL

(75) Inventor: Toru Raura, Tokyo (JP)

(73) Assignee: NEC Corporation, Tokyo (JP)

( * ) Notice: Subject to any disclaimer, the term of this patent is extended or adjusted under 35 U.S.C. 154(b) by 195 days.

(21) Appl. No.: 12/094,248

(22) PCT Filed: Nov. 16, 2006

(86) PCT No.: PCT/JP2006/322807

§ 371 (c)(1),
(2), (4) Date: May 19, 2008

(87) PCT Pub. No.: WO2007/058230

PCT Pub. Date: May 24, 2007

(65) Prior Publication Data

US 2009/0231215 A1 Sep. 17, 2009

(30) Foreign Application Priority Data

Nov. 18, 2005 (JP) ..... 2005-334952
Sep. 21, 2006 (JP) ..... 2006-256304
Sep. 21, 2006 (JP) ..... 2006-256305

(51) Int. Cl.
*H01Q 13/10* (2006.01)
*H01Q 1/24* (2006.01)

(52) U.S. Cl.
USPC ..... 343/767; 343/702; 343/770

(58) Field of Classification Search
USPC ..... 343/727, 768, 840, 906, 713, 880, 343/911 R, 873, 702, 767, 700 MS, 770; 375/267; 342/368; 235/380; 370/329, 335, 370/280; 455/550.1, 452.2; 439/108
See application file for complete search history.

(56) References Cited

U.S. PATENT DOCUMENTS 2,570,824 A * 10/1951 Lindenblad ..... 343/767
3,701,161 A * 10/1972 Gregory ..... 343/770

(Continued)

FOREIGN PATENT DOCUMENTS

CA 2416437 1/2002
EP 1307947 5/2003

(Continued)

OTHER PUBLICATIONS

International Search Report PCT/ISA/210 of PCT/JP2006/322807.

(Continued)

*Primary Examiner* — Robert Karacsony
*Assistant Examiner* — Hasan Islam
(74) *Attorney, Agent, or Firm* — Young & Thompson

(57) ABSTRACT

A slot antenna is provided with at least two conductive plates arranged to face each other. A slot is arranged on one of or both of the facing conductive plates and has a long and narrow opening shape. A power feeding unit is arranged between the facing conductive plates and is electrically and physically connected with the facing conductive plates, respectively. When power is fed to the power feeding unit, the power is fed between the facing conductive plates by the power feeding unit. Thus, excitation with a frequency dependent on the electrical length of the slot is induced at the slot, and a current excited at the slot is distributed entirely over one conductive plate, the current becomes a radiation source, and an electromagnetic wave is radiated from the one conductive plate. At this time, the other conductive plate operates as the reflecting plate of the electromagnetic wave.

17 Claims, 49 Drawing Sheets

U.S. PATENT DOCUMENTS

| | | | | |
|---|---|---|---|---|
| 4,132,995 | A * | 1/1979 | Monser | 343/767 |
| 5,757,326 | A * | 5/1998 | Koyama et al. | 343/702 |
| 5,757,329 | A * | 5/1998 | Hoover et al. | 343/770 |
| 6,222,488 | B1 * | 4/2001 | Pai-Chuan et al. | 343/700 MS |
| 6,225,958 | B1 * | 5/2001 | Amano et al. | 343/767 |
| 6,392,609 | B2 * | 5/2002 | Nieminen | 343/767 |
| 6,466,176 | B1 | 10/2002 | Maoz et al. | |
| 6,492,957 | B2 * | 12/2002 | Carillo et al. | 343/841 |
| 6,614,405 | B1 * | 9/2003 | Mikkonen et al. | 343/872 |
| 6,636,183 | B1 * | 10/2003 | Hellgren et al. | 343/767 |
| 6,906,674 | B2 * | 6/2005 | McKinzie et al. | 343/767 |
| 7,221,320 | B2 * | 5/2007 | Sathath | 343/700 MS |
| 7,400,302 | B2 * | 7/2008 | Winter | 343/702 |
| 2003/0025636 | A1 * | 2/2003 | Chen | 343/702 |
| 2005/0280582 | A1 * | 12/2005 | Powell et al. | 343/700 MS |

FOREIGN PATENT DOCUMENTS

| | | |
|---|---|---|
| EP | 1677384 | 5/2006 |
| JP | 63-95308 | 6/1988 |
| JP | 05-199031 | 8/1993 |
| JP | 09-074312 | 3/1997 |
| JP | 2000-269849 | 9/2000 |
| JP | 2002-084131 | 3/2002 |
| JP | 2003-249811 | 9/2003 |
| JP | 2004-056421 | 2/2004 |
| JP | 2004-128660 | 4/2004 |
| JP | 2004-516694 | 6/2004 |
| JP | 2005-130216 | 5/2005 |
| WO | 02/05384 | 1/2002 |
| WO | 2005/041350 | 5/2005 |

OTHER PUBLICATIONS

Japanese Office Action dated Jun. 5, 2012 in corresponding Japanese Application No. 2007-545274 with its English translation.

* cited by examiner

SLOT ANTENNA AND PORTABLE WIRELESS TERMINAL

TECHNICAL FIELD

The present invention relates to a slot antenna and a portable wireless terminal incorporating the slot antenna.

BACKGROUND ART

Recently, the portable wireless terminal becomes downsized and thin, and some techniques have been disclosed in which a metal case is used for the portable wireless terminals to ensure those rigidity. From a viewpoint of improved designs and protection from damages, the portable wireless terminals have been incorporating those antennas into themselves more and more. When a whole part of a case of the wireless terminal is made of metal, an antenna incorporated into the case does not operate. Therefore, techniques have been disclosed in which a part of the case is made of metal.

For example, in Patent Document 1, a device having a case of a portable wireless terminal, a part of which is metal, is disclosed. As shown in FIG. 45, the case of a wireless terminal device disclosed in Patent Document 1 is composed of a printed substrate 70 having an antenna element 71, and two cases 72 and 73 covering the antenna element 71 and the printed substrate 70 respectively. The case 73 covering the printed substrate 70 is a metal case and the case 72 covering the antenna element 71 is a plastic case, which ensures operation of the antenna and rigidity of the case.

In Patent Document 2, a coaxial resonant slot antenna in which a slot antenna is mounted on a metal case, and its manufacturing method are disclosed. A wireless terminal device disclosed in Patent Document 2 includes, as shown in FIGS. 46A, 46B, and 46C, an elongate belt-like conductor 75 disposed in an internal space of a flat conductor case 74, and an elongate slot 76 formed on the upper surface of the conductor case 74 orthogonally to the belt-like conductor 75 when seen in a planar view.

A connection point 79 between the belt-like conductor 75 and one end of a high-frequency circuit 77 is arranged at a position corresponding to a quarter wavelength of a usable frequency from one end 78 of the belt-like conductor 75. The other end of the high-frequency circuit 77 is connected to the conductor case 74. The belt-like conductor 75 and the metal conductor case 74 compose a coaxial line. When a signal with the usable wavelength is supplied from the connection point 79 to the belt-like conductor 75, a quarter wavelength resonance, with which electric field intensity becomes maximum at the end 78 of the belt-like conductor 75, and with which the electric field intensity becomes minimum at the connection point 79, is induced. Then, an electromagnetic wave forming this resonance is radiated from the slot 76 toward outside.

As shown in FIG. 47A, a small basic wireless antenna disclosed in Patent Document 3 performs induction at a slot 80 provided on a hollow metal conductor case 82 by using a probe 81 which is an extended part from a core portion of a three-branched line 84 connected on the hollow metal conductor case 82 through a connector 83.

With an induction method shown in FIG. 47A, impedance mismatching is caused. Therefore, as shown in FIG. 47B, an impedance matching circuit 86 is provided in between an antenna 85 and a main feed line 87, and the impedance between antenna 85 and the main feed line is adjusted by the impedance matching circuit 86.

Patent Document 4 discloses a method in which a matching circuit makes an antenna be a dual resonant antenna so as to extend an operating band of the antenna.

A dual resonant antenna device disclosed in Patent Document 4 has, as shown in FIGS. 48A and 48B, an antenna element 88 and an LC parallel resonant circuit 95 to make the antenna element 88 resonant in a plurality of frequency bands. The LC parallel resonant circuit 95 includes an inductance element 90 as a shunt element to prevent the impedance from reaching an infinite value in a prescribed frequency band, and a T-shaped circuit composed of capacitance elements 93 and 94. Further, an inductance element 91 is connected in between a feeding point 97 and a ground to match an input impedance of the antenna element 88 and the impedance of a feed circuit 96.

When the antenna element 88 is powered from the feed circuit 96 through the feeding point 97, as for a frequency characteristic, a band-pass characteristic S21 of the dual resonant antenna device does not have drop points in gain at two resonant frequencies f1 and f2, as shown in FIG. 48B, and therefore gain degradation can be prevented. According to this conventional technique, the impedance can be matched in a plurality of frequencies when a matching circuit having the LC parallel resonant circuit as a basic component is added to an antenna having a single resonant characteristic.

Patent Document 5 discloses a notch antenna, which is a slot with one side of it open, as a technique to minimize a slot antenna. As shown in FIG. 49, Patent Document 5 discloses a slit in a length corresponding to the quarter wavelength of a usable frequency provided on a substrate, which operates as an antenna. That is, as shown in FIG. 49, a notch antenna 104 is a linear slit in an electrical length corresponding to the quarter wavelength of the usable frequency, provided from an edge 103*a* of a substrate 103. The notch antenna 104 is provided with a feed section 105 for induction. Further, a notch antenna 106 is provided on the substrate 103, an interval between it and the notch antenna 104 is a distance d. The notch antenna 106 operates by electromagnetic coupling with the notch antenna 104, and is formed as a linear slit slightly shorter than the quarter wavelength of the usable frequency.

Patent Document 1: Japanese Patent Application Laid-open No. 2000-269849

Patent Document 2: Japanese Patent Application Laid-open No. 09-74312

Patent Document 3: Japanese Patent Application Laid-open No. 05-199031

Patent Document 4: Japanese Patent Application Laid-open No. 2003-249811

Patent Document 5: Japanese Patent Application Laid-open No. 2004-56421

DISCLOSURE OF THE INVENTION

Problems to be Solved by the Invention

However, according to a technique of Patent Document 1, there is a problem in which, as a thickness of the plastic case 72 becomes increased to ensure its intensity, an area where the antenna can occupy in the portable wireless terminal becomes decreased. That causes deterioration in performance of antenna. In particular, because the inner antenna of Patent Document 1 has a construction in which the antenna element 71 and the metal case 73 are arranged so as to be stacked in a thickness direction of the case, an area for the antenna becomes smaller and the distance of the antenna element 71 and the metal case 73 becomes decreased. Consequently, the antenna performance becomes extremely deteriorated.

Further, because the plastic case 72 covers the antenna element 71, dielectric losses increase as the thickness of the plastic case 72 is increased, and the antenna performance becomes deteriorated.

In Patent Document 2, the coaxial line for feeding the antenna is composed of the belt-like conductor 75 and the conductor case 74 as a ground. The impedance of the coaxial line varies according to an interval between the belt-like conductor 75 and the conductor case 74. Accordingly, high accuracy is required to determine positions of the belt-like conductor 75 and the conductor case 74 so as to maintain constant impedance. Further, if the conductor case 74 with a curved shape and an unlevel shape is adopted from a viewpoint of an improved design, a position of the conductor case 74 with respect to the belt-like conductor 75 varies according to the curved or the unlevel surfaces, and it becomes very difficult to maintain flat impedance for the coaxial line. Accordingly, losses are generated due to the impedance mismatching, which ends up the deterioration of antenna performance. Further, because the quarter wavelength of the using wavelength is necessary as the coaxial line length in this structure, conductor losses due to the line length is generated. Specifically, the width of the belt-like conductor 75 is required to be narrower along with the thickness of the conductor case 74 becoming thin, which increases the conductor losses and results in the deterioration of antenna performance. Furthermore, an enough mounting space is required in the conductor case 74 to maintain the constant impedance of the arranged coaxial line, which leads to an enlarged size of the device.

In Patent Documents 3 and 4, the problem is that the antenna performance is deteriorated due to losses included in a capacitor chip themselves and an inductor chip both of which compose the matching circuit. Specifically, when the antenna impedance and the feed line impedance are much different from each other, the number of components increases in the matching circuit, accordingly, the losses also increases. At the same time, the matching circuit requires an area to be mounted, which causes increase in the size of a portable wireless terminal. Further, when the matching circuit is set in the metal case, a parallel resonance circuit is formed by influence of a parasitic capacitance existing in between the metal case and the matching circuit. If a resonant frequency at the parallel resonance circuit is within the usable frequency band, the antenna performance is deteriorated.

In Patent Document 5, the antenna occupies a half size of the slot antenna to be mounted. Considering an antenna for the portable wireless terminals, the problem is that antenna characteristic is deteriorated due to influence of a human body because the portable wireless terminals are held by a hand of a user to be used.

As for impedance matching, in Patent Document 2, the coaxial line impedance varies depending on the interval between the line and the metal case, and therefore high accuracy is required to determine the position of the coaxial line in order to maintain the constant impedance. Further, if a metal case having a curved shape or an unlevel shape is adopted as the conductor case from the viewpoint of an improved design for a portable terminal, it is very difficult to maintain the constant impedance of the coaxial line. Accordingly, the losses occur due to impedance mismatching, and the antenna performance is deteriorated.

An object of the present invention is to provide a slot antenna and a portable wireless terminal incorporating the slot antenna, considering the aforementioned problems.

Means of Solving the Problems

To achieve the above mentioned object, a slot antenna according to the present invention includes at least two conductive plates facing to each other, a slot being an opening provided on one or both of the facing conductive plates, and a feed unit connected electrically and physically to each of the facing conductive plates.

Advantageous Effect of the Invention

According to the present invention, the losses due to impedance mismatching can be prevented without adding an impedance matching circuit, and a good antenna performance can be ensured.

BEST MODES FOR CARRYING OUT THE INVENTION

Next, exemplary embodiments of the invention will be explained in details with reference to the drawings.

(First Exemplary Embodiment)

A slot antenna according to a first exemplary embodiment includes, as shown in FIGS. 1A, 1B, and 1C, at least two conductive plates 1 and 2 facing to each other, a slot 3, and a feed unit 4.

The feed unit 4 used for the slot antenna of the first exemplary embodiment functions as a feeding terminal for supplying the conductive plates 1, 2 with electricity so as to deliver a transmission signal in a case of a transmitting antenna, and functions as a receiving terminal for receiving a current excited by an electromagnetic wave in a case of a receiving antenna. Further, although the conductive plates 1, 2 are not limited in number as long as they are facing to each other, two of the conductive plates 1, 2 facing to each other are used in the first exemplary embodiment shown in FIG. 1.

A first conductive plate 1 and a second conductive plate 2 are disposed at facing positions. The feed unit 4 is in between the first conductive plate 1 and the second conductive plate 2 facing to each other, and is connected to each of the first conductive plate 1 and the second conductive plate 2 electrically and physically. It is desirable that the conductive plate 1 and the feed unit 4, and the conductive plate 2 and the feed unit 4 be connected respectively at corresponding positions.

The first conductive plate 1 and the second conductive plate 2 may be either a metal plate or a metal film. It is desirable that a highly conductive material be used therefor. The metal plate is effective to product a metal case with high stiffness. Generally, highly conductive metal tend to be soft, and many are not suitable for exterior of packages which are required to be rigid. Therefore, a metal plate with high stiffness but with comparably low conductive characteristic is used for the exterior. As shown in FIGS. 2A and 2B, a metal film 6 may be laid on a surface of the metal plate 5, alternatively, as shown in FIGS. 3A and 3B, the metal film 6 may be laid on a surface of the plastic plate 7, to compose the first conductive plate 1 and the second conductive plate 2. In this case, the metal film 6 is more conductive than the metal plate 5.

Further, by setting a thickness of the metal film 6 having a conductive rate higher then those of the first conductive plate 1 and the second conductive plate 2 to be equal to or more than a depth of penetration specified by a usable frequency and a material of the metal film 6, a current which is excited at the slot 3 can be distributed only on the surface and inside of the metal film 6. With this, resistance losses can be more reduced and the antenna performance can be more improved, comparing to a case without the metal film 6.

The first conductive plate 1 and the second conductive plate 2 are illustrated as a flat and plain plate, however, shapes thereof are not limited to the case described above. For example, as shown in FIG. 4A, facing surfaces of the first conductive plate 1 and the second conductive plate 2 may be plain and the other surfaces may be in a vault shape which is a curved surface with a high middle part. In the case of FIG. 4A, any one or both of the first conductive plate 1 and the second conductive plate 2 may be in a vault shape. Further, as shown in FIGS. 4B and 4C, the first conductive plate 1 may be in a curved shape. In the case of FIGS. 4B and 4C, any one or both of the first conductive plate 1 and the second conductive plate 2 may be in a curved shape.

Recent portable wireless terminals in which an improved design is pursued tend to have a curved surface. The slot antenna of the first exemplary embodiment has conductive plates 1 and 2 in a curved shape as shown in FIG. 4. Thus, when applied to a portable wireless terminal adopting a curved surface, the slot antenna can be easily incorporated into a portable wireless terminal depending on a shape of terminal.

The feed unit 4 includes a pair of terminals 4*a* and 4*b*, and at least one terminal 4*b* have an elasticity. The feed unit 4 is attached to one of the first conductive plate 1 and the second conductive plate 2 at one terminal 4*a*, and is pressed and fixed to the other one of the first conductive plate 1 and the second conductive plate 2 at the terminal 4*b* with an elasticity, so that it is connected to the first conductive plate 1 and the second conductive plate 2 electrically and physically, and electric power is supplied from the pair of the terminals 4*a* and 4*b* to an interval of the first conductive plate 1 and the second conductive plate 2. The terminal 4*a* with an elasticity may be, for example, in a spring pin structure, a plate-like spring structure, or a coil shaped structure. Further, the pair of the terminals 4*a* and 4*b* of the feed unit 4 may be connected directly to the first conductive plate 1 and the second conductive plate 2.

The feed unit 4 and the feed line 12 will be explained in details. The feed unit 4 shown in FIG. 5A includes an insulating plate 4*c*, having a metal pattern formed on one surface thereof, and also having a spring pin provided on the other surface thereof. The metal pattern forms the terminal 4*a* and the spring pin forms the terminal 4*b*. In the feed unit 4 shown in FIG. 5A, the metal pattern terminal 4*a* is attached on any one of the first conductive plate 1 and the second conductive plate 2, and the spring pin terminal 4*b* is pressed and fixed to the other one of the first conductive plate 1 and the second conductive plate 2, so that the first conductive plate 1 and the second conductive plate 2 are connected to each other electrically and physically. In this case, it is desirable that the metal pattern terminal 4*a* be connected to the conductive plate 1 or 2 by soldering or the like.

The feed unit 4 shown in FIG. 5B includes an insulating plate 4*c* with a metal pattern formed on one surface thereof, and a plate-like spring provided on the other surface thereof. The metal pattern configures the terminal 4*a*, and the plate-like spring configures the terminal 4*b*. In the feed unit 4 shown in FIG. 5B, the metal pattern terminal 4*a* is attached to any one of the first conductive plate 1 and the second conductive plate 2, and the plate-like spring terminal 4*b* is pressed and fixed to the other one of the first conductive plate 1 and the second conductive plate 2, so that the first conductive plate 1 and the second conductive plate 2 are connected to each other electrically and physically. In this case, it is desirable that the metal pattern terminal 4*a* be connected to the conductive plate 1 or 2 by soldering or the like.

In the example of FIGS. 5A and 5B, only one terminal 4*b* is configured with the spring pin or the plate-like spring to have the elasticity, however, the invention is not limited to the case described above. Both terminals 4*a* and 4*b* may be configured with spring pins or plate-like springs. Further, the terminals 4*a* and 4*b* are not limited to the spring pin or the plate-like spring to have the elasticity. It is desirable that the terminals 4*a* and 4*b* of the feed unit 4 be connected to the first and second conductive plates 1 and 2 at two points opposite to each other.

Next, a relationship between the feed unit 4 and the feed line 12 will be explained. As shown in FIG. 5C, when a coaxial cable is used as the feed line 12, a center conductor 12*a* of the coaxial cable 12 is connected to the terminal 4*b* of the feed unit 4, and an outer conductor 12*b* of the coaxial cable 12 is connected to the terminal 4*a* of the feed unit 4. Accordingly, the center conductor 12*a* of the coaxial cable 12, the terminal 4*b* of the feed unit 4, and the first conductive plate 1 are connected electrically, and the outer conductor 12*b* of the coaxial cable 12, the terminal 4*a* of the feed unit 4, and the second conductive plate 2 are connected electrically, and then, the second conductive plate 2 becomes a ground.

As the feed line 12 connecting between the feed unit 4 and an unillustrated wireless circuit, such as a coaxial cable, a microstrip line, and a coplanar line are usable. The ground of the coaxial cable, the microstrip line, and the coplanar line is connected to the terminal 4*a* of the feed unit 4. The feed line 12 supplies electricity from the unillustrated wireless circuit to the feed unit 4 upon transmission, and transmits a received current to the unillustrated wireless circuit upon reception.

The slot 3 is formed in an elongated shape with being shorted at one's ends, and provided on the first conductive plate 1. When the electricity is supplied to the interval between the first conductive plate 1 and the second conductive plate 2 by the feed unit 4, excitation with a frequency depending on the electrical length of the slot 3 occurs at the slot 3, and a current which is excited at the slot 3 is distributed entirely over the first conductive plate 1 or the second conductive plate 2, and then an electromagnetic wave is radiated.

FIGS. 1-4 show the examples in which the slot 3 provided only on the first conductive plate 1, however, the invention is not limited to those cases. For example, even if the slot 3 is arranged on both of the first and second conductive plates 1 and 2, it operates as an antenna. When the slot 3 is arranged only on the first conductive plate 1, a directional antenna can be realized with which an electromagnetic wave has directivity toward a side of the first conductive plate 1. When the slot 3 is arranged both of the first and second conductive plates 1 and 2, an omnidirectional antenna can be realized with which an electromagnetic wave is omnidirectional.

As described above, the slot 3 is in an elongated shape with being shorted at one's ends, but it is not limited to this shape. As shown in FIG. 1D, the slot 3 may be in an elongate opening shape with one end 3*c* open. Further, the slot 3 may be in a hook shape, an inverse-U shape, a meandering shape, and the like, instead of the elongate linear opening shape. Moreover, an opening part of the slot 3 is desirably covered with a dielectric body having a low dielectric loss. Furthermore, by changing the material of the dielectric body, relative permittivity of the dielectric body can be varied, and a resonant frequency of the current excited at the slot 3 can be also varied.

Further, in the slot 3 shown in FIG. 1A, the electrical length thereof is set in a half wavelength of the usable frequency, and in the slot 3 shown in FIG. 1B, the electrical length thereof is set in the quarter wavelength of the usable frequency, but the electrical length of the slot 3 is not limited to those lengths. The electrical length of the slot 3 may be set in an n/2 wavelength or an m/4 wavelength of a usable frequency so that high-order excitation is generated. In this case, n is an integer as 2, 3, 4, 5, etc., and m is an integer such as 3, 5, 7, 9, etc. The slot 3 is required to be formed as being shorted at one's ends when the electrical length is set in the n/2 wavelength of the usable frequency, and to be formed as being with one end 3*c* open when the electrical length is set in the m/4 wavelength of the usable frequency.

As described above, the slot 3 may have any electrical length, may be in any shape and in any structure, as long as the excitation occurs with a frequency depending on the electrical length of the slot 3.

Next, an operation of the slot antenna according to the first exemplary embodiment will be explained. Firstly, an operation as a transmitting antenna will be described.

When electricity is supplied from the unillustrated wireless circuit to the feed unit 4 through the feed line, the electricity is then supplied to the interval between the first conductive plate 1 and the second conductive plate 2 by the feed unit 4. Therefore, the excitation occurs at the slot 3 in the frequency depending on the electrical length according to about the half wavelength of the slot 3, and a current excited at the slot 3 is distributed entirely over the first conductive plate 1. The current becomes a radiative source and an electromagnetic wave is radiated from the first conductive plate 1. At that time, the second conductive plate 2 works as a reflective plate for the electromagnetic wave. Accordingly, the electromagnetic wave radiated from the first conductive plate 1 to the second conductive plate 2 is reflected by the second conductive plate 2 to the first conductive plate 1 side. Thus, the antenna operates as a directional antenna with which an electromagnetic wave has directivity toward the first conductive plate 1 side. Specifically, when the interval between the first conductive plate 1 and the second conductive plate 2 is set in about the quarter wavelength of the usable frequency, the antenna performance becomes a maximum.

Next, an operation as the receiving antenna will be explained. Around the first conductive plate 1 and the slot 3, a current is induced by an electromagnetic wave incoming as a received wave. In this case, the feed unit 4 functions as a receiving unit, and the induced current is transmitted as a reception signal to the unillustrated wireless circuit through the feed unit 4 and the feed line 12.

The current induction by the electromagnetic wave is generated when the first conductive plate 1 and the slot 3 are combined, and the current excitation by the electromagnetic wave is not generated at the second conductive plate 2. Therefore, the antenna works as a directive antenna which responds only to an incoming electromagnetic waves at a side of the first conductive plate 1 and slot 3, especially responds more sensitively to an incoming electromagnetic wave from the first conductive plate 1 side.

Next, a positional relationship between the first conductive plate 1, the second conductive plate 2, and the feed unit 4 will be explained with reference to FIG. 6.

At the feed line 12 such as the coaxial cable, the microstrip line, and the coplanar line, the characteristic impedance thereof is 50Ω. Therefore, if the feed line 4 supplies and receives electricity at a point where the impedance of the slot 3 is 50Ω, the losses due to mismatching are not generated. As for impedance distribution with respect to the slot 3 shown in FIG. 1, FIG. 6A shows that a very high impedance at a center 3*a* in FIG. 6A, then the impedance is decreasing from the center 3*a* close to an end 3*b*, and the impedance becomes the lowest at the end 3*b* of the slot 3.

When the slot 3 shown in FIG. 6A has the electrical length corresponding to the half wavelength of the usable frequency, an impedance matching area 8 satisfying a value of S11<−10 dB, which is generally used as a guide for impedance matching, is an elliptical shaped area centering a highest impedance point (the center 3*a* of the slot 3). An interval between the center 3*a* of the slot 3 and the impedance matching area 8 is in a range from an upper limit +5% to a lower limit −10% centering the electrical length corresponding to about 0.2 wavelength of the usable frequency at a nearest point (a neighborhood of the end 3*b* of the slot 3, and the area spreads in a belt-like shape. Therefore, the feeding position in which the feed unit 4 feeds to the first conductive plate 1 and the second conductive plate 2 is set in the impedance matching area 8, and the losses due to impedance mismatching can be suppressed in a low level.

FIG. 6B is a diagram showing an electromagnetic field simulation result with respect to the impedance matching area 8 in which a feeding position of the feed unit 4 for feeding to the first conductive plate 1 and the second conductive plate 2 is set, in the slot antenna of the first exemplary embodiment.

According to the first exemplary embodiment, in order to obtain an area in which the impedance can be matched in the slot antenna, especially among the first conductive plate 1, the second conductive plate 2 and the feed unit 4 (the impedance matching area 8), an electromagnetic field simulation is performed by using an analytical model shown in FIG. 6B. As the first conductive plate 1 and the second conductive plate 2, conductive plates in a rectangular shape with 184 mm long and 48 mm wide are disposed with facing to each other, and the slot 3 in a size of 3×30 mm being shorted at one's ends is formed on the first conductive plate 1. The first conductive plate 1 and the second conductive plate 2 are connected electrically to each other at those edge parts respectively. Then, a feeding point (one point) by the feed unit 4 is provided in between the first conductive plate 1 and the second conductive plate 2, and antenna impedance characteristic is calculated in a case with the feeding point shifted. In this case, the interval between the first conductive plate 1 and the second conductive plate 2 is set to be far narrower than a length corresponding to the quarter wavelength of the resonant frequency of the antenna, and that is about a 0.03 wavelength.

According to the result of the electromagnetic field simulation of the impedance matching area 8, as shown in FIG. 6B, positions where the impedance is adjusted, that is the feeding points indicating S11<−10 dB with respect to the resonant frequency $f_0$ of the slot 3, are expressed by ○. Further, positions where the impedance is not adjusted, that is the feeding points indicating S11>−10 dB with respect to the resonant frequency $f_0$ of the slot 3, are expressed by •.

The electromagnetic field simulation for the impedance matching area 8 in FIG. 6B is performed only for a case where the feeding point is arranged in an area under the slot 3, and besides, from the center 3*a* to a right end 3*b* of the slot. However, considering its symmetric structure, the same results are obtained in the electromagnetic field simulation for the impedance matching area 8, as in the case shown in FIG. 6B with • and ○, when the feeding point is arranged in an area under the slot 3 and from the center 3*a* of the slot to a left end 3*b*, when the feeding point is arranged in an area over the slot 3 and from the center 3*a* of the slot to the right end 3*b*, or when the feeding point is arranged in an area over the slot 3 and from the center 3*a* of the slot to the left end 3*b*.

Therefore, as shown in FIGS. 6A and 6B, the impedance matching area 8 in which the impedance can be adjusted between the first conductive plate 1, the second conductive plate 2, and the feed unit 4 in the slot antenna of the first exemplary embodiment is distributed in a range of semielliptical shape centering the center 3*a* of the slot 3, and also distributed symmetrically with respect to the slot 3.

According to the above result, the feed unit 4 is disposed in the impedance matching areas 8 shown in FIGS. 6A and 6B, and therefore the losses due to impedance mismatching can be reduced, and the slot 3 can be effectively supplied with electricity. An optimal feeding point can be calculated by the above equation, namely can be calculated as the position indicating S11<−10 dB with respect to the resonant frequency $f_0$ of the slot 3. Alternatively, the optimal feeding point can be obtained by positional adjustment while a reflection amount of electricity from the feed unit 4 is being monitored.

Further, the impedance matching area 8 is not an area expressed by a line, however, an area having a width indicated by an upper limit and a lower limit as shown with arrows in FIGS. 6A and 6B In addition, it appears symmetrically with respect to the slot 3. Therefore, in a case where the slot antenna of the first exemplary embodiment is incorporated in a portable wireless terminal, even if other components are arranged in an optimal feeding point according to its mounting layout, another feeding point can be selected so as to achieve impedance matching between the slot 3 and the feed unit 4. Further, the impedance between the slot 3 and the feed unit 4 can be easily adjusted by adjusting the position of the feed unit 4. Thus, a circuit for impedance matching is not necessary to be set in.

Further, because there is a strong electromagnetic field in a neighborhood of the feed unit 4, erroneous operations tend to occur in mounted components due to an electromagnetic noise, or the like. However, according to the slot antenna of the first exemplary embodiment, the impedance matching area 8 is distributed widely. Therefore, electricity can be supplied and received in the impedance matching area 8 avoiding the mounted components, and influence of the electromagnetic field can be reduced for the mounted components.

In FIG. 6, the simulation with the impedance matching area 8 in which the slot being shorted at one's ends is used as the slot 3 in the first exemplary embodiment is described. Meanwhile, when the slot being an opening one end of which is open is used as the slot 3 in the first exemplary embodiment, the impedance matching area 28 described in FIG. 9 corresponds to the impedance matching area 28.

In the description above for the first exemplary embodiment, the example has been presented in which impedance matching is achieved only by adjusting the position of the feed unit 4. But it may be achieved by combining the impedance matching circuits. In this combination, the impedance is adjusted roughly by the positional adjustment of the feed unit 4, and fine adjustment is performed by the impedance matching circuit. According to this combination, the impedance matching circuit functions only for the fine adjustment, so that circuit components thereof are reduced.

According to the first exemplary embodiment, because the pair of conductive plates disposed with facing to each other, the slot formed on one of the conductive plates, and the feed unit in between the pair of the conductive plates and connected electrically and physically to the pair of the conductive plates at two of the opposite points are included, the high accuracy is not required to determine a position of the feed line to maintain the constant impedance, and the losses due to impedance mismatching can be prevented, then the impedance matching circuit can be unnecessary therefor. Further, because the impedance matching circuit is not necessary, the losses due to the matching circuit itself can be prevented.

According to the first exemplary embodiment, a feeding structure takes a system in which the feed unit feeds directly to the first conductive plate and the second conductive plate, and in which the impedance is adjusted by the adjustment of the feeding position. Thus, the impedance matching circuit is not necessary, and improved antenna performance can be achieved. Further, according to this feeding structure, large area can be obtained as the impedance matching area for the feed unit to supply and receive electricity. Thus, a mounting layout in which the mounted components are arranged far from the feeding position can be realized, and an erroneous operation due to noises or the like in functional components or circuits can be reduced.

According to the first exemplary embodiment, it is considered that the slot antenna is incorporated into a portable wireless terminal, for example. The portable wireless terminals are required to be small, so that a mounting layout depending on mounted components of a portable wireless terminal sometimes puts restrictions on the arrangement of the feed unit. However, in the first exemplary embodiment, the feed unit can be arranged flexibly in some extent, so that even if the mounting layout puts restrictions on the arrangement of the feed unit, the feed unit can surely supply and receive electricity while impedance matching is ensured.

According to the first exemplary embodiment, the impedance matching circuit may be combined. In this combination, the impedance is adjusted roughly by the positional adjustment of the feed unit, and the impedance matching circuit performs the fine adjustment. Therefore, the function of the impedance matching circuit can be limited to the fine adjustment, and the circuit components can be reduced. Consequently, even if the impedance matching circuit is added, the circuit construction can be in a required minimum size. Thus, the losses due to the circuit can be minimized and good antenna performance can be achieved.

According to the first exemplary embodiment, the metal film 6 having conductivity higher than the first conductive plate 1 and the second conductive plate 2 is set in a thickness equal to or more than a skin depth specified by the usable frequency and a material of the metal film 6, so that a current excited at the slot 3 can be distributed only on a surface and inside of the metal film 6. Accordingly, the resistance losses can be more reduced and the antenna performance can be more improved, comparing to a case without the metal film 6.

According to the first exemplary embodiment, the electrical length of the slot 3 shown in FIG. 1A may be shorten to be the quarter wavelength (the m/4 wavelength) of the usable frequency, as shown in FIG. 1D, instead of the half wavelength (the n/2 wavelength) of the usable frequency as shown in FIG. 1A so as to reduce an area occupied only by the antenna and to minimize the antenna.

(Second Exemplary Embodiment)

Next, a case will be explained as a second exemplary embodiment in which the impedance matching between the slot and the feed unit is obtained by positioning of the slot, the feed unit, and a metal wall.

A slot antenna according to the second exemplary embodiment includes, as shown in FIGS. 7A, 7B, and 7C, at least two of the conductor plates 1 and 2 facing to each other, the slot 3, the feed unit 4, and the metal wall 26.

The feed unit 4 used for the slot antenna according to the second exemplary embodiment feeds the conductive plates 1 and 2 for transmitting a transmission signal as in the case of a transmitting antenna, and receives a current induced by an electromagnetic wave as in the case of a receiving antenna. Further, though the conductive plates 1 and 2 are not limited in number to be arranged as long as facing to each other, two of the facing conductive plates are used in the second exemplary embodiment shown in FIG. 7.

The first conductive plate 1 and the second conductive plate 2 are disposed at facing positions. The feed unit 4 is in between the first conductive plate 1 and the second conductive plate 2 facing to each other, and the first conductive plate 1 and the second conductive plate 2 are connected electrically and physically. It is desirable that the conductive plate 1 and the feed unit 4, and the conductive plate 2 and the feed unit 4 be connected at facing positions respectively.

The first conductive plate 1 and the second conductive plate 2 may be either a metal plate or a metal film. A material thereof is preferred to have high conductivity. The metal plate is effective to construct a metal case with high stiffness. Generally, high conductivity metal tends to be soft, and it is not suitable for exterior of a case which is required to be rigid. Therefore, the metal plate with high stiffness and with comparably low conductivity is used for the exterior of the case, and the metal film is laid on a surface of the metal plate or on a surface of a plastic plate to construct the first conductive plate 1 and the second conductive plate 2. In this case, the metal film has higher conductivity than the metal plate.

Further, by setting a thickness of the metal film with conductivity higher than the first conductive plate 1 and the second conductive plate 2 to be equal to or more than a skin depth specified by a usable frequency and a material of the metal film, and therefore a current excited at the slot 3 is distributed only on a surface and inside of the metal film. Accordingly, the resistance losses can be more reduced and the antenna performance can be more improved, comparing to a case without the metal film.

The first conductive plate 1 and the second conductive plate 2 are illustrated in the flat and plain plates in the drawing, but the invention is not limited to this case. As shown in FIG. 4, for example, the facing sides of the first conductive plate 1 and the second conductive plate 2 may be plain, and the other sides thereof may be in vault shape, which has a curved surface with a high middle section. Further, as shown in FIG. 4, one or both of the first conductive plate 1 and the second conductive plate 2 may be curved shaped.

Recent portable wireless terminals in which an improved design is pursued tend to have a curved surface. Adopting the curved shapes for the surfaces of the conductive plates 1 and 2, the slot antenna in the second exemplary embodiment can be easily incorporated into a portable wireless terminal depending on a shape of the terminal, when it is applied to a portable wireless terminal adopting a curved surface.

The feed unit 4 includes a pair of terminals 4*a* and 4*b* as shown in FIGS. 8A and 8B, and at least one terminal 4*b* thereof have an elasticity. In the feed unit 4, as shown in FIG. 8C, one terminal 4*a* is attached to one of the first conductive plate 1 and the second conductive plate 2, and the terminal 4*b* with an elasticity is pressed and fixed to the other one of the first conductive plate 1 and the second conductive plate 2. Accordingly, the first conductive plate 1 and the second conductive plate 2 are connected to each other electrically and physically, and electricity is supplied from a pair of terminals 4*a* and 4*b* to an interval of the first conductive plate 1 and the second conductive plate 2. The terminal 4*b* with an elasticity may be in a spring pin structure, a plate-like spring structure, or a coil shaped structure. Further, the pair of the terminals 4*a* and 4*b* of the feed unit 4 may be connected directly to the first conductive plate 1 and the second conductive plate 2.

The feed unit 4 and a feed line 27 will be explained in details. In the feed unit 4 shown in FIG. 8A, a metal pattern is formed on one surface of an insulating plate 4*c*, and a spring pin is provided on the other surface of the insulating plate 4*c*. The metal pattern configures the terminal 4*a*, and the spring pin configures the terminal 4*b*. In the feed unit 4 shown in FIG. 8A, the metal pattern terminal 4*a* is attached to one of the first conductive plate 1 and the second conductive plate 2, and the spring pin terminal 4*b* is pressed and fixed on the other one of the first conductive plate 1 and the second conductive plate 2, so that the first conductive plate 1 and the second conductive plate 2 are connected to each other electrically and physically. In this case, it is desirable that the feeding terminal 4*a* with the metal pattern be connected on the conductive plate 1 or 2 by soldering.

The feed unit 4 shown in FIG. 8B includes a metal pattern formed on a surface of the insulating plate 4*c*, and a plate-like spring provided on the other surface of the insulating plate 4*c*. The metal pattern configures the terminal 4*a*, and the plate-like spring configures the terminal 4*b*. In the feed unit 4 shown in FIG. 8B, the metal pattern terminal 4*a* is attached on one of the first conductive plate 1 and the second conductive plate 2, and the plate-like spring terminal 4*b* is pressed and fixed on the other one of the conductive plate 1 and the second conductive plate 2, so that the first conductive plate 1 and the second conductive plate 2 are connected to each other electrically and physically. In this case, it is desirable that feeding terminal 4*a* with the metal pattern be connected on the conductive plate 1 or 2 by soldering.

In the examples of FIGS. 8A and 8B, only one terminal 4*b* is configured with a spring pin or a plate-like spring to have the elasticity, but the invention is not limited to this case. Both of the terminals 4*a* and 4*b* may be spring pins or plate-like springs. Further, the terminals 4*a* and 4*b* are not limited to a spring pin or a plate-like spring in order to having the elasticity. The terminals 4*a* and 4*b* of the feed unit 4 are desirably connected to the first and second conductive plates 1 and 2 at opposite two points.

Next, a relationship between the feed unit 4 and the feed line 27 will be explained. As shown in FIG. 8C, when the coaxial cable is used as the feed line 27, a center conductor 27*a* of the coaxial cable 27 is connected to the terminal 4*b* of the feed unit 4, and an outer conductor 27*b* of the coaxial cable 27 is connected to the terminal 4*a* of the feed unit 4. Accordingly, the center conductor 27*a* of the coaxial cable 27, the terminal 4*b* of the feed unit 4, and the first conductive plate 1 are connected electrically, and the outer conductor 27*b* of the coaxial cable 27, the terminal 4*a* of the feed unit 4, and the second conductive plate 2 are connected electrically, and then the second conductive plate 2 is a ground.

As the feed line 27 connecting in between the feed unit 4 and an unillustrated wireless circuit, such as the coaxial cable, the microstrip line, and the coplanar line are usable. A ground of the coaxial cable, the microstrip line, and the coplanar line is connected to the terminal 4*a* of the feed unit 4. The feed line 27 supplies electricity from the unillustrated wireless circuit to the feed unit 4 upon transmission, and transmits a received current to the unillustrated wireless circuit upon reception.

The slot 3 is formed in an opened and elongated opening shape, and provided on the first conductive plate 1. A length of the slot 3 shown in FIG. 7 is set in the electrical length of the quarter wavelength of the usable frequency. One end 3*d* of the slot 3 is open toward outside at the edge 1*a* of the first conductive plate 1, and the other end 3*e* of the slot 3 is a short end. When electricity is supplied by the feed unit 4 to the interval of the first conductive plate 1 and the second conductive plate 2, excitation with the frequency depending on the electrical length of the slot 3 occurs at the slot 3, and a current excited at the slot 3 is distributed entirely over the first conductive plate 1 or the second conductive plate 2, and then an electromagnetic wave is radiated.

FIG. 7 has shown the construction example in which the slot 3 is disposed only on the first conductive plate 1, but the invention is not limited to this case. For example, even if the slot 3 is disposed on both of the first conductive plate 1 and the second conductive plate 2, it operates as an antenna. When the slot 3 is arranged only on the first conductive plate 1, a directive antenna can be realized with which an electromagnetic wave has directivity toward a first conductive plate 1 side. When the slot 3 is arranged on both of the first conductive plate 1 and the second conductive plate 2, an omnidirectional antenna can be realized with which an electromagnetic wave is omnidirectional.

In the above description with respect to the second exemplary embodiment, the slot 3 is in the opened and elongated opening, but it is not limited to this case. As shown in FIG. 7B, the slot 3 may be in an elongate shaped opening with being shorted at the both ends 3*d* and 3*e*. Further, the slot 3 may be in an inversed-U shape or a meander shape, instead of the elongate opening shape. Further, the slot 3 may be in an inverse-U shape, a meandering shape, and the like, instead of the elongate linear opening shape. Moreover, the opening section of the slot 3 is desirably covered with a dielectric body having a low dielectric loss. Furthermore, by changing a material of the dielectric body, a relative permittivity of the dielectric body can be varied, and a resonant frequency of the current exited at the slot 3 can be varied.

Further, the slot 3 shown in FIG. 7A has its electrical length set in the quarter wavelength of the usable frequency, and the slot 3 shown in FIG. 7B has its electrical length set in the half wavelength of the usable frequency. However, the electrical length of the slot 3 is not limited to those. The electrical length of the slot 3 may be set in the n/2 wavelength of the usable frequency, or the m/4 wavelength of the usable frequency so that high-order excitation can be occurred. In this case, n is an integer of 2, 3, 4, 5, etc., and m is an integer of 3, 5, 7, 9, etc. The slot 3 needs to be formed as being shorted at one's ends when the electrical length is set in the n/2 wavelength of the usable frequency, and it needs to be formed as being opened at one end 3*d* when the electrical length is set in the m/4 wavelength of the usable frequency.

As described above, the slot 3 may have any electrical length, may be in any shape and in any structure, as long as the excitation is occurred with a frequency depending on the electrical length of the slot 3.

Next, a positional relationship between the first conductive plate 1, the second conductive plate 2, and the feed unit 4 will be explained with reference to FIG. 9.

In the feed line 27 such as the coaxial cable, the microstrip line, and the coplanar line, the characteristic impedance is 50Ω. Therefore, if electricity is supplied and received at a point where the impedance of the slot 3 is 50Ω, the losses due to impedance mismatching do not occur.

Focusing on the slot 3 provided on the first conductive plate 1, as shown in FIG. 9A, a feeding area (an impedance matching area) for the feed unit 4 is considered. In a model of FIG. 9B, the first conductive plate 1 and the second conductive plate 2 are arranged with facing to each other. The metal wall 26 is disposed at edge sections of the first conductive plate 1 and the second conductive plate 2 in a side of the short end 3*e* of the slot 3, and connects the two conductor plates 1 and 2 electrically.

As shown in FIG. 9B, when the slot 3 is provided on the first conductive plate 1, cutting the first conductive plate from an edge 1*a* into an inside linearly, the impedance matching area 28 for the feed unit 4 is a semielliptical shaped area centering a highest impedance point (the open end 3*d* of the slot 3). An interval from the open end 3*d* to the impedance matching area 28 is in an electrical length corresponding to about 0.2 wavelength of the usable frequency at a shortest point (a neighborhood of the short end 3*e* of the slot 3).

Therefore, the feed unit 4 is connected electrically and physically to the first conductive plate 1 and the second conductive plate 2 at facing positions within the semielliptical shaped impedance matching area shown with dotted lines in FIG. 9A, and supplies electricity within the impedance matching area 28 to the interval of the first conductive plate 1 and the second conductive plate 2.

The metal wall 26 is close to the short end 3*e* of the slot 3 and, in addition, arranged near the feeding position of the feed unit 4. In this case, an interval between the feed unit 4 and the metal wall 26, and an interval between the short end 3*e* of the slot 3 and the metal wall 26 are equal to or less than the electrical length corresponding to a 1/10 wavelength of the usable frequency. It is desirable that the interval between the first conductive plate 1 and the second conductive plate 2 be theoretically set in a length of the quarter wavelength of the usable frequency.

However, the portable wireless terminals targeted for incorporation is required to be slim, and it is practically difficult to secure a thickness for an antenna corresponding to the quarter wavelength of the usable frequency (when the usable frequency is 2 GHz, for example, the thickness is 37.5 mm) within a portable wireless terminal, and the interval between the first conductive plate 1 and the second conductive plate 2 is inevitably narrow. In such a situation, the impedance does not adjusted between the slot 3 and the feed unit 4, and electricity in a designed value is not supplied to the interval between the first conductive plate 1 and the second conductive plate 2.

Therefore, the metal wall 26 is used for impedance matching. The metal wall 26 is formed in a reed shape to be fitted in between the first conductive plate 1 and the second conductive plate 2, and connected to the first conductive plate 1 and the second conductive plate 2 electrically and physically at a neighborhood of the feed unit 4. According to this structure, impedance matching between the slot 3 and feed unit 4 is achieved by the metal wall 26, that is, the metal wall 26 functions as an impedance matching element. In FIG. 7, the metal wall 26 is disposed almost at a middle point of the conductive plates 1 and 2, but the invention is not limited to this case. The metal wall 26 may be disposed at a position being shifted right and left, or upward and downward from the middle point of the conductive plates 1 and 2 within a range in which the interval between the feed unit 4 and the short part 3*b* of the slot 3 is equal to or less than the electrical length corresponding to the 1/10 avelength of the usable frequency.

In FIG. 9, the simulation with the impedance matching area 28 in which the slot with an open end is used as the slot 3 in the second exemplary embodiment is described. Meanwhile, when the slot being shorted at one's ends is used as the slot 3 in the second exemplary embodiment, the impedance matching area 8 described in FIG. 6 corresponds to the impedance matching area 28.

Next, an operation of the slot antenna of the second exemplary embodiment will be explained. Firstly, an operation as the transmitting antenna will be described.

When electricity is supplied from the unillustrated wireless circuit to the feed unit 4 through the feed line 27, the electricity is supplied to the interval between the first conductive plate 1 and the second conductive plate 2 by the feed unit 4. In this case, the metal wall 26 is in between the first conductive plate 1 and the second conductive plate 2 and positioned near the feed unit 4. The metal wall functions as the impedance matching element to achieve impedance matching at the position of the feed unit 4. Thus, the electricity from the feed unit 4 is supplied to the interval between the first conductive plate 1 and the second conductive plate 2 at a maximum.

When the maximum electricity is supplied, excitation with a frequency depending on the electrical length of the quarter wavelength of the slot 3 occurs at the slot 3, a current excited at the slot 3 is distributed entirely over the first conductive plate 1. The current becomes a radiative source and an electromagnetic wave is radiated from the first conductive plate 1. At that time, the second conductive plate 2 works as a reflection plate. Accordingly, the antenna operates as a directional antenna with which an electromagnetic wave is strongly radiated toward a side where the slot 3 is provided.

FIGS. 10 and 11 show experiment examples of impedance effect in the slot antenna according to the metal wall. The slot antennas used in this experiment have arrangements as shown in FIGS. 10C and 11C, and impedance characteristics are measured at the feed unit 4'. In this case, an interval between the metal wall 26 and the feed unit 4 or 4' corresponds to about a 0.05 wavelength of the usable frequency. Further, a thickness of the slot antenna (an interval between the first conductive plate 1 and the second conductive plate 2) corresponds to about a 0.03 wavelength which is much thinner than the quarter wavelength of the resonant frequency of the antenna.

FIG. 10A shows a result of the experiment for the impedance characteristic of an existing slot antenna in which the metal wall 26 is not arranged, while FIG. 11A shows a result of the experiment for the impedance characteristic of the slot antenna according to the exemplary embodiment where the metal wall 26 is arranged. Further, FIG. 10B shows an impedance characteristic (a Smith chart) P1 of the existing slot antenna without arranging the metal wall 26, while FIG. 11B shows an impedance characteristic (a Smith chart) P2 of the slot antenna of the exemplary embodiment with arranging the metal wall 26.

FIGS. 10A and 10B apparently show that degree of impedance mismatching between the feed unit 4 and the slot 3 becomes great when the interval between two conductive plates 1 and 2 is narrower than the quarter wavelength of the usable frequency, and the antenna is almost never supplied with electricity.

On the other hand, as shown in FIGS. 11A and 11B, the metal wall 26 works as the impedance matching element in between the feed unit 4 and the slot 3 so as to adjust a positional relationship between the feed unit 4' and the metal wall 26, and impedance matching between the feed unit 4' and the slot 3 can be achieved. Thus, the antenna is supplied with electricity at a maximum.

It is apparent from the experiment result of FIG. 11 that the metal wall 26 functions as the impedance matching element and contributes to the impedance matching between the feed unit 4 and the slot 3. In this case, a structure of the slot antenna used in the present experiment example is different from the one in the second exemplary embodiment. However, the function of impedance matching by the metal wall 26 is same as in both of a third exemplary embodiment and a fourth exemplary embodiment where the metal wall 26 is used.

Next, an operation as the receiving antenna will be explained. A current is induced by an electromagnetic wave incoming as a receiving wave around the first conductive plate 1 and the slot 3. In this case, the feed unit 4 functions as a receiving device, and the induced current is transmitted to the unillustrated wireless circuit as a reception signal through the feed unit 4 and the feed line 27.

Since the current induction by the electromagnetic wave is occurred according to a combination of the first conductive plate 1 and the slot 3, the current induction does not occurs at the second conductive plate 2. Therefore, the slot antenna works as the directional antenna responding only to the incoming electromagnetic wave at the side of the first conductive plate 1 and the slot 3, and especially responds more sensitively to an incoming electromagnetic wave from the first conductive plate 1 side.

When it operates as the receiving antenna, impedance matching is achieved by the metal wall 26 at feeding unit 4. Therefore, electricity of the receiving wave is effectively transmitted from the first conductive plate 1 to the wireless circuit (an illustration thereof is omitted) through the feed unit 4 and the feed line 27.

According to the second exemplary embodiment, impedance matching between the slot and the feed unit can be achieved by adjusting a positional relationship between the slot, the feed unit, and the metal wall. Thus, even if the metal case of the portable wireless terminal incorporating the slot antenna adopts a curved surface or an unleveled surface from a viewpoint of an improved design, the slot can be arranged on the case and, in addition, impedance matching at the feed unit can be achieved by the positional adjustment of the slot, feed unit, and the metal wall.

According to the second exemplary embodiment, impedance matching between the slot and the feed unit can be achieved by adjusting a positional relationship between the slot, the feed unit, and the metal wall. Because the portable wireless terminals incorporating the slot antenna is restricted in its thickness or the like, the interval between the pair of conductive plates is possibly different at every portable wireless terminal. However, by adjusting the positions of the slot, the feed unit, and the metal wall according to the intervals, impedance matching in the antennas at the position of the feed unit can be achieved.

According to the second exemplary embodiment, the slot is provided at least one of the facing conductive plates and the metal wall is disposed at near the feed unit. Thus, a good impedance characteristic can be ensured even if the interval of the two conductive plates is narrow. When a plurality of slots is excited by using a plurality of feed units at the same time, the metal wall also functions as a shield element, as well as the matching element. Thus, electromagnetic interference for each other can be prevented and each antenna can be easily adjusted individually.

According to the second exemplary embodiment, because the pair of conductive plates disposed with facing to each other, the slot formed on one of the conductive plates, the feed unit disposed in between the pair of conductive plates and connected electrically and physically to the pair of conductive plates at two opposite points, and the metal wall for adjusting impedance between the slot antenna and the feed unit are included, an impedance matching circuit can be unnecessary. Further, because the impedance matching circuit is not necessary, the losses due to the matching circuit itself can be prevented.

According to the second exemplary embodiment, the large area can be secured for the impedance matching area in which the feed unit supplies and receives electricity. Thus, the feed unit can be arranged flexibly.

According to the second exemplary embodiment, the slot antenna is considered to be incorporated into a portable wireless terminal, for example. The portable wireless terminals are required to be minimized, and a mounting layout according to mounted components in a portable wireless terminal may put restrictions on the arrangement for the feed unit in some cases. However, the feed unit can be arranged flexibly in the second exemplary embodiment, so that electricity can be supplied and received surely by the feed unit while impedance matching is ensured, even if the mounting layout puts restrictions on the arrangement of the feed unit.

According to the second exemplary embodiment, the impedance matching circuit may be combined. According to this combination, impedance is adjusted roughly by the positional adjustment of the feed unit, and the impedance matching circuit performs the fine adjustment. Therefore, the impedance matching circuit functions only for the fine adjustment, thus the circuit compositions can be reduced. Even if the impedance matching circuit is added, the circuit construction can be in a required minimum size. Thus, the losses due to the circuit can be suppressed at a minimum, and good antenna performance can be achieved.

(Third Exemplary Embodiment)

Next, a slot antenna according to a third exemplary embodiment, which is a modification of that of the second exemplary embodiment using the metal wall 26, will be explained with reference to FIGS. 12A, 12B and 12C.

The slot antenna according to the third exemplary embodiment includes a plurality of slots on the conductive plate 1 and 2. In the third exemplary embodiment shown in FIG. 12, two slots 29 and 30 are provided on the first conductive plate 1. The slots 29 and 30 may be in any number, as long as the number is two or more. Other structures are the same as in the second exemplary embodiment.

The two slots 29 and 30, each having an open end, are formed and provided on the first conductive plate 1. The length of the slots 29 and 30 shown in FIG. 12 are set in the electrical length corresponding to the quarter wavelength of a usable frequency, one ends 29*a* and 30*a* of the slots 29 and 30 are open toward outside at the edge 1*a* of the first conductive plate 1, and the other ends 29*b* and 30*b* of the slots 29 and 30 are short ends. Two of the slots 29 and 30 are arranged near the feed unit 4 which is in between the slots 29 and 30. When electricity is supplied by the feed unit 4 to an interval of the first conductive plate 1 and the second conductive plate, excitation with a frequency depending on the electrical length of the slots 29 and 30 occurs at the slots 29 and 30, and currents excited at the slots 29 and 30 are distributed entirely over the first conductive plate 1 or the second conductive plate 2, and then an electromagnetic wave is radiated.

Two of the slots 29 and 30 of the third exemplary embodiment are set in the electrical length corresponding to the quarter wavelength of the usable frequency. Therefore, if the lengths of two slots 29 and 30 are set in quarter wavelengths of the different usable frequency, two of the slots 29 and 30 perform transmission/reception with different frequencies.

FIG. 12 shows a construction example in which the slots 29 and 30 are disposed only on the first conductive plate 1, but a construction is not limited to this case. For example, even if the slots 29 and 30 are disposed on both of the first conductive plate 1 and the second conductive plate 2, it operates as an antenna. When the slots 29 and 30 are disposed only on the first conductive plate 1, a directional antenna can be realized with which an electromagnetic wave has directivity toward a side of the first conductive plate 1. When the slots 29 and 30 are disposed on both of the first conductive plate 1 and the second conductive plate 2, an omnidirectional antenna can be realized with which an electromagnetic wave is omnidirectional.

In the third exemplary embodiment, the slots 29 and 30 are in a hook shaped slit, but the invention is not limited to this case. For example, the slots 29 and 30 may be in a straight shape, a meander shape, or the like. Further, as shown in FIG. 12D, by cutting an inside of a right angle corner away from the hook shaped slot 30 obliquely to form a shape 30*c*, a frequency band with which the antenna operates can be expanded. Further, openings of the slot 29 and 30 are desirably covered with a dielectric body having a low dielectric loss. When a material of the dielectric body is changed, a relative permittivity of the dielectric body is varied, and resonant frequencies of currents excited at the slots 29 and 30 can be varied. Other structures and operations are same as in the second exemplary embodiment.

According to the third exemplary embodiment, a plurality of the slots 29 and 30 are provided on the conductive plates 1 and 2. Thus, even if one of those is shielded electromagnetically, transmission/reception can be performed with a remaining slot. Further, by adjusting the lengths of the plurality of slots 29 and 30, different frequencies can be selected for transmission/reception.

(Fourth Exemplary Embodiment)

Next, a slot antenna according to a fourth exemplary embodiment using the metal wall 26 will be explained with reference to FIGS. 13-20.

In the slot antenna according to the fourth exemplary embodiment, the metal wall 26 separates the conductive plates 1 and 2 into a plurality of areas electromagnetically as a fundamental structure, and the slot antenna includes the slot and the feed unit at each separated area of the conductive plates 1 and 2. Other structures are the same as in the second and third exemplary embodiments.

In the slot antenna according to the fourth exemplary embodiment as shown in FIGS. 13A, 13B, and 13C, the conductive plates 1 and 2 are divided into two areas electromagnetically by the metal wall 26. The divided areas of the conductive plates 1 and 2 include the slots 29, 30, and the feed units 4, 4'. In FIG. 13, the metal wall 26 is disposed at almost a center of the conductive plates 1 and 2, but the invention is not limited to this case. The metal wall 26 may be arranged within the conductive plates 1 and 2 with being shifted in right and left, or upward and downward.

In FIG. 13, the metal wall 26 is set in a minimum length L1 required to separate an electromagnetical connection of the slot 29 and the feed unit 4 and an electromagnetical connection of the slot 30 and the feed unit 4'.

In FIG. 13, the slots 29 and 30 provided on the conductive plate 1 separated by the metal wall 26 are different in those lengths. That is, two of the slots 29 and 30 are set in lengths corresponding to the quarter wavelengths of different usable frequencies. Therefore, a frequency of excitation depending on the electrical length of the slot 29 and a frequency of excitation depending on the electrical length of the slot 30 are different. Other structures and operations are the same as in the second and third exemplary embodiments.

According to a construction shown in FIG. 13, the feed units 4 and 4' electromagnetically separated by the metal wall 26 supply electricity to the slots 29 and 30, with switching the slots 29 and 30. Then, excitations with frequencies depending on different lengths of the electrical lengths of slots 29 and 30 occur at the slots 29 and 30. Thus, a multiband antenna can be achieved.

FIGS. 14A, 14B, and 14C show an example into which a structure in FIG. 13 is modified. The conductive plate 1 is separated electromagnetically by the metal wall 26 into areas, and has two sets of slots 29 and 30 in those areas. Two sets of the slots 29 and 30 are provided in a same manner as in FIG. 12. The slots 29 and 30 may be provided in any number, as long as the number is two or more. Other structures are the same as in FIG. 13.

According to a structure shown in FIG. 14, there are a plurality of slots at every area of the conductive plate separated by the metal wall 26 electromagnetically. Thus, if one of those slots is electromagnetically shielded, a remaining slot can perform transmission/reception. Further, the same effect as in the structure in FIG. 13 can be achieved. Moreover, in the structure in FIG. 14, as in the case of FIG. 12, by forming a bottom slot 30 under the slots 29 and 30 arranged longitudinally to be in a shape of the one shown in FIG. 12D, that is, by cutting an inside portion of a right angle corner away from the hook shaped bottom slot 30 obliquely to form a shape 30*c*, a frequency band with which the antenna operates can be expanded.

FIGS. 15A, 15B, and 15C show an example into which the structure in FIG. 13 is modified, where the metal wall 26 is disposed entirely in the length of the conductive plates 1 and 2, so that the conductive plate 1 and 2 are electromagnetically separated into two in right and left by the metal wall 26. The metal wall 26 shown in FIG. 15B is expressed with diagonal lines to clarify its existence.

According to a structure shown in FIG. 15, a pair of the slot 29 and the feed unit 4 and a pair of the slot 30 and the feed unit 4' are completely and electromagnetically separated from each other by the metal wall 26. Thus, mutual interference can be prevented. Further, the same effect as in the structure of FIG. 13 can be achieved.

In the structure shown in FIGS. 15A, 15B, and 15C, the plurality of slots 29 and 30 may be provided at every area electromagnetically separated by the metal wall 26, as shown in FIGS. 16A, 16B, and 16C. The metal wall 26 shown in FIG. 16B is expressed with diagonal lines to clarify its existence.

According to a structure in FIG. 16, there is a plurality of slots provided at every area on the conductive plate electromagnetically separated by the metal wall 26. Thus, if one of those slots is electromagnetically shielded, a remaining slot can perform transmission/reception.

FIGS. 17A, 17B, and 17C show an example into which the structure in FIG. 15 is modified, where the metal wall 26 is disposed on the conductive plates 1 and 2 entirely in a longitudinal direction and, at the same time, one end 26*a* of the metal wall 26 is extended to short sides of the conductive plates 1 and 2 to be arranged thereat. Other structures are the same as in FIG. 15. The metal wall 26 shown in FIG. 17B is expressed with diagonal lines to clarify its existence.

FIGS. 18A, 18B, and 18C show an example into which the structure in FIG. 15 is modified, where the metal wall 26 is disposed on the conductive plates 1 and 2 entirely in the longitudinal direction and, at the same time, both ends 26*a* and 26*b* of the metal wall 26 are extended to short sides of the conductive plates 1 and 2 to be arranged thereat. Other structures are the same as in FIG. 15. The metal wall 26 shown in FIG. 18B is expressed with diagonal lines to clarify its existence.

FIGS. 19A, 19B, and 19C show an example into which the structure in FIG. 15 is modified, where the metal wall 26 is disposed on the conductive plates 1 and 2 entirely in the longitudinal direction and, at the same time, both ends 26*a* and 26*b* of the metal wall 26 are extended to short sides of the conductive plates 1 and 2 in right and left to be arranged thereat. Other structures are the same as in FIG. 15. The metal wall 26 shown in FIG. 19B is expressed with diagonal lines to clarify its existence.

According to constructions in FIGS. 17, 18 and 19, the extended portions (26*a* and 26*b*) of the metal wall 26 are intermediated between the pair of conductive plates 1 and 2. Thus, it can prevent the conductive plate having the slots from deforming and, in addition, electromagnetic interference can be reduced among each slot. Further, radiation directivity in a slot arranged side can be intensified.

FIGS. 20A, 20B, and 20C show an example into which the structure in FIG. 15 is modified, where two metal walls 26 and 26' are disposed in parallel on the conductive plates 1 and 2 entirely in the longitudinal direction. The metal walls 26 and 26' shown in FIG. 20B are expressed with diagonal lines to clarify those existences.

According to FIG. 20, a space surrounded by two of the metal walls 26 and 26' is shielded from an electromagnetic field caused by an antenna current. Thus, it becomes possible to mount a circuit component and a functional component, which are vulnerable to electromagnetic disturbance, within the area surrounded by two of the metal walls 26 and 26'. With this, stable operations can be easily achieved in the portable wireless terminal.

(Fifth Exemplary Embodiment)

Next, an example where the slot antenna according to the first exemplary embodiment is adopted for a portable wireless terminal will be explained as a fifth exemplary embodiment.

As shown in FIG. 21, the portable wireless terminal employs the metal case 9 in a rectangular solid shape so as to maintain the stiffness of the terminal itself, and the metal case 9 is used to house necessary components therein.

The metal case 9 is formed in the rectangular solid shape, and includes wide-width and flat metal frames 9*a* and 9*b* disposed at positions facing to each other, and narrow-width metal frames 9*c* and 9*d* for holding the facing flat plate 9*a* and 9*b* at a certain interval. The wide-width metal frames 9*a* and 9*b* are facing to each other with the interval in a size of the metal frames 9*c* and 9*d*, accordingly, these are applicable to the first conductive plate 1 and the second conductive plate 2 in the slot antenna of the first exemplary embodiment.

Therefore, in the fifth exemplary embodiment, the slot antenna of the first exemplary embodiment is applied to the portable wireless terminal by utilizing the facing wide-width metal frames 9*a* and 9*b* of the metal case 9.

As shown in FIGS. 21A-21D, one of the facing metal frames 9*a* and 9*b* is used as the first conductive plate 1, and the other one is used as the second conductive plate 2. Accordingly, the first conductive plate 1 (the metal frame 9*a*) and the second conductive plate 2 (the metal frame 9*b*) are also works as the case 9 of the portable wireless terminal. To clarify a correspondence relationship, the metal frame 9*a* is explained as the first conductive plate 1 and the metal frame 9*b* is explained as the second conductive plate 2 in the following description, respectively.

As shown in FIGS. 21A and 21C, the first conductive plate 1 includes the slot 3 formed in an elongate opening shape. In the fifth exemplary embodiment, the length of the slot 3 is set in the electrical length corresponding to the half wavelength of a frequency used for communication by the portable wireless terminal. Further, on a backside of the first conductive plate 1, a dielectric body 10 having a low dielectric loss is disposed with covering the opening of the slot 3. In the fifth exemplary embodiment, a plastic plate is used as the dielectric body 10.

Inside of the metal case 9, that is in a space formed by the first conductive plate 1 (the metal frame 9*a*), the second conductive plate 2 (the metal frame 9*b*), and the metal frames 9*c* and 9*d*, circuit components 11 of the portable wireless terminal are mounted on an unillustrated substrate and housed, as shown in FIGS. 21C and 21D.

The feed unit 4 is in between the first conductive plate 1 and the second conductive plate 2, and one terminal 4*b* is connected to the first conductive plate 1 electrically and physically, and the other terminal 4*a* is connected to the second conductive plate 2 electrically and physically. The feed unit 4 is in the impedance matching area 8 in a semielliptical shape shown in FIG. 6, and positioned avoiding the circuit components 11 housed in the metal case 9. Further, a space in between the first conductive plate 1 and the second conductive plate 2 is used for the coaxial cable 12 arranged therein as the feed line, and the center conductor 12*a* of the coaxial cable 12 is electrically connected to the one terminal 4*b* of the feed unit 4, and the outer conductor (the ground) 12*b* of the coaxial cable 12 is electrically connected to the other terminal 4*a* of the feed unit 4. Moreover, the coaxial cable 12 is connected to a wireless circuit incorporated into the circuit component 11.

In this regard, structures of the feed unit 4, the slot 3, the impedance matching area 8, and the feed line 12 in the fifth exemplary embodiment are the same as in the structures of the feed unit 4, the slot 3, the impedance matching area 8, and the feed line 12 in the first exemplary embodiment.

The metal frame 9*b* forming the second conductive plate 2 has a concave section 13 formed on a surface thereof. On the concave section 13 of the metal frame 9*b*, an LCD (a Liquid Crystal Display) 14 is fitted as a display section of the portable wireless terminal. Further, on the surface of the metal frame 9*b*, numerical buttons and operation buttons 15 are formed on an unillustrated substrate and attached.

Next, an operation will be explained in a case where communication is performed with the slot antenna incorporated into a portable wireless terminal.

Firstly, a case will be explained in which the portable wireless terminal transmits information to an unillustrated wireless base station. When electricity is supplied from the wireless circuit incorporated in the circuit components 11 to the feed unit 4 through the coaxial cable 12, the electricity is supplied to the interval between the first conductive plate 1 and the second conductive plate 2 by the feed unit 4. Accordingly, excitation with a frequency depending on the electrical length corresponding to the half wavelength of the slot 3 occurs at the slot 3, and a current excited at the slot 3 is distributed entirely over the first conductive plate 1. The current becomes a radiative source, and an electromagnetic wave is radiated from the first conductive plate 1. At that time, the second conductive plate 2 works as a reflective plate for the electromagnetic wave. Therefore, the electromagnetic wave radiated from the first conductive plate 1 to the second conductive plate 2 is reflected by the second conductive plate toward a first conductive plate 1 side, and the antenna operates as a directive antenna with which an electromagnetic wave has directivity toward the first conductive plate 1 side. Specifically, when the interval between the first conductive plate 1 and the second conductive plate 2 is set in a length corresponding to near the quarter wavelength of the usable frequency, the antenna performance becomes a maximum.

With this, the information is transmitted from the portable wireless terminal to the unillustrated wireless base station through the slot antenna.

Next, an operation in which information from the unillustrated base station is received by the portable wireless terminal will be explained.

Around the first conductive plate 1 and the slot 3, a current is induced by an electromagnetic wave incoming as a reception signal. In this case, the feed unit 4 functions as a receiving unit, and the excited current is transmitted as a reception signal to the wireless circuit incorporated in the circuit components through the feed unit 4 and the coaxial cable 12.

The current induction by an electromagnetic wave occurs with a combination of the conductive plate and the slot 3, accordingly, the current induction does not occurs by an electromagnetic wave at the second conductive plate 2. Therefore, the antenna works as a directive antenna responding only to an electromagnetic wave incoming on the side of the first conductive plate 1 and the slot 3, especially responding with high sensitivity to an electromagnetic wave incoming from the first conductive plate 1 side.

Consequently, the information from the unillustrated wireless base station is received by the portable wireless terminal through the slot antenna.

According to the fifth exemplary embodiment, the pair of facing conductive plates and the slot formed on one conductive plate are incorporated into the metal case of the portable wireless terminal, and electricity is supplied and received by the feed unit positioned in between the pair of conductive plates and connected electrically and physically to the pair of conductive plates at opposite two points. Thus, high accuracy is not required for positioning of the feed line to maintain constant impedance and, in addition, the losses due to impedance mismatching can be prevented and an impedance matching circuit can be unnecessary. Further, the impedance matching circuit is not necessary, and therefore a size of the portable wireless terminal can be compact.

According to the fifth exemplary embodiment, it is apparent from the electromagnetic field simulation for the impedance matching area that an large area can be obtained for the impedance matching area in which the feed unit supplies and receives electricity. Further, because the large area can be obtained for the impedance matching area in which the feed unit supplies and receives electricity, the feed unit can be disposed flexibly.

Because the portable wireless terminals are required to be minimized, arrangement of the feed unit is restricted in some cases by a mounting layout depending on mounted components in the portable wireless terminal. However, in the fifth exemplary embodiment, the feed unit can be arranged flexibly, thus, the feed unit can surely supply and receive electricity while impedance matching is ensured, even if the mounting layout puts restrictions on the arrangement of the feed unit.

According to the fifth exemplary embodiment, a slot is provided only on one of the pair conductive plates, and therefore an electromagnetic wave has a directivity. With the structure having the directivity, deterioration of the antenna performance due to influence of a human body during communication can be suppressed at minimum. Further, a SAR (Specific Absorption Rate) can be reduced, and therefor a portable wireless terminal excellent also in a safety aspect can be provided.

Because a strong electromagnetic field is distributed near the feed unit 4, an erroneous operation easily occurs in the circuit components 11 due to an electromagnetic noise and the like. The portable wireless terminal in the fifth exemplary embodiment has the impedance matching area 8 capable of matching the impedance. Thus, the feed unit 4 can be disposed within the impedance matching area 8 flexibly with selecting a position far from the circuit components 11 to be set.

Further, by using a dielectric body having a low dielectric loss as the plastic plate 10 covering the opening of the slot 3, the losses at antenna can be reduced, and by changing the relative permittivity of the material, a resonant frequency of the slot 3 can be varied.

According to the fifth exemplary embodiment, the slot is provided on an exterior of the case so that the whole case operates as an antenna. Thus, even if the case becomes thinner, the stiffness necessary for the case of the portable wireless terminal can be secured, comparing to existing portable wireless terminals having an inner antenna inside of the plastic case thereof. Further, since the antenna area can be utilized at maximum, the portable wireless terminal can be minimized and thinner, while the antenna performance is maintained. Moreover, since the antenna is not stuck out to outside of the case, the antenna is not damaged due to dropping or the like.

According to the fifth exemplary embodiment, the feeding structure is such a type in which the case is directly fed, and in which impedance matching is achieved by adjusting a feeding position, so that the impedance matching circuit becomes necessary therefore, and the antenna performance can be improved. Further, according to this feeding structure, a large area can be obtained for the impedance matching area 8 at which feeding is possible. Thus, a mounting layout in which a mounted component is placed far from the feeding position can be realized, and an erroneous operation of a functional component and a circuit due to noises or the like can be reduced. Further, configuring the exterior metal case with combination of a high stiffness material and a high permittivity material, good antenna performance can be achieved while the case maintains its stiffness.

(Sixth Exemplary Embodiment)

An example into which the portable wireless terminal according to the fifth exemplary embodiment is modified will be explained as a sixth exemplary embodiment.

As shown in FIGS. 22C and 22D, a printed substrate 16 housed in the metal case 9 of the portable wireless terminal has a ground pattern 17 formed entirely over a surface thereof, the ground pattern 17 is in common with the circuit components 11 mounted on the print substrate 16.

In the sixth exemplary embodiment, the ground pattern 17 formed on an entire surface of the print substrate 16 disposed facing to the first conductive plate 1 of the metal frame 9*a* is used as the second conductive plate 2. The ground pattern 17 and the first conductive plate 1 compose the pair of conductive plates 1 and 2 of the slot antenna. Therefore, the second conductive plate 2 is also works as a metal component to be housed in the case 9. In the sixth exemplary embodiment, the ground pattern 17 of the printed substrate 16 housed in the case 9 is used as the metal component, but the invention is not limited to this case. Other structures shown in FIGS. 22A, 22B, 22C and 22D are the same as the components of the fifth exemplary embodiment shown in FIG. 21.

In this case, the antenna performance degrades as an interval between the ground pattern 17 of the printed substrate 16 and the first conductive plate 1 becomes narrower than the electrical length corresponding to the quarter wavelength of a usable frequency of the portable wireless terminal.

Therefore, as shown in FIG. 22D, metal contacts 18 are pulled out at almost regular intervals from an outer edge section of a whole circumference in the ground pattern 17, and the metal contacts 18 are connected electrically to the metal frames 9*c* and 9*d* which are side walls, or the first conductive plate 1. The feed unit 4 is connected electrically and physically to the first conductive plate 1 at its one terminal 4*b*, and also connected electrically and physically to the ground pattern 17 of the printed substrate 16 at the other terminal 4*a*.

Next, an operation in a case where the communication is performed by the slot antenna incorporated in the portable wireless terminal will be explained.

Firstly, a case where information is transmitted from the portable wireless terminal to an unillustrated wireless base station will be explained. When electricity is supplied from a wireless circuit incorporated in the circuit components 11 to the feed unit 4 through the coaxial cable 12, the electricity is supplied to the interval of the first conductive plate 1 and the second conductive plate 2 by the feed unit 4. Accordingly, excitation with a frequency depending on the electrical length corresponding to about the half wavelength of the slot 3 occurs at the slot 3, and a current excited at the slot 3 is distributed entirely over the first conductive plate 1 and the ground pattern 17 (the second conductive plate 2). Then, the current becomes a radiative source, and an electromagnetic wave is radiated from the first conductive plate 1.

Consequently, the information is transmitted from the portable wireless terminal to the unillustrated wireless base station through the slot antenna.

Next, an operation in a case where information 2*a* from the unillustrated wireless base station is received by the portable wireless terminal will be explained.

A current is induced by an electromagnetic wave incoming as a reception wave around the first conductive plate 1 and the slot 3. In this case, the feed unit 4 functions as a receiving unit, and the excited current is transmitted to the wireless circuit incorporated into the circuit components 11 through the feed unit 4 and the coaxial cable 12 as a reception signal.

Consequently, the information transmitted from the unillustrated wireless base station through the slot antenna is received by the portable wireless terminal.

When the slot antenna of the first exemplary embodiment is incorporated into a portable wireless terminal, a thickness with which maximum antenna performance can be obtained is not secured because the portable wireless terminals has been minimized and thin recently. Accordingly, the interval between the first conductive plate 1 and the ground pattern 17 (the second conductive plate 2) has to be narrow, and a frequency band for the antenna to operate becomes narrow. Even in this case, according to the fourth exemplary embodiment, if the ground pattern 17 is electrically connected to the first conductive plate 1 or the metal frames 9*c* and 9*d* with the metal contacts 18, the metal frames 9*c* and 9*d* can be functioned as impedance matching elements, thus the frequency band for the antenna to operate can be extended. In this case, in a positional relationship, it is desirable that the feed unit 4 and the metal frame 9*c*, 9*d* be neighboring with each other and that a distance thereof be equal to or less than the electrical length corresponding to the 1/10 wavelength of the usable frequency.

(Seventh Exemplary Embodiment)

Next, an example in which the metal case of the portable wireless terminal is modified will be explained as a seventh exemplary embodiment.

In the exemplary embodiment shown in FIGS. 21 and 22, the case of the portable wireless terminal is made of metal. In a portable wireless terminal of the seventh exemplary embodiment shown in FIG. 23, the metal frame 9*a* and the metal frame 9*b* of the case are configured with metal, and the side walls of the case connecting the metal frames 9*a* and 9*b* are composed of the metal contacts 18 and a plastic frame 19. In this exemplary embodiment, the metal frame 9*a* is used as the first conductive plate 1, and the metal frame 9*b* is used as the second conductive plate 2.

In the exemplary embodiment shown in FIGS. 21 and 22, the metal frame 9*a* and the metal frame 9*b* are electrically conducted with each other by the metal frame 9*c* and 9*d*. On the other hand, in the seventh exemplary embodiment, the metal frame 9*c* and the metal frame 9*d* are electrically conducted with each other by the metal contacts 18, as shown in FIGS. 23A, 23B, 23C, and 23D. Other structures shown in FIGS. 23A, 23B, 23C and 23D are the same as the exemplary embodiments shown in FIGS. 21 and 22.

According to the seventh exemplary embodiment, because the metal frame 9*a* and the metal frame 9*b* are conducted electrically by using the metal contacts 18 at a side surface of the case 9, a inductive current preventing electromagnetic waves from being radiated is not induced on the case 9, and the electromagnetic waves is effectively radiated. In this case, it is desirable that the metal contacts 18 be arranged at a possibly narrow pitch all over the circumference of the side surface. Especially, the metal contacts are necessary to be arranged at places where currents are distributed a lot such as the slot 3, a neighborhood of the feeding point, and the like.

(Eighth Exemplary Embodiment)

Next, a portable wireless terminal according to an eighth exemplary embodiment of the present invention will be explained.

As shown in FIG. 24, in the eighth exemplary embodiment, the metal frame 9*a* and the metal frame 9*c* and/or 9*d* are used as the first conductive plate 1, and the slot 3 is provided on the metal frame 9*c* and/or 9*d* composing a portion of the first conductive plate 1. Other structures shown in FIGS. 24A, 24B, 24C are the same as the structures shown in FIGS. 21 and 22.

In FIG. 24A the metal frame 9*a* and the short side metal frame 9*d* are used as the first conducive plate 1, and the slot 3 is provided on the metal frame 9*d* composing a portion of the first conductive plate 1

In FIG. 24B, the metal frame 9*a* and the long side metal frame 9*c* are used as the first conductive plate 1, and the slot 3 is provided on the metal frame 9*c* composing a portion of the first conductive plate 1.

In FIG. 24C, the metal frame 9*a*, the long side metal frame 9*c*, and the short side metal frame 9*d* are used as the first conductive plate 1, and the slot 3 is provided over both of the metal frames 9*c* and 9*d* composing a portion of the first conductive plate 1.

In FIG. 24, a position of the feed unit 4 to supply and receive electricity is adjusted while a reflection amount of electricity from the feed unit 4 is monitored.

According to the eighth exemplary embodiment, the slot 3 is provided on the metal frame 9*c* and/or the metal frame 9*d* composing the side walls of the case 9, the antenna is sensitive to a polarized electromagnetic wave with directivity toward a thickness direction of the portable wireless terminal. Therefore, the slot 3 can be more sensitive in a case where the slot 3 is in a position vertical to a surface of a human body or a metal board, namely in a case where the terminal is close to the human body (in a breast pocket), and in a case where the terminal is left on the metal desk.

According to the eighth exemplary embodiment, a plurality of the slots 3 can be provided when the second exemplary embodiment shown in FIG. 21 or the sixth exemplary embodiment shown in FIG. 22 are combined with the eighth exemplary embodiment. Thus, diversity reception is performable.

(Ninth Exemplary Embodiment)

Next, a portable wireless terminal according to a ninth exemplary embodiment of the invention will be explained.

In the ninth exemplary embodiment shown in FIGS. 25A, 25B, and 25C, the metal case 9 can be folded into two at a center thereof. Further, the slot 3 is provided on a surface of the case 9, which is to be an outside surface when it is folded. A surface of the case 9 corresponds to the metal frame 9*a* of the case 9, that is a surface of the first conductive plate 1. Other structures shown in FIGS. 25A, 25B, and 25C are the same as the structures of the exemplary embodiments shown in FIGS. 21 and 22.

In the ninth exemplary embodiment, when the slot 3 provided on the metal frame 9*a* is supplied with electricity from the wireless circuit (unillustrated) through the coaxial cable 12 and the feed unit 4, excitation with a frequency of the half wavelength of a usable frequency occurs at the slot 3. A current excited at the slot 3 is distributed entirely over the metal frame 9*a* which is provided with the slot 3, and an electromagnetic wave is radiated from the slot 3 of the metal frame 9*a*.

According to the ninth exemplary embodiment, the slot 3 is positioned in the outside when the case is folded. Thus, communication can be performed without any trouble with the folded portable wireless terminal.

According to the ninth exemplary embodiment, a current is almost never distributed on a surface of the metal frame 9*b* (the second conductive plate 2). Thus, impedance difference between a case with the opened portable wireless terminal and a case with the folded one is small, and therefore a circuit for impedance matching and the like is not necessary to be included.

According to the ninth exemplary embodiment, by adjusting a position of the feed unit 4 to supply and receive electricity as in the case of the second exemplary embodiment, impedance between the coaxial cable 12 for feeding and the antenna can be easily adjusted, and a matching circuit is not necessary to be included. Further, as in the case of the fifth exemplary embodiment, the impedance matching area 8 capable of matching the impedance exists, so that the feed unit 4 can be arranged flexibly within the impedance matching area 8 by selecting a position far from the mounted components 11, and a mounting layout can be adopted where erroneous operation caused by an electromagnetic noise and the like in the mounted components 11 can be reduced.

(Tenth Exemplary Embodiment)

Next, a portable wireless terminal according to a tenth exemplary embodiment of the invention will be explained.

In the tenth exemplary embodiment shown in FIG. 26, the case 9 of the seventh exemplary embodiment shown in FIG. 23 is configured in a clamshell structure as in FIG. 25, and the slot 3 is disposed on a surface of the case 9, which is to be an outside surface when it is folded. The surface of the case 9 corresponds to the metal frame 9*a* of the case 9, that is, the first conductive plate 1. Other structures shown in FIGS. 26A, 26B, and 26C are the same as the structures in the exemplary embodiments shown in FIGS. 22 and 23.

In the tenth exemplary embodiment, electricity is supplied to an interval of the first conductive plate 1 (the metal frame 9*a*) and the second conductive plate (the metal frame 9*b*) from the wireless circuit through the coaxial cable 12 and the feed unit 4. Excitation occurs at the slot 3 with a frequency depending on the electrical length corresponding to about the half wavelength of the slot 3. A current excited at the slot 3 is distributed entirely over the metal frame 9*a*, and thereby an electromagnetic wave is radiated from the slot 3 of the metal frame 9*a*. In this case, the antenna operates as a directive antenna toward the side of which the slot 3 is arranged. While, the current is almost never distributed over the case surface facing to the slot 3 side. Therefore, impedance difference between the opened case 9 and the folded case 9 is small, and an impedance matching circuit or the like is not necessary to be included.

As for the feeding position, adjustment is performed as in the fifth exemplary embodiment so that the impedance can be easily adjusted between the coaxial cable 12 for supplying and receiving electricity and the antenna, and in particular, a matching circuit is not necessary to be included. Further, as in the case of the fifth exemplary embodiment, the impedance matching area 8 at which impedance matching can be achieved exists. Thus, the feed unit 4 can be disposed within the impedance matching area 8 by flexibly selecting a position far from mounted components 11 and a mounting layout is adoptable in which erroneous operation of the mounted components 11 caused by an electromagnetic noise and the like can be reduced.

In the tenth exemplary embodiment, the metal frame 9*a* and the metal frame 9*b* are electrically conducted especially by using the metal contacts 18 at the side surface of the case 9. Thus, an inductive current preventing electromagnetic wave from radiating is not excited on the case 9, and the electromagnetic wave can be radiated effectively.

(Eleventh Exemplary Embodiment)

Next, a portable wireless terminal according to an eleventh exemplary embodiment of the invention will be explained.

In the eleventh exemplary embodiment shown in FIG. 27, the slot 3 in the seventh exemplary embodiment shown in FIG. 25 is modified. That is, in the eleventh exemplary embodiment shown in FIG. 27, two slots 3*a* and 3*b* in an inverse-U shape are arranged in parallel longitudinally (in a longitudinal direction of the metal frame 9*a*), and the slots 3*a* and 3*b* have the electrical lengths in which the resonant frequencies are corresponding to f1 and f2, respectively. Other structures shown in FIGS. 27A, 27B, and 27C are the same as structures of the ninth exemplary embodiment shown in FIG. 25.

In the eleventh exemplary embodiment, electricity is supplied through the coaxial cable 12 and the feed unit 4 so as to generate excitation at the slot 3*a*, when an antenna current with the resonant frequency f1 is excited. On the other hand, when an antenna current with the resonant frequency f2 is excited, excitation is generated with a combination of the slot 3*a* and the slot 3*b*. The slots 3*a* and 3*b* are not limited in number as shown in the drawing. The number is specified in accordance with the number of frequencies for excitation at those slots.

The eleventh exemplary embodiment has shown the example where the feed unit 4 is disposed at a right end of the slot 3*a*. However, as shown in FIGS. 4, 29, and 30, the feed unit dose operate as in the same manner even if it is arranged at any position of a left end of the slot 3, a right end and a left end of the slot 3*b*. Other structures shown in FIGS. 28A, 28B, 28C, FIGS. 29A, 29B, 29C, and FIGS. 30A, 30B, 30C are the same in constructions of the ninth exemplary embodiment shown in FIG. 25.

According to the eleventh exemplary embodiment, an operating band of the antenna can be extended. In communication systems used for a mobile system such as a GSM (Global System for Mobile Communications), a FOMA (Freedom Of Mobile multimedia), and a PDC (Personal Digital Cellular), a usable frequency is different between a transmission band and a reception band. Therefore, two resonant frequencies excited at the slots 3*a* and 3*b* are adjusted in a transmission frequency band and a reception frequency band respectively in a communication system to be used, so that an antenna with a minimum required operational band can be constructed and a portable wireless terminal can be minimized according to the minimized antenna.

In the eleventh exemplary embodiment, two of the slots 3*a* and 3*b* are in the inverse-U shape, and the slot 3*a* is a narrow in its middle part and becomes wider toward its ends. However, the slots may be in other shapes, for example, an inverse-U shape, or a meander shape, with a regular width.

In the tenth exemplary embodiment shown in FIG. 26, it can be configured that two of the slots 3*a* and 3*b* in the inverse-U shape are arranged in parallel, and the slots 3*a* and 3*b* have the electrical lengths in which the resonant frequencies are corresponding to f1 and f2, respectively, as in the same manner with the eleventh exemplary embodiment, while other structures can be the same. Operations thereof are the same as one explained in the eleventh exemplary embodiment.

(Twelfth Exemplary Embodiment)

Next, a portable wireless terminal according to a twelfth exemplary embodiment of the present invention will be explained.

The case 9 of the portable wireless terminal shown in FIGS. 31A and 31B, the surfaces of the metal frame 9*a* (the first conductive plate 1) and the metal frame 9*b* (the second conductive plate 2) are covered with a metal film 20 in a different material. The metal film 20 is a higher conductive material than the metal frames 9*a* and 9*b*.

In the first, fifth-eleventh exemplary embodiments, current excited at the slot 3 is distributed over the surface and inside of the metal case 9. The degree of the current penetration into the inside of metal case depends on a frequency of the current and a material of the metal case. When a conductivity of the metal or the current frequency is higher, the current excited at the slot 3 distributes nearer the surface of the case 9. Frequencies used in the mobile system are very high. For example, in the mobile communication systems such as the GSM, the FOMA, and the PDC, an antenna operates with a frequency of some hundreds MHz and more. Currents having such a frequency distribute near the surface of the metal case 9 and do not penetrate into the inside of metal. For example, when a material is Au and a frequency is 2 GHz, a skin depth is about 2 μm.

In the twelfth exemplary embodiment, the metal film 20 with higher conductivity than the metal frame 9*a* (the first conductive plate 1) and the metal frame 9*b* (the second conductive plate 2) is laid on the surface of the case 9 being an exterior of the portable wireless terminal, in which the metal film 20 is set in a thickness equal to or more than a skin depth of the high-frequency current. Accordingly, a current excited at the slot 3 can be distributed only over the surface and inside of the metal film 20. Thus, registration losses can be reduced more and the antenna performance can be improved more, comparing to a case without the metal film 20.

Further, by forming the metal frames 9*a* and 9*b* with a material with high stiffness, the portable wireless terminal can be thin, and the antenna performance also can be improved at the same time.

As a material of the metal film 20, high conductivity materials such as Au, Cu, Ag are suitable. On the other hand, as a material of the metal frames 9*a* and 9*b*, high stiffness materials such as Sus, Ti are suitable. The metal film 20 may be laid on the surface of the metal frames 9*a* and 9*b* with any method of application, spatter, evaporation, and plating.

Further, as shown in FIGS. 32A, 32B, 32C, and 32D, when a plastic case 21 is used instead of the metal frames 9*a*, 9*b*, and the metal frames 9*c*, 9*d*, and a surface thereof is plated or applied with a conductive coating to provide the metal film 20, the same efficiency as the above mentioned can be achieved. In this case, the metal films 20 and 20 facing to each other inside of the plastic case 21 are the first conductive plate 1 and the second conductive plate 2. Further, the plastic case 21 being the exterior of the portable wireless terminal has the metal 20 on its surface, and thereby it becomes stiffer compared to the a configuration of being formed with the plastic case 21 only, to increase its durability for crash when the portable wireless terminal is dropped.

Further, as shown in FIGS. 33A, 33B, 33C, and 33D, a printed substrate (or a flexible printed substrate) 22 and 23 having a solid GND pattern and a slot pattern may be used instead of the metal film 20 and attached inside of the plastic case 21. The printed substrate 22 configures the first conductive plate 1, and the printed substrate 23 configures the second conductive plate 2. In this case, a circuit component, a functional component and the like (unillustrated) may be mounted in a space surrounded by the printed substrates 22 and 23, and on the printed substrate 23 corresponding to the second conductive plate 2. Because the plastic case 21 and the slot antenna are different components, these can be designed and manufactured separately, that leads to easy adjustment. FIGS. 32 and 33 has shown the example of the case in a strait type, but the invention is not limited to this case. For example, it is applicable to a clamshell type case structure.

(Thirteenth Exemplary Embodiment)

Next, a portable wireless terminal according to a thirteenth exemplary embodiment of the invention will be explained.

The exemplary embodiment shown in FIGS. 34A and 34B is different from the twelfth exemplary embodiment shown in FIG. 31 in that the metal film 20 is laid only on the slot 3 side. Other structures are the same as in the twelfth exemplary embodiment.

In the thirteenth exemplary embodiment, the metal film 20 with high conductivity is laid on the metal frame 9*a* (the first conductive plate 1), where the metal film 20 is set in a thickness equal to or more than a skin depth of high-frequency current. Consequently, the resistance losses can be reduced, and the antenna performance can be improved. At the same time, the metal frame 9*b* (the second conductive plate 2) with less conductivity than the metal film 20 is arranged one side of the folded portable wireless terminal, which is to be inside when it is folded, so that an antenna current can be prevented from distributing on the metal frame 9*b*. Consequently, current distribution toward a human body during communication can be prevented, and deterioration of the antenna performance due to the human body can be reduced.

In the thirteenth exemplary embodiment, the metal film 20 are laid entirely over the metal frame 9*a*, but the metal film 20 may be arranged only on a portion where an antenna current is intensively distributed, such as a neighboring part of the metal frame 9*b*.

(Fourteenth Exemplary Embodiment)

Next, a portable wireless terminal according to a fourteenth exemplary embodiment of the present invention will be explained.

The portable wireless terminal of the fourteenth exemplary embodiment shown in FIGS. 35A, 35B, and 35C includes a surface (the first conductive plate 1; the metal frame 9*a*) on which the slots 3*a* and 3*b* are disposed, and a surface (the first conductive plate 1; the metal frame 9*b*) on which the slots 3*c* and 3*d* are disposed, which is to be positioned at opposite to the surface having the slot 3*a* and slot 3*b* when the portable wireless terminal is folded.

The slots 3*a*, 3*b* and the slots 3*c*, 3*d* are disposed at a certain distance so as not to be covered by a hand holding the portable wireless terminal of the fourteenth exemplary embodiment at the same time. Further, the portable wireless terminal of the fourteenth exemplary embodiment is provided with a switch 24 in between the wireless circuit (unillustrated) and the slots, and the slots 3*a*, 3*b* and the slots 3*c*, 3*d* are switched by the switch 24 according to a control signal.

In the fourteenth exemplary embodiment, as shown in FIG. 35D, the switch 24 and the control signal thereof are included for detecting reception power from the slots 3*a*, 3*b* and the slots 3*c*, 3*d*, and selecting one with the higher reception power, and the slots with better condition can be selected. Thus, even if one set of the slots are covered by a hand holding the portable wireless terminal during communication and the like, the antenna performance can be maintain by selecting the other set of the slots. Further, even if the folded terminal is left on a desk, especially on a metal desk, the antenna performance in waiting can be maintained by selecting the slots opposite to the desk side.

(Fifteenth Exemplary Embodiment)

Next, a portable wireless terminal according to a fifteenth exemplary embodiment of the invention will be explained.

In the portable wireless terminal according to the fifteenth exemplary embodiment shown in FIGS. 36A, 36B, 36C, and 36D, the case 9 in the exemplary embodiment shown in FIG. 22 is partially exchanged for the plastic case 21, and an antenna element 25, which is different from the slot antenna of the first exemplary embodiment, is disposed in the plastic case 21.

In the fifteenth exemplary embodiment, the slot antenna of the first exemplary embodiment (a first antenna) is composed of the first conductive plate 1 formed by the metal frame 9*a*, the second conductive plate 9*b* formed by the metal frame 9*b*, and the slot 3. Further, an antenna element 25 is formed by a linear or a plate-like metal component or a metal pattern, and another antenna (a second antenna) is composed of the antenna element 25, the first conductive plate 1 formed by the metal frame 9*a*, and the second conductive plate formed by the metal frame 9*b*. That is, the first antenna with strong radiation directivity toward the slot side and the second antenna 2 with omnidirectional radiation directivity for omnidirectional radiation are provided. The linear or the plate-like metal component or the metal pattern composing the antenna element 25 may be in any shape of a strait shape, an L-shape, a folding back shape, a meander shape, and the like.

The fifteenth exemplary embodiment includes the first antenna having the strong radiation directivity toward the slot side and the second antenna 2 with the omnidirectional radiation directivity for omnidirectional radiation. Thus, by adopting the first antenna for a transmission system and the second antenna 2 for a reception system for example, a portable wireless terminal being not subject to influence of a human body much, and, in addition, having omnidirectional reception sensitivity can be achieved.

Further, as for another combination example, by adopting the first antenna for a communication system with higher usable frequency and the second antenna 2 for a communication system with lower usable frequency, thereby a thinner portable wireless terminal can be achieved.

In FIG. 35, the portable wireless terminal has the case 9 in a strait type, but it is applicable to another type such as in a clamshell type, a slide type, and the like.

As described above, the exemplary embodiments have been presented in which the slot antenna of the first exemplary embodiment shown in FIG. 1 is adopted for the portable wireless terminal, but the invention is not limited to this case. The slot antenna of the first exemplary embodiment can be adoptable at any instrument performing communication by using an electromagnetic wave.

As described, according to the first exemplary embodiment, the losses due to impedance mismatching can be prevented with no impedance matching circuit added, and the good antenna performance can be ensured. A portable wireless terminal applying such an antenna can use a metal material for its case, so that it can be thin while necessary stiffness of the case is ensured. Further, the whole case operates as an antenna, so that a large antenna space can be obtained and the antenna performance can be improved. Moreover, the antenna has the directivity, so that deterioration of the antenna performance, according to the influence of a human body during communication, can be minimized. In addition, the SAR can be reduced, and an excellent portable wireless terminal in a safety aspect can be provided.

(Sixteenth Exemplary Embodiment)

Next, a sixteenth exemplary embodiment will be explained with reference to FIG. 37 where a portable wireless terminal adopts the slot antenna according to the exemplary embodiment shown in FIG. 12.

As shown in FIGS. 37A, 37C, and 37D, an LCD 23 as a display section is attached to a surface of a metal case 32 in the portable wireless terminal. A reference numeral 24 indicates operation buttons and the like provided for operating the portable wireless terminal.

As shown in FIGS. 37B, 37C, and 37D, it is a configuration in which a portion corresponding to the second conductive plate 2 is being the solid GND pattern formed entirely over the substrate 20 mounting a circuit and the like, and a portion corresponding to the first conductive plate 1 is being the metal case 21 of the portable wireless terminal. The metal case 21 has two slots 29 and 9 formed thereon by cutting a part of the case itself away. The two of the slots 29 and 9 in FIGS. 37C and 37D are filled with a dielectric body. The feed unit 4 is fixed in between two of the slots 29 and 9, at a position near the slots 29 and 9, and the feed unit 4 is connected to the feed line 6 shown in FIG. 8C. The structures of the feed unit 4 and the feed line 6 are the same as the structures shown in FIG. 8.

The metal wall 26 functioning as an impedance matching element is provided integrally inside of the metal case 21 of the portable wireless terminal as a rib structure, and the metal case 26 and the solid GND pattern of the substrate 20 is connected to each other in a structure where electrical interengagement can be obtained stably by using a gasket 25 and the like.

In FIG. 37, the solid GND pattern of the substrate 20 has been used as the second conductive plate 2, but the invention is not limited to this case. As shown in FIGS. 30A-38D, the solid GND pattern of the substrate 20 may be exchanged for another conductive component, such as a metal component 26 for holding and fixing the LCD 33, as the second conductive plate 2. In FIG. 37, the metal case 21 of the portable wireless terminal is used as the first conductive plate 1, but the invention is not limited to this case. When the case of the portable wireless terminal is plastic, a metal film is evaporated to inside of the case, and the metal film may be used as the first conductive plate 1. In this case, the metal film may be cut away to form the slots 29 and 9.

Further, in FIG. 37, the first conductive plate 1 is arranged entirely over the back surface of the portable wireless terminal, but the invention is not limited to this case. As shown in FIGS. 44A and 44B, when a camera, a back side LCD 27, and the like are mounted on the back surface of the portable wireless terminal, the metal plate 21 (the first conductive plate 1) cannot be disposed in a mounting area A in some cases.

An example of countermeasures for this case, as shown in FIGS. 44B-44D, the metal plate 21 where the slots 29 and 9 are not arranged is taken away from the mounting area A, and the area without the metal plate 21 may have the camera, the back surface LCD 27, and the like thereon.

It is desirable that a material for the first and second conductive plates 1, 2 and the metal wall 26 be made of a material having good conductivity such as Cu, Au, Ag or the like, and that a thickness thereof be equal to or more than a skin depth of the high-frequency current with respect to a usable frequency. In FIG. 37, the gasket 25 is used for electrical connection between the first conductive plate 1 and the second conductive plate 2, but another metal contact, having a structure of, for example, a plurality of plate springs arranged along a rib may be used.

Further, the metal wall 26 has a configuration using the plate-like metal plate (a rib), but another structure, for example as shown in FIGS. 39A-39D, may be adopted in which the metal wall 26 is configured with one or a plurality of spring pins, a narrow plate spring or the like, arranged at a certain interval.

In the portable wireless terminal adopting the slot antenna shown in FIG. 12, the first and second slots 29 and 9 provided on the surface of the metal case is supplied with electricity by the wireless circuit (unillustrated) through the feed unit 4, and resonances with frequency in the length of about the quarter wavelength of each slot length are generated. At that time, the feed unit 4 is desirably disposed at a neighborhood of the short end (an opposite side of the open end) of the first or the second slot 29 or 9.

A current excited by the slots 29 and 9 is distributed entirely over the surface of the case in the side where the slot is arranged, and the antenna does operate as an antenna with which an electromagnetic wave is radiated from the whole metal case of the portable wireless terminal in the present invention. Further, as shown in FIGS. 40A and 40B, the antenna does operate as a directional antenna toward the side having the slot (a −y direction). The operating frequency band thereof depends on each slot length. Therefore, it becomes possible to respond to a multiband system by exciting a plurality of slots with different lengths.

(Seventeenth Exemplary Embodiment)

Next, a seventeenth exemplary embodiment will be explained with reference to FIG. 41 in which the slot antenna according to the exemplary embodiment shown in FIG. 14 is adopted for a portable wireless terminal.

As shown in FIGS. 41A, 41C, and 41D, the LCD 33 as the display section is attached on the surface of the metal case 32 in the portable wireless terminal. The reference numeral 34 indicates operation buttons and the like provided for operating the portable wireless terminal.

As shown in FIGS. 411, 41C, and 41D, a portion corresponding to the second conductive plate 2 is the solid GND pattern of the substrate 20 mounting a circuit and the like, and a portion corresponding to the first conductive plate 1 is the metal case 21 of the portable wireless terminal.

The metal wall 26 functioning as an impedance matching element is composed as a rib structure integrally provided inside of the metal case 21 of the portable wireless terminal, and the metal wall 26 and the solid GND pattern of the substrate 20 are connected to each other in a structure where electrical interengagement can be obtained stably by using the gasket 25 and the like.

Areas of the metal case 21 electromagnetically separated by the metal wall 26 include two of the slots 29 and 9 formed thereon by cutting the case itself away. Two slots 29 and 9 in FIGS. 41C and 41D are filled with dielectric bodies. The feed units 4 are fixed at positions near slots 29 and 9, and in between two slots 29 and 8, and two slots 9 and 9. The feed unit 4 is connected to the feed line 6 shown in FIG. 8C. The feed unit 4 and the feed line 6 are in the same structure as in FIG. 8.

In FIG. 41, the solid GND pattern of the substrate 20 is used as the second conductive plate 2, but the invention is not limited to this case. The solid GND pattern of the substrate 20 may be exchanged for another conductive component, such as the metal component 36 holding and fixing the LCD 33, as the second conductive plate 2. The metal case 31 of the portable wireless terminal is used as the first conductive plate 1, but the invention is not limited to this case. When the case of the portable wireless terminal is formed by plastic, a metal film is evaporated inside the case, and the metal film may be used as the first conductive plate 1. In this case, the metal film may be cut away to form the slots 29 and 9. Further, a thin metal plate or a flexible substrate having a solid pattern may be arranged inside the plastic case, and the slots 29 and 9 may be formed thereon.

It is desirable that the first and second conductive plates 1, 2, and the metal wall 26 be made of a material having good conductivity such as Cu, Au, and Ag, and that the thickness thereof is equal to or more than the skin depth of the high-frequency current with respect to the usable frequency. The gasket 25 is used for the electrical connection between the first conductive plate 1 and the second conductive plate 2, but another metal contact, such as in a structure where a plurality of plate-like springs are arranged along the rib may be used.

Further, the metal wall 26 is the plate-like metal plate (the rib), but another structure, for example as shown in FIGS. 39A-39D, may be adopted as the metal wall 26 in which one or a plurality of spring pins or a narrow plate springs arranged at a certain interval.

In the portable wireless terminal adopting the slot antenna shown in FIG. 14, the first and second slots 29 and 9 provided on the surface of the metal case is supplied with electricity by the wireless circuit (unillustrated) through the feed unit 4, and resonance with frequency having the quarter wavelength of each slot length are generated. At that time, the feed unit is desirably disposed at a neighborhood of the short end (an opposite side of an open end) of the first or the second slot.

Currents excited by the slots 29 and 30 are distributed entirely over the surface having the slot of the case, and the portable wireless terminal of the present invention operates as an antenna in which an electromagnetic wave is radiated from the whole metal case. Further, as shown in FIG. 40B, it operates as a directive antenna toward the side having the slot (−y direction). The operating frequency band thereof depends on each slot length, so that the antenna can respond to a multiband system by exciting a plurality of slots with different lengths.

Arrangement of the metal wall 26 is not limited to the structure shown in FIG. 41. The metal walls 26 and 26' may be arranged entirely over the longitudinal area of the conductive plates 1 and 2, as shown in FIGS. 42A-42D (FIGS. 15, 16, 17, 18 and 19). Further, as shown in FIGS. 43A-43D (FIG. 20), the metal wall 26 may be exchanged for two of the metal walls 26 and 26' disposed in parallel. Moreover, the slot antennas shown in FIGS. 7, 13, 15-20 are applicable to the portable wireless terminals as in the same manner.

Further, in structures shown in FIGS. 16, 37, 38, 39, 40, 41, 42, 43, and 44, if a bottom slot 30 of longitudinally arranged slots is in a shape shown in FIG. 12D, that is, in a shape 30*c* of the hock shaped bottom slot in which inner side of the right angle corner is cut away diagonally, a frequency band for an antenna to operate can be extended.

According to the second to fourth exemplary embodiments, the slot is provided on at least one of a pair of conductive plates facing to each other, and the metal wall is arranged near the feed unit so as to ensure the good impedance characteristic even if the interval between the pair of conductive plates is narrow.

A metal material can be used for the case of the portable wireless terminal adopting such an antenna. Thus, the terminal can be thin while the stiffness necessary for the case of a terminal can be maintained. Further, the whole case operates as an antenna, so that a large antenna space can be obtained and the antenna performance can be improved. Furthermore, the antenna has directivity, so that deterioration due to influence of a human body during communication can be minimized in the antenna performance. In addition, the SAR can be reduced and an excellent portable wireless terminal can be provided in a safety aspect.

A shape of the case in the portable wireless terminal may be in a clamshell type, instead of a strait type shown in the exemplary embodiment. When the case is in the clamshell type, the slot antenna is desirably disposed at an upper side so as to avoid influence of a hand holding the terminal. Further, a portion of the metal case may be exchanged for a plastic material, and a usual inner antenna (a linear antenna, a plane antenna and the like) may be disposed at the portion, and then it may be combined with the aforementioned slot antenna to operate.

Further, each slot antenna may be assigned to, for example, transmission/reception. According to the structure of the present invention, the frequency bandwidth for the antenna to operate tends to be narrower as the case becomes thinner. Usually, frequency bands are assigned to each antenna at every communication system such as a W-CDMA, a GSM, and the like. There is an unused frequency band between a transmission band and a reception band with respect to the communication systems, and an operating frequency bandwidth for an antenna includes that unused frequency band. In order to utilize a narrow bandwidth for the antennas effectively, each slot is assigned to the transmission/reception, and the aforementioned method in which the slot lengths are switched by using the semiconductor switch and the like is combined therewith. Accordingly, an antenna structure in which minimum number of the slot antennas operates in a wide frequency bandwidth can be achieved with a thin case.

In the aforementioned description, there are two of the facing conductive plates, but the exemplary embodiment is not limited to this case. There may be three of the facing conductive plates. When three conductive plates are used, a conductive plate arranged in middle is set as a common ground for two of the conductive plates in both sides of the middle plate. Then, the feed unit 4 feeds directly to intervals in between the conductive plate being the ground and two conductive plates disposed in the both sides of the conductive plate of the ground. Further, the metal wall 26 is disposed in between the conductive plate being the ground and two conductive plates in the both sides thereof. The number of the facing conductive plates is not limited to be two or three. Any number of conductive plates may be arranged as long as there is an installation space for an antenna.

Further, as described above, each exemplary embodiment uses the feeding structure shown in FIG. 5 or 8, but the exemplary embodiments are not limited to this. As a modified example of the feeding structure shown in FIG. 5 or 8, a structure in which a portion immediately beneath the terminal 4*b* in the metal pattern (a part of 4*a*, or a part of the second conductive plate) is removed may be adopted. According to the modified example, the parasitic capacitance at the antenna feeding point and the resistance losses can be reduced, and it is expected that the antenna bandwidth can be extend and that radiation efficiency can be improved.

INDUSTRIAL APPLICABILITY

According to the present invention, the impedance matching between the antenna and the feed line can be achieved using any one of the direct feeding method by the feed unit and the combination of the direct feeding method by feed unit and the metal wall.

BRIEF DESCRIPTION OF THE DRAWINGS

[FIG. 1]

[FIG. 2]

[FIG. 3]

[FIG. 4]

[FIG. 5]

[FIG. 6]

[FIG. 7]

[FIG. 8]

[FIG. 9]

[FIG. 10]

[FIG. 11]

[FIG. 12]

[FIG. 13]

[FIG. 14]

[FIG. 15]

[FIG. 16]

[FIG. 17]

[FIG. 18]

[FIG. 19]

[FIG. 20]

[FIG. 21]

[FIG. 22]

[FIG. 23]

[FIG. 24]

[FIG. 25]

[FIG. 26]

[FIG. 27]

[FIG. 28]

[FIG. 29]

[FIG. 30]

[FIG. 31]

[FIG. 32]

[FIG. 33]

[FIG. 34]

[FIG. 35]

[FIG. 36]

[FIG. 37]

[FIG. 38]

[FIG. 39]

[FIG. 40]

[FIG. 41]

[FIG. 42]

[FIG. 43]

[FIG. 44]

[FIG. 46]

[FIG. 47]

[FIG. 48]

DESCRIPTION OF SYMBOLS

Figure 1A:
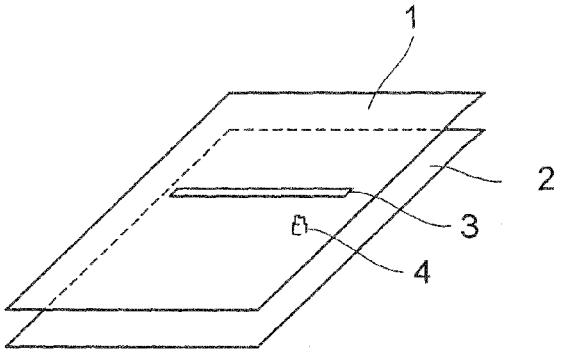
FIG. 1A is a perspective view showing a slot antenna according to a first exemplary embodiment of the invention.
Figure 1B:
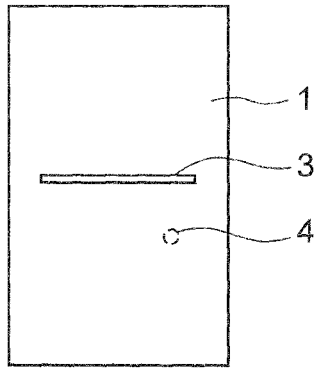
FIG. 1B is a plan view showing the slot antenna according to the first exemplary embodiment of the invention.
Figure 1C:
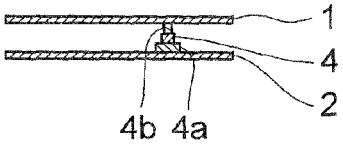
FIG. 1C is a transversal sectional view sectioned at a position of a feed unit.
Figure 1D:
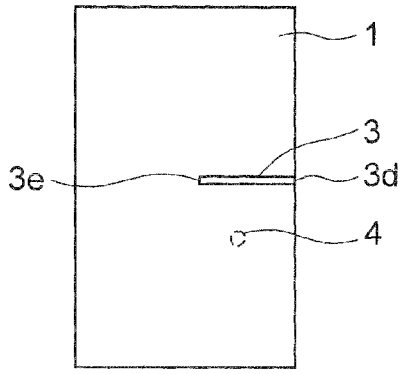
FIG. 1D is a perspective view showing a modified example of the slot.
Figure 2A:
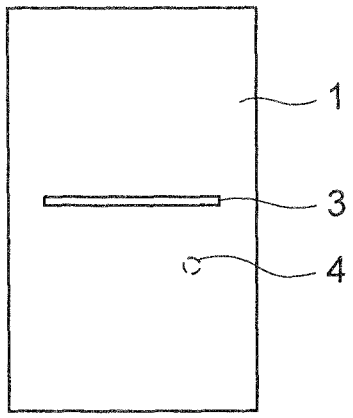
FIG. 2A is a plan view showing a modified example of a conductive plate with respect to the slot antenna according to the first exemplary embodiment.
Figure 2B:
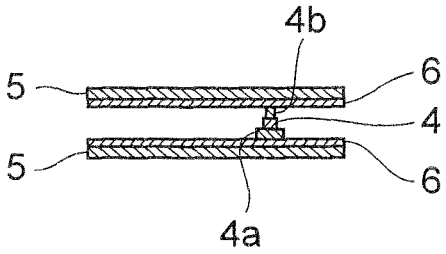
FIG. 2B is a transversal sectional view sectioned at a position of the feed unit.
Figure 3A:
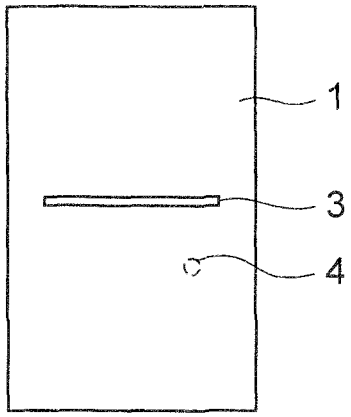
FIG. 3A is a plan view showing a modified example of the conductive plate with respect to the slot antenna according to the first exemplary embodiment.
Figure 3B:
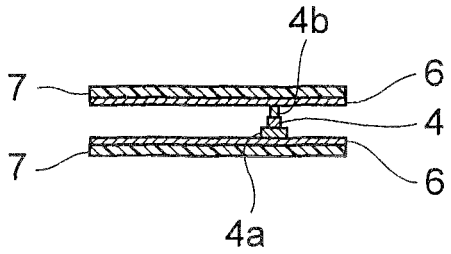
FIG. 3B is a transversal sectional view sectioned at a position of the feed unit.
Figure 4A:
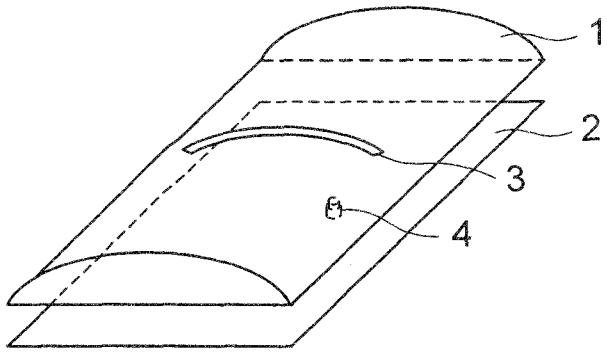
FIG. 4A is a perspective view showing an example in which the conductive plate of the slot antenna according to the first exemplary embodiment is in a curved shape.
Figure 4B:
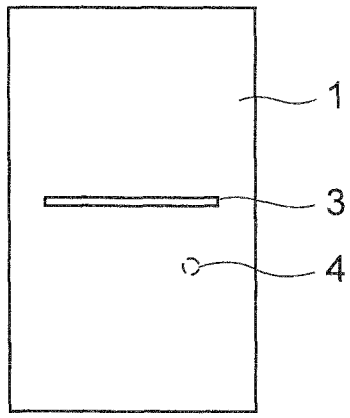
FIG. 4B is a plan view of the same.
Figure 4C:
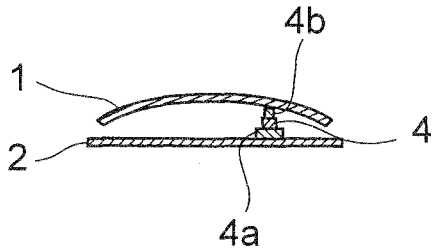
FIG. 4C is a transversal sectional view sectioned at a position of the feed unit.
Figure 5A:
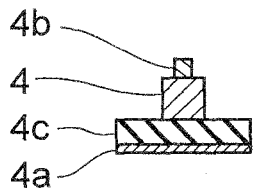
FIGS. 5A and 5B are diagrams showing structures of the feed unit.
Figure 5B:
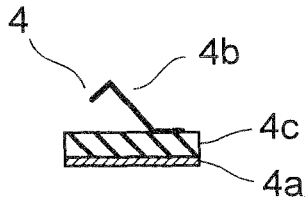
Figure 5C:
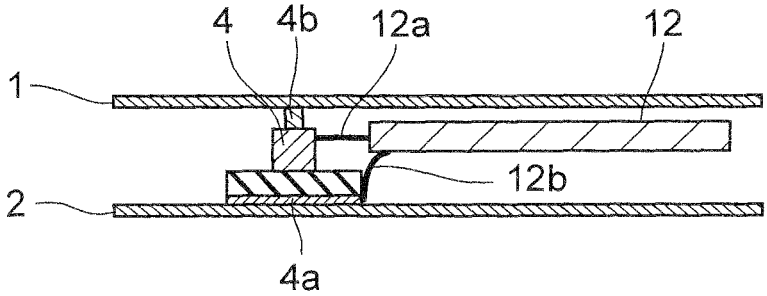
FIG. 5C is a diagram showing a relationship between the feed unit and a feed line.
Figure 6A:
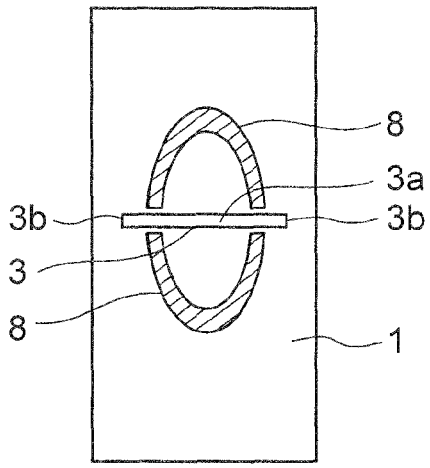
FIG. 6A is a diagram showing an impedance matching area in which the feed unit with the slot antenna according to the first exemplary embodiment is arranged.
Figure 6B:
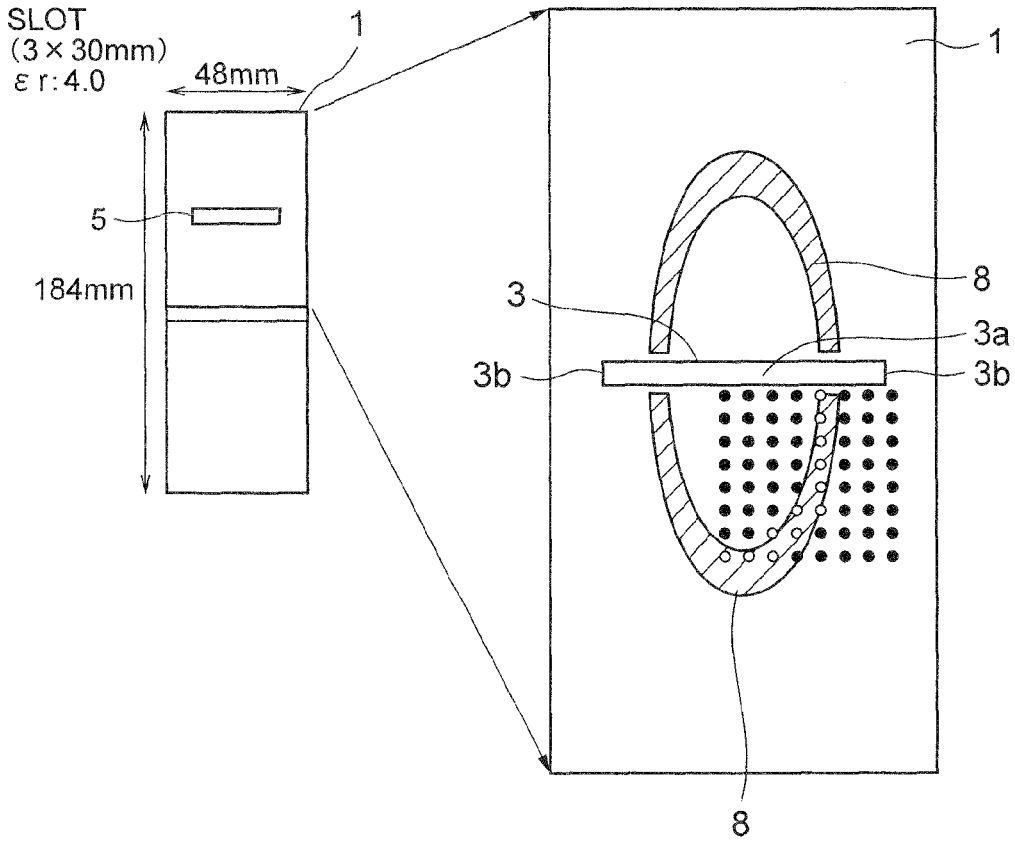
FIG. 6B is a diagram showing a result of an electromagnetic field simulation with respect to the impedance matching area of the slot antenna in the first exemplary embodiment of the present invention.
Figure 7A:
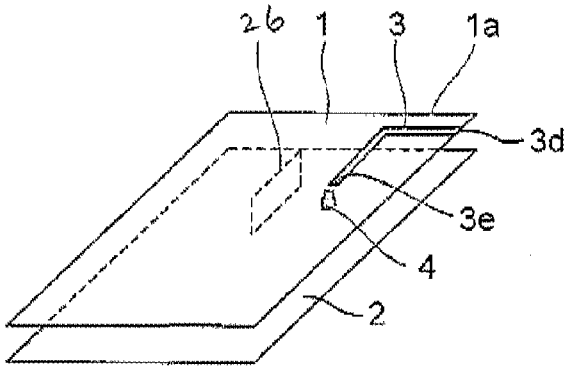
FIG. 7A is a perspective view showing a slot antenna according to a second exemplary embodiment of the present invention.
Figure 7B:
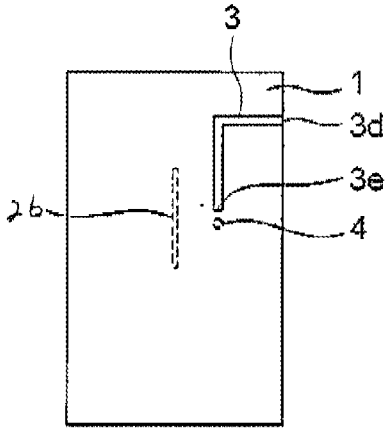
FIG. 7B is a plan view showing the same.
Figure 7C:
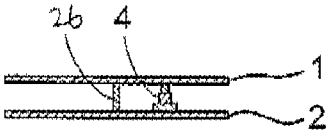
FIG. 7C is a longitudinal sectional view.
Figure 7D:
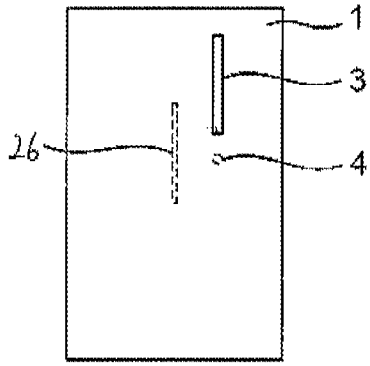
FIG. 7D is a perspective view showing a modified example of the slot.
Figure 8A:
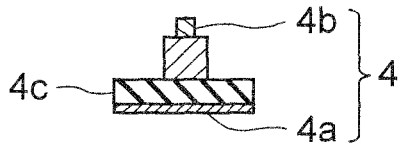
FIGS. 8A and 8B are longitudinal sectional views showing feed units.
Figure 8B:
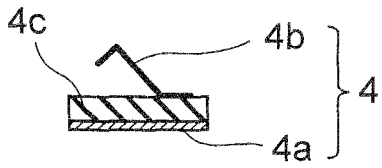
Figure 8C:
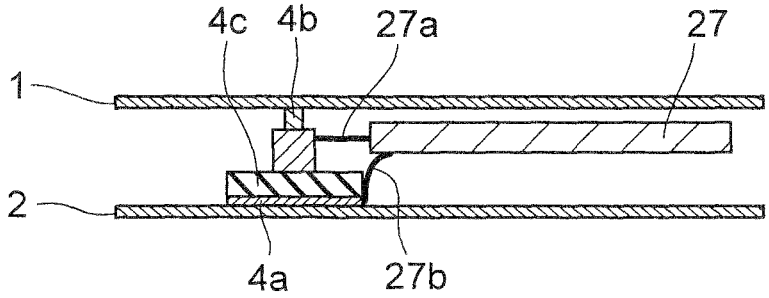
FIG. 8C is a longitudinal sectional view showing a relationship between the feed unit and a feed line.
Figure 9A:
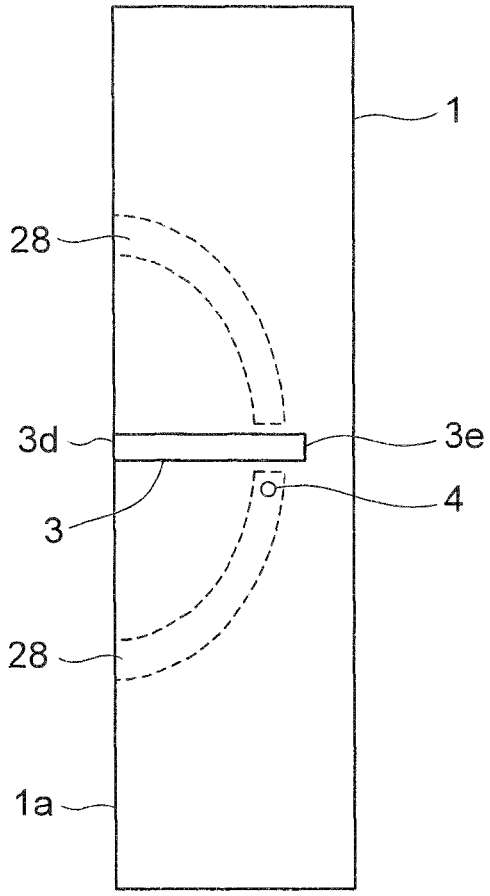
FIG. 9A is a plan view explaining a feeding area for the feed unit.
Figure 9B:
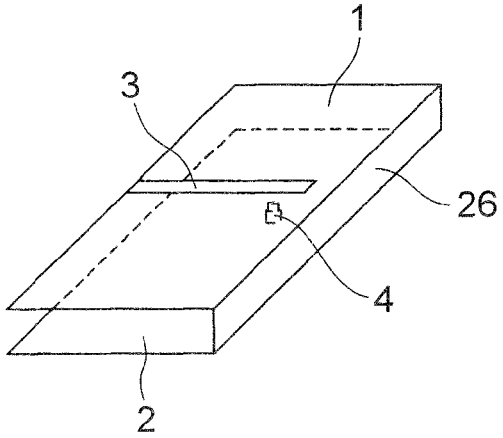
FIG. 9B is a perspective view showing a slot antenna model.
Figure 10A:
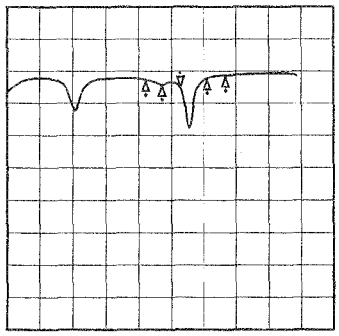
FIG. 10A is a diagram showing an impedance characteristic of a slot antenna according to an related art.
Figure 10B:
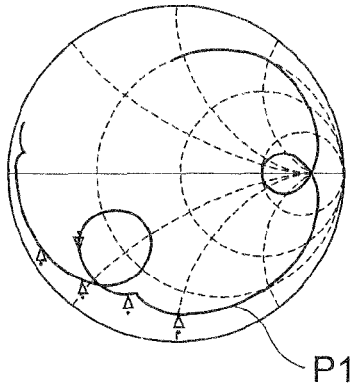
FIG. 10B is a diagram showing the impedance characteristic (a Smith chart) of the slot antenna according to the related art.
Figure 10C:
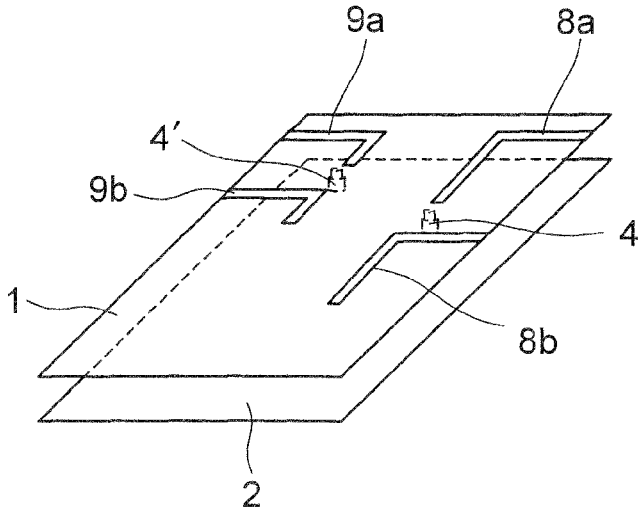
FIG. 10C is a perspective view of a slot antenna used for an experiment.
Figure 11A:
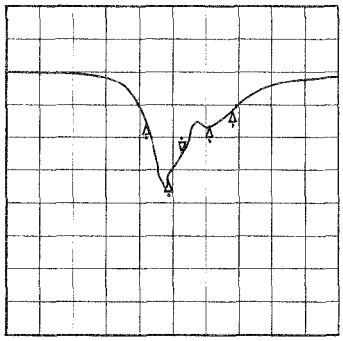
FIG. 11A is a diagram showing an impedance characteristic of the slot antenna according to the second exemplary embodiment.
Figure 11B:
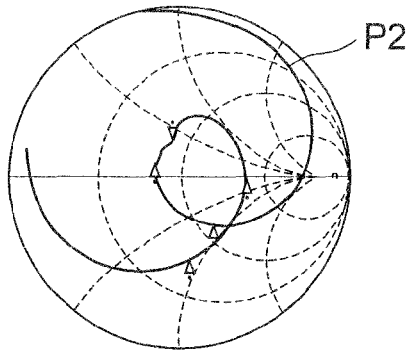
FIG. 11B is a diagram showing the impedance characteristic (a Smith chart) of the slot antenna according to the second exemplary embodiment.
Figure 11C:
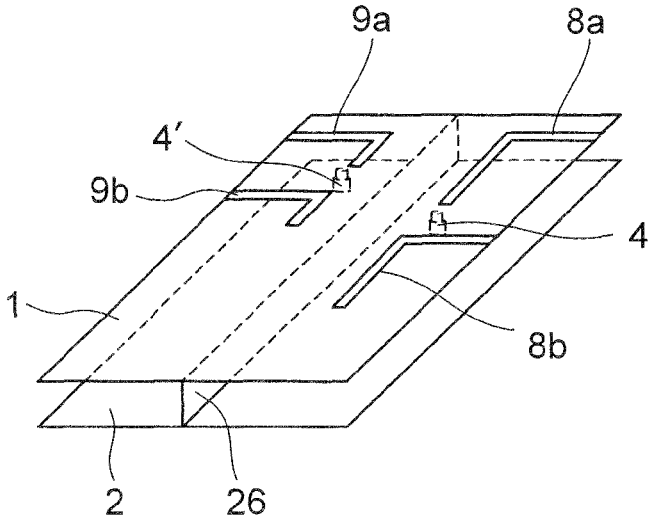
FIG. 11C is a perspective view of a slot antenna used for the experiment.
Figure 12A:
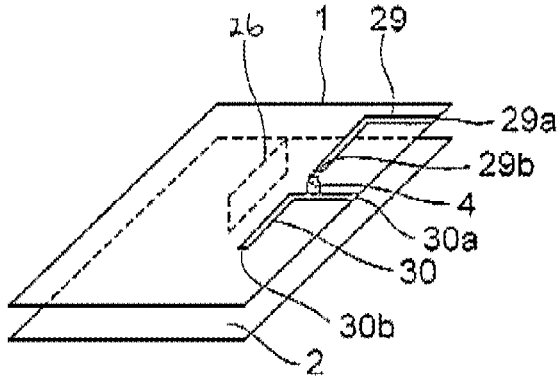
FIG. 12A is a perspective view showing a slot antenna according to a third exemplary embodiment of the present invention.
Figure 12B:
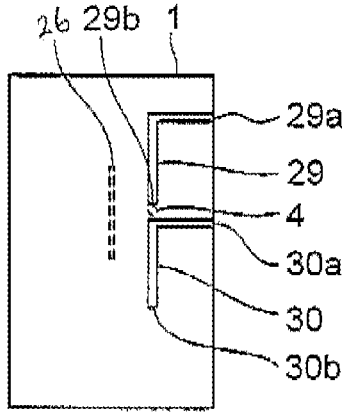
FIG. 12B is a plan view for the same.
Figure 12C:
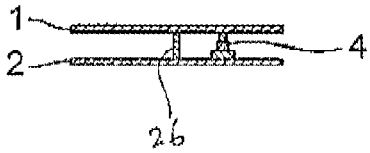
FIG. 12C is a longitudinal sectional view.
Figure 12D:
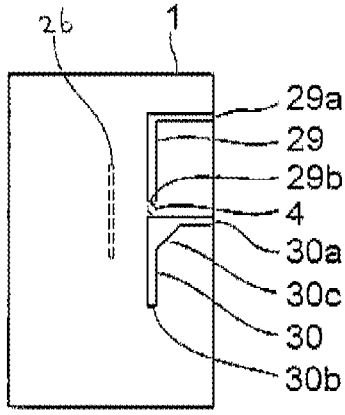
FIG. 12D is a plan view showing a modified example of the slot.
Figure 13A:
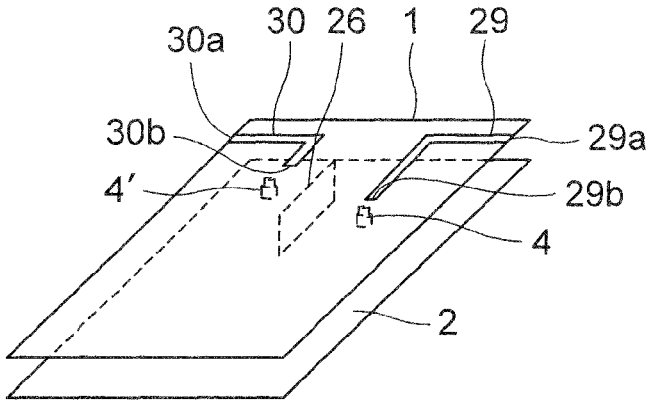
FIG. 13A is a perspective view showing a slot antenna according to an eighteenth exemplary embodiment of the present invention.
Figure 13B:
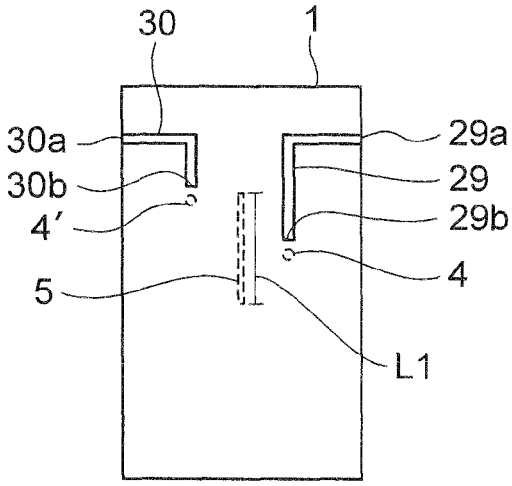
FIG. 13B is a plan view for the same.
Figure 13C:
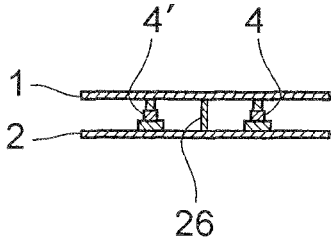
FIG. 13C is a longitudinal sectional view.
Figure 14A:
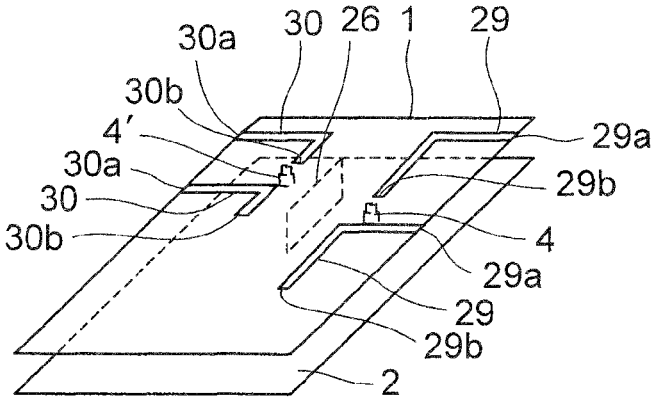
FIG. 14A is a perspective view showing a modified example of the slot antenna according to a fourth exemplary embodiment of the invention.
Figure 14B:
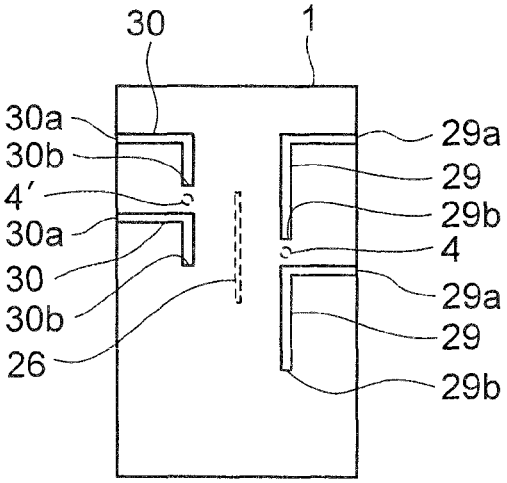
FIG. 14B is a plan view for the same.
Figure 14C:
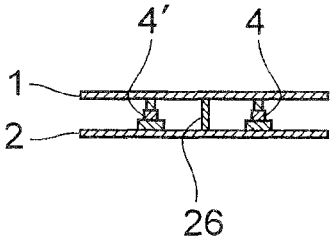
FIG. 14C is a longitudinal sectional view.
Figure 15A:
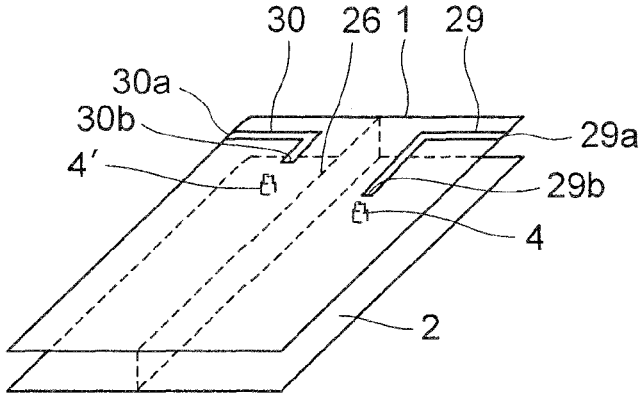
FIG. 15A is a perspective view showing a modified example of the slot antenna according to the fourth exemplary embodiment of the invention.
Figure 15B:
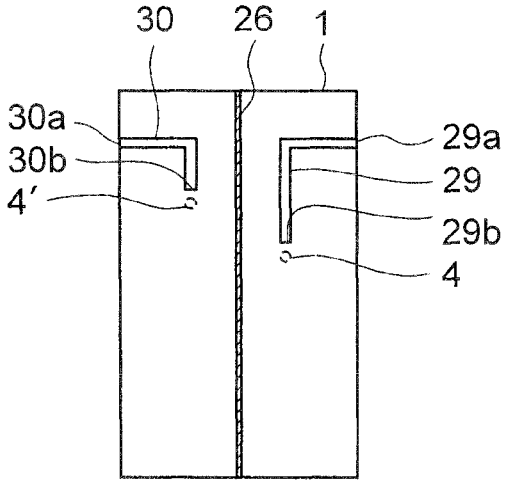
FIG. 15B is a plan view for the same.
Figure 15C:
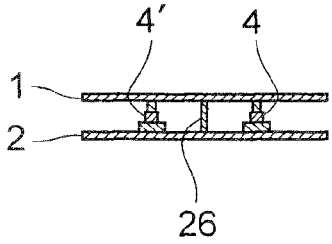
FIG. 15C is a longitudinal sectional view.
Figure 16A:
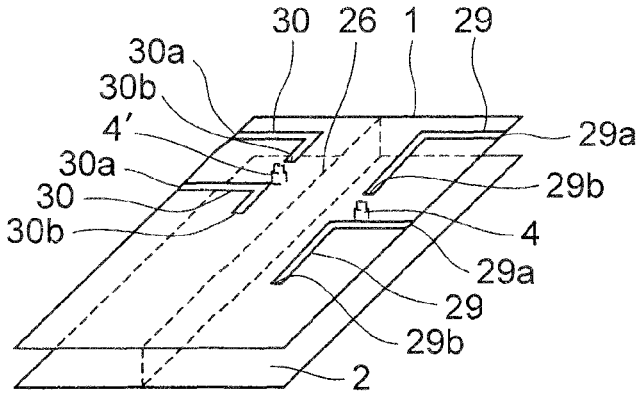
FIG. 16A is a perspective view showing a modified example of the slot antenna according to the fourth exemplary embodiment of the invention.
Figure 16B:
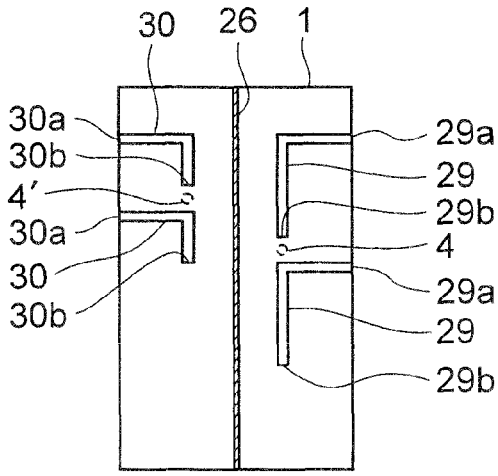
FIG. 16B is a plan view for the same.
Figure 16C:
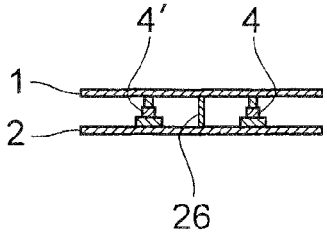
FIG. 16C is a longitudinal sectional view.
Figure 17A:
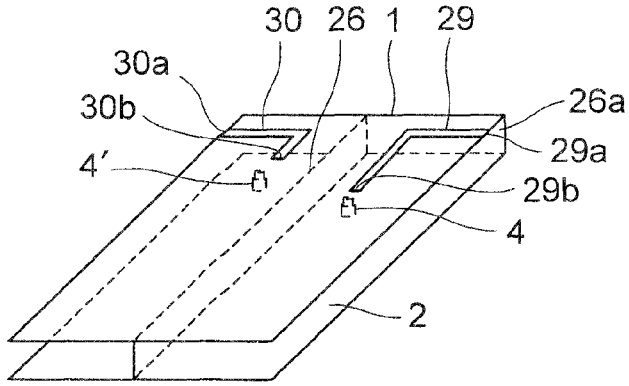
FIG. 17A is a perspective view showing a modified example of the slot antenna according to the fourth exemplary embodiment of the invention.
Figure 17B:
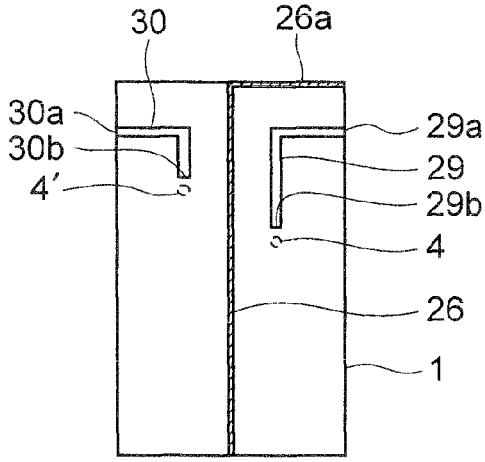
FIG. 17B is a plan view for the same.
Figure 17C:
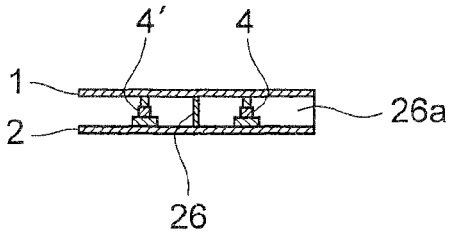
FIG. 17C is a longitudinal sectional view.
Figure 18A:
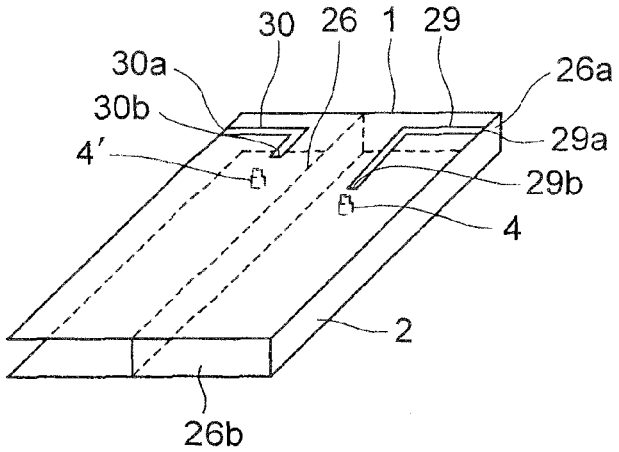
FIG. 18A is a perspective view showing a modified example of the slot antenna according to the fourth exemplary embodiment of the invention.
Figure 18B:
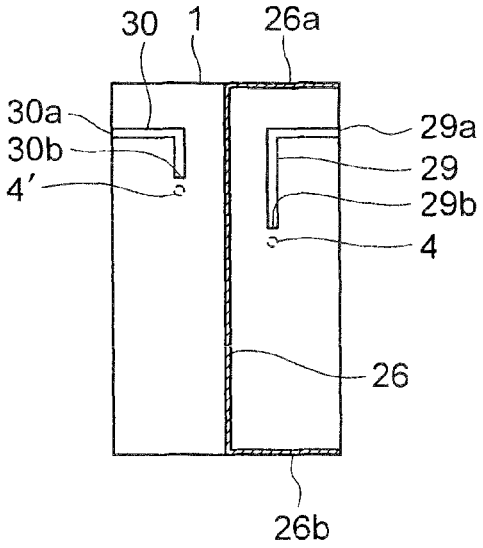
FIG. 18B is a plan view for the same.
Figure 18C:
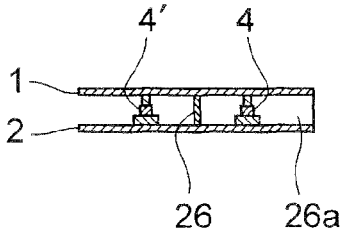
FIG. 18C is a longitudinal sectional view.
Figure 19A:
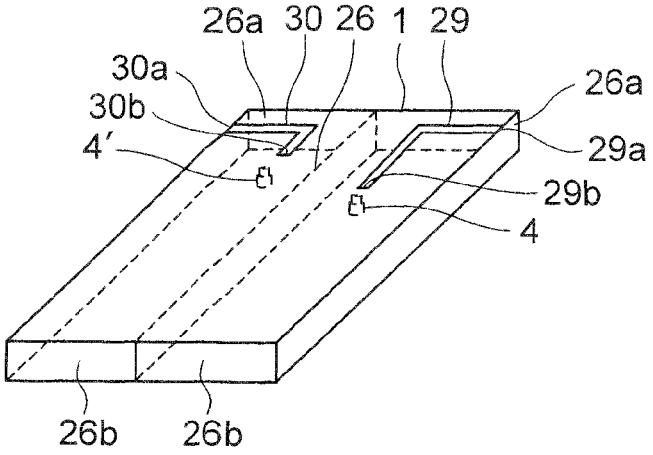
FIG. 19A is a perspective view showing a modified example of the slot antenna according to the fourth exemplary embodiment of the invention.
Figure 19B:
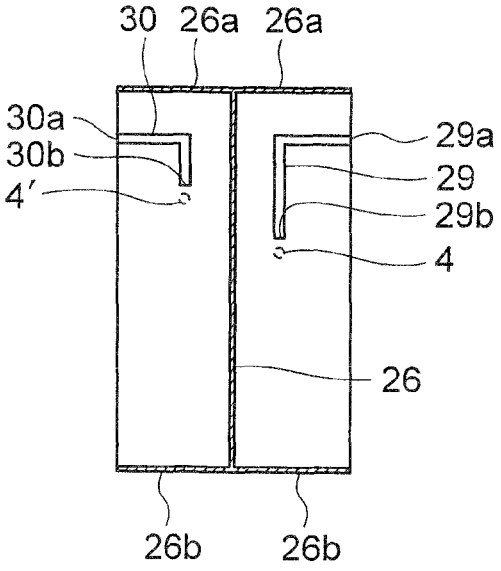
FIG. 19B is a plan view for the same.
Figure 19C:
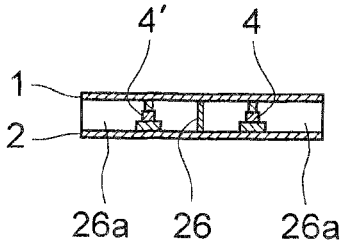
FIG. 19C is a longitudinal sectional view.
Figure 20A:
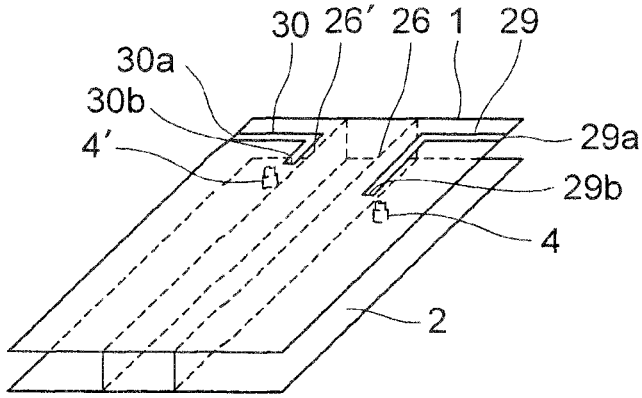
FIG. 20A is a perspective view showing a modified example of the slot antenna according to the fourth exemplary embodiment of the invention.
Figure 20B:
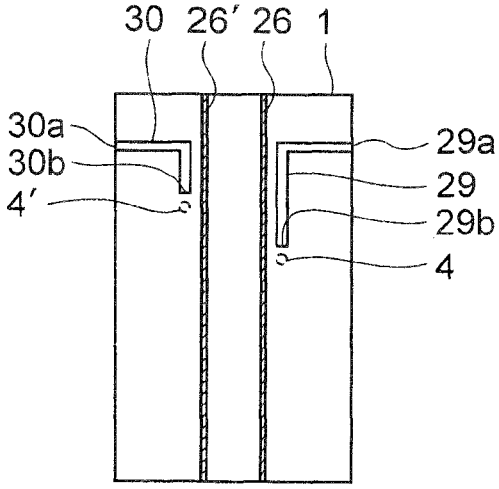
FIG. 20B is a plan view for the same.
Figure 20C:
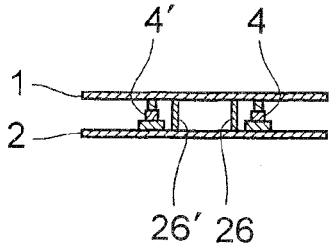
FIG. 20C is a longitudinal sectional view.
Figure 21A:
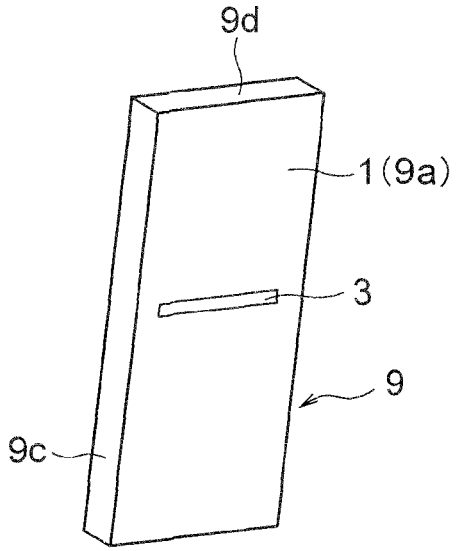
FIG. 21A is a perspective view showing a portable wireless terminal according to a fifth exemplary embodiment of the invention viewed from its back surface side.
Figure 21B:
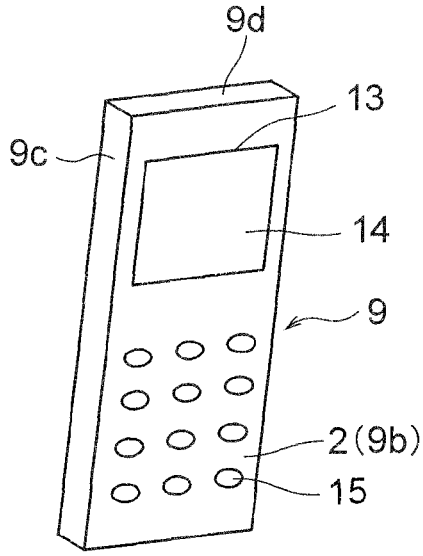
FIG. 21B is a perspective view from its front surface side.
Figure 21C:
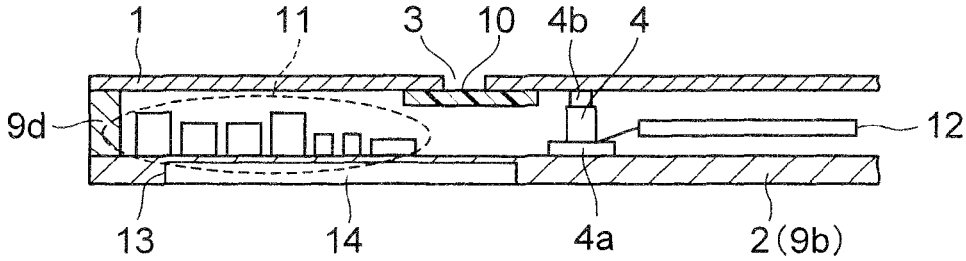
FIG. 21C is a longitudinal sectional view of the portable wireless terminal according to the fifth exemplary embodiment of the invention sectioned in a long side direction.
Figure 21D:
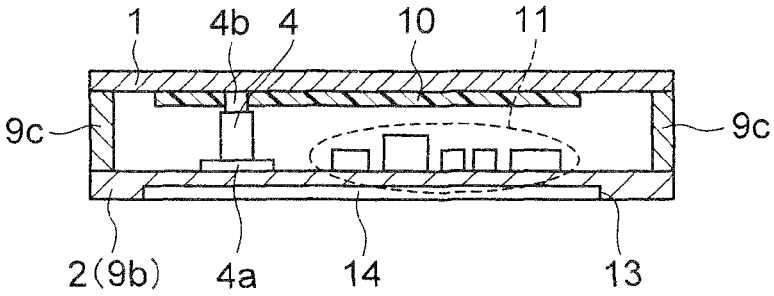
FIG. 21D is a transversal sectional view of the portable wireless terminal according to the fifth exemplary embodiment of the invention sectioned in a short side direction.
Figure 22A:
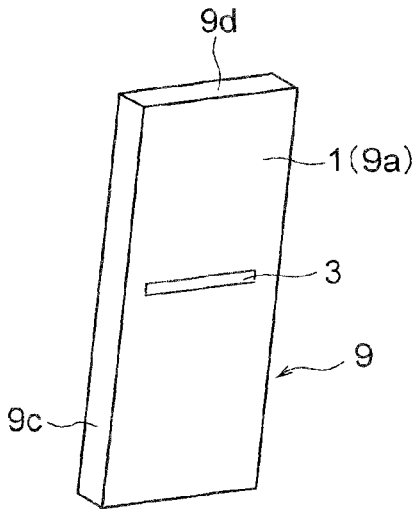
FIG. 22A is a perspective view of a portable wireless terminal according to a sixth exemplary embodiment of the invention viewed from its back surface side.
Figure 22B:
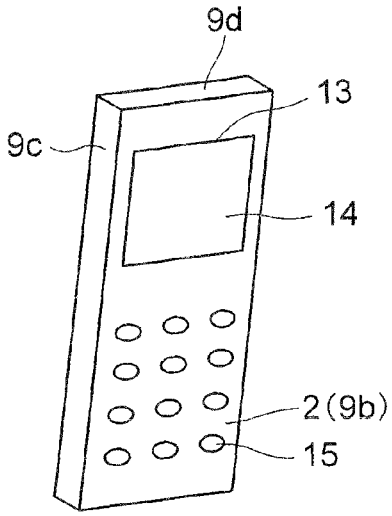
FIG. 22B is a perspective view from its front surface side.
Figure 22C:
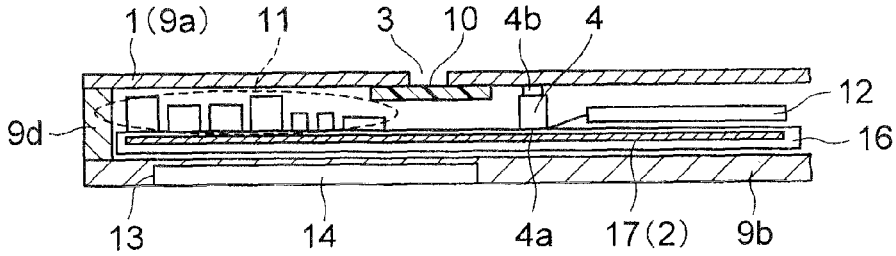
FIG. 22C is a longitudinal sectional view of the portable wireless terminal according to the sixth exemplary embodiment of the invention sectioned in a long side direction.
Figure 22D:
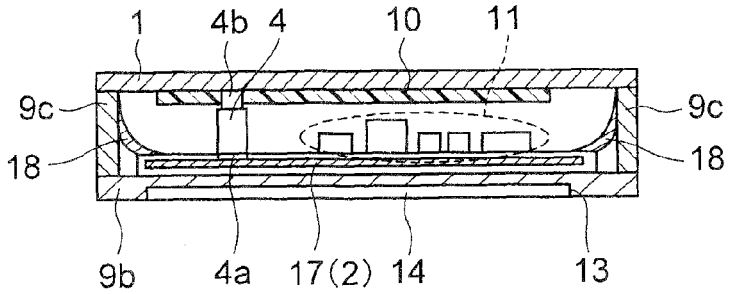
FIG. 22D is a transversal sectional view of the portable wireless terminal according to the sixth exemplary embodiment of the invention sectioned in a short side direction.
Figure 23A:
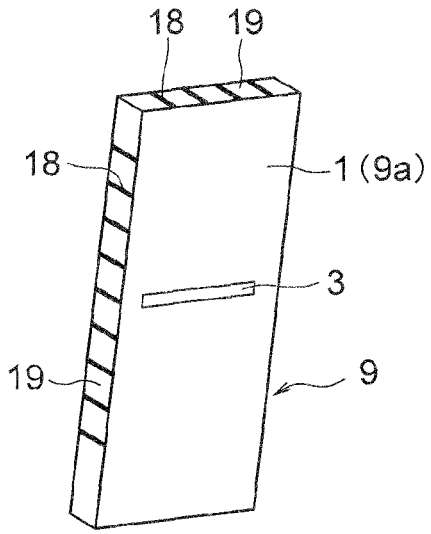
FIG. 23A is a perspective view of a portable wireless terminal according to a seventh exemplary embodiment of the invention viewed from its back surface side.
Figure 23B:
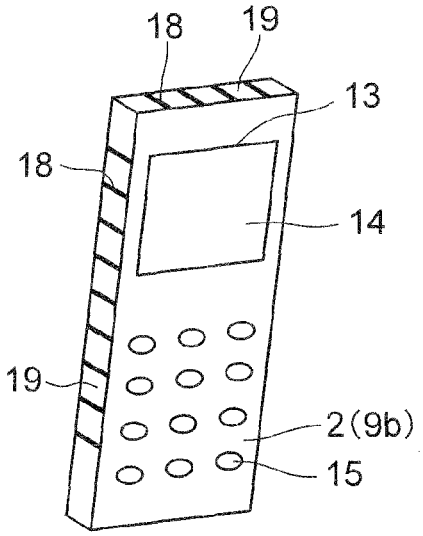
FIG. 23B is a perspective view from its front surface side.
Figure 23C:
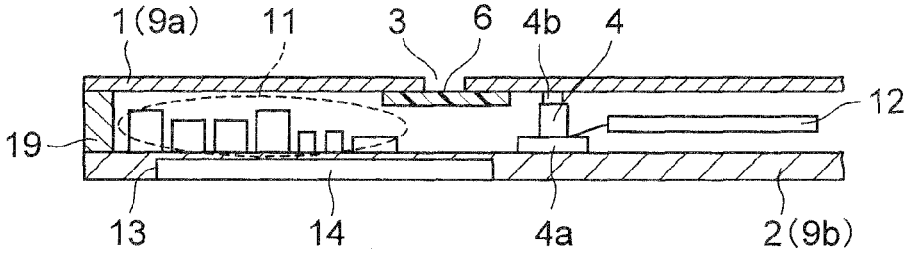
FIG. 23C is a longitudinal sectional view of the portable wireless terminal according to the seventh exemplary embodiment of the invention sectioned in a long side direction.
Figure 23D:
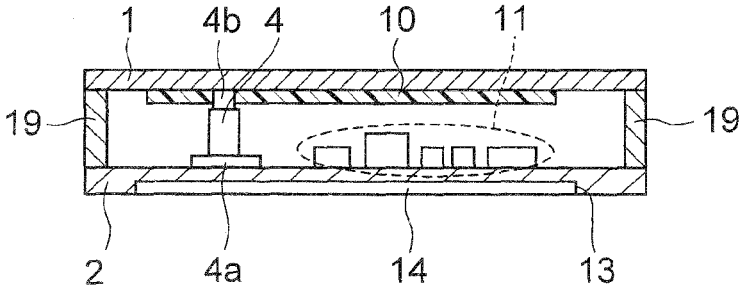
FIG. 23D is a transversal sectional view of the portable wireless terminal according to the seventh exemplary embodiment of the invention sectioned in a short side direction.
Figure 24A:
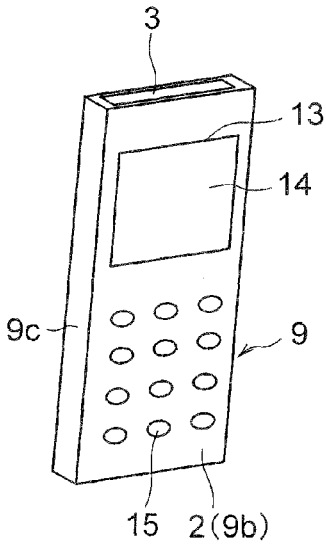
FIGS. 24A, 24B, and 24C are perspective views of a portable wireless terminal according to an eighth exemplary embodiment of the invention viewed from its back surface side.
Figure 24B:
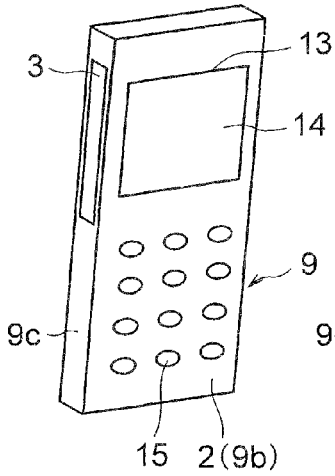
Figure 24C:
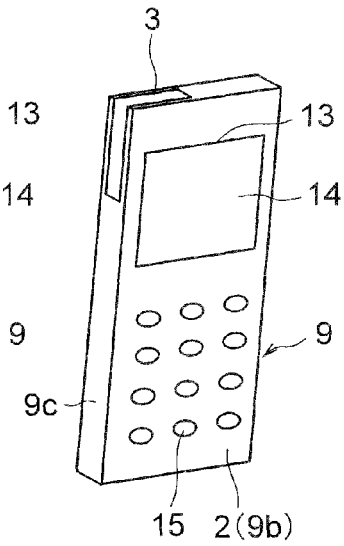
Figure 25A:
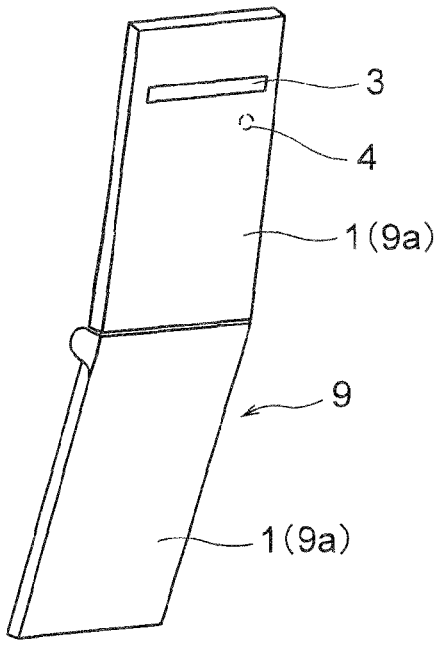
FIG. 25A is a perspective view of a portable wireless terminal according to a ninth exemplary embodiment of the invention viewed from its back surface side.
Figure 25B:
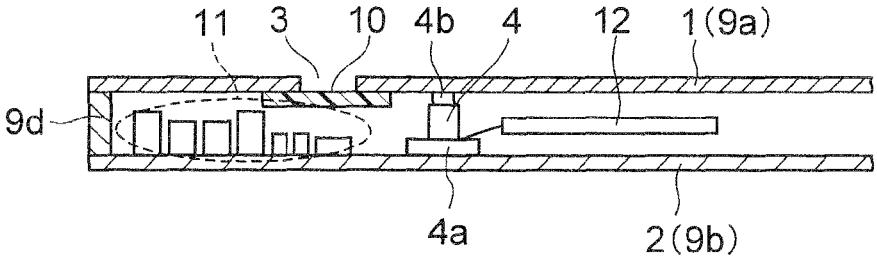
FIG. 25B is a longitudinal sectional view of the portable wireless terminal according to the ninth exemplary embodiment of the invention sectioned in a long side direction.
Figure 25C:
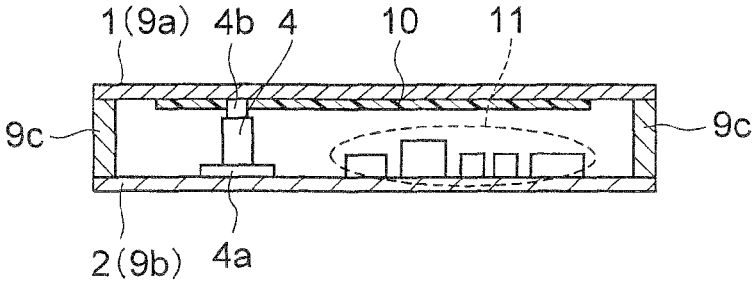
FIG. 25C is a transversal sectional view of the portable wireless terminal according to the ninth exemplary embodiment of the invention sectioned in a short side direction.
Figure 26A:
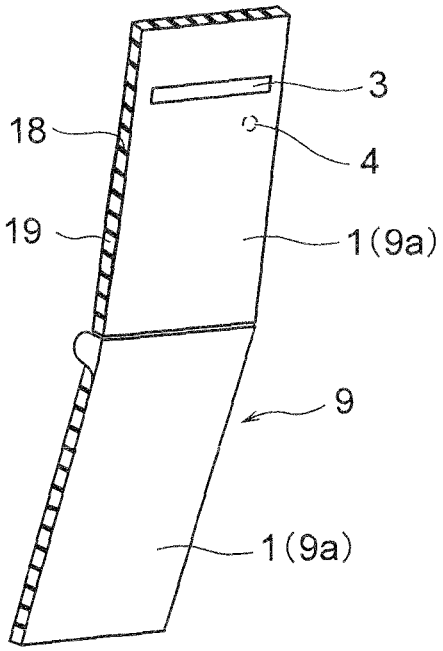
FIG. 26A is a perspective view of a portable wireless terminal according to the tenth exemplary embodiment of the invention viewed from its back surface side.
Figure 26B:
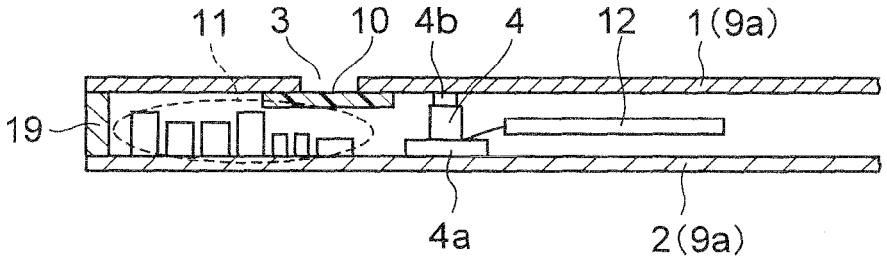
FIG. 26B is a longitudinal sectional view of the portable wireless terminal according to the tenth exemplary embodiment of the invention sectioned in a long side direction.
Figure 26C:
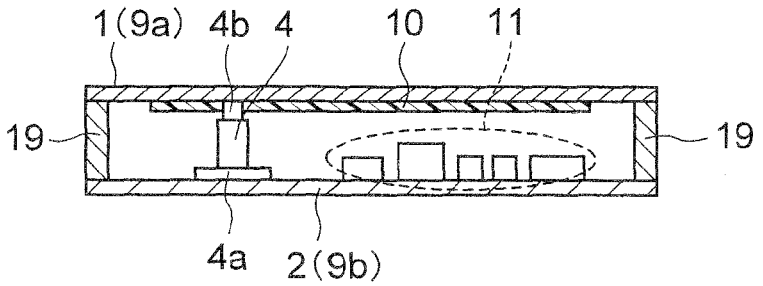
FIG. 26C is a transversal sectional view of the portable wireless terminal according to the tenth exemplary embodiment of the invention sectioned in a short side direction.
Figure 27A:
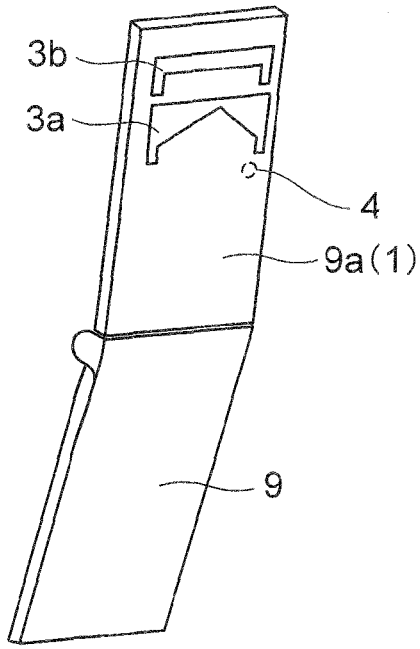
FIG. 27A is a perspective view of a portable wireless terminal according to the eleventh exemplary embodiment of the present invention viewed from its back surface side.
Figure 27B:
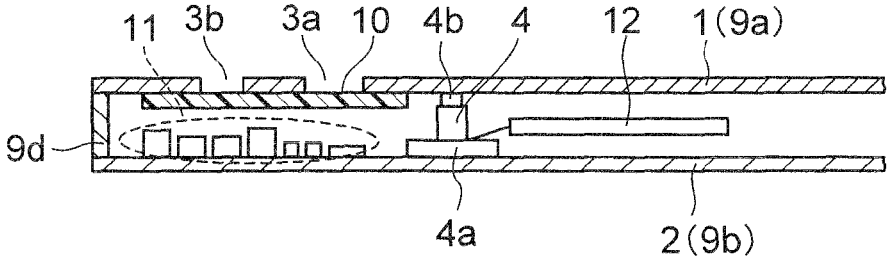
FIG. 27B is a longitudinal sectional view of the portable wireless terminal according to the eleventh exemplary embodiment of the invention sectioned in a long side direction.
Figure 27C:
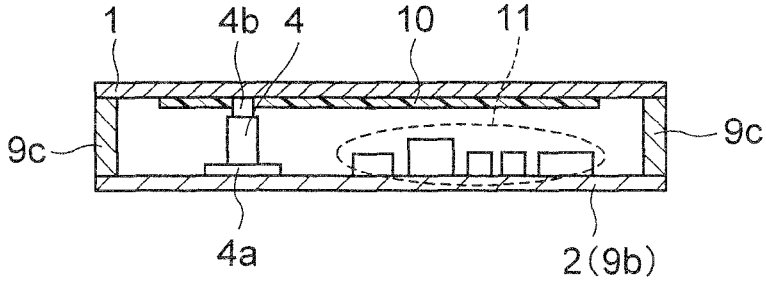
FIG. 27C is a transversal sectional view of the portable wireless terminal according to the eleventh exemplary embodiment of the invention sectioned in a short side direction.
Figure 28A:
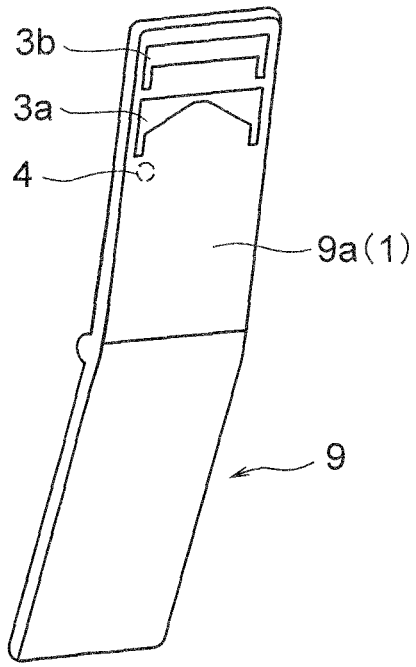
FIG. 28A is a perspective view of a portable wireless terminal according to the eleventh exemplary embodiment of the invention viewed from its back surface side.
Figure 28B:
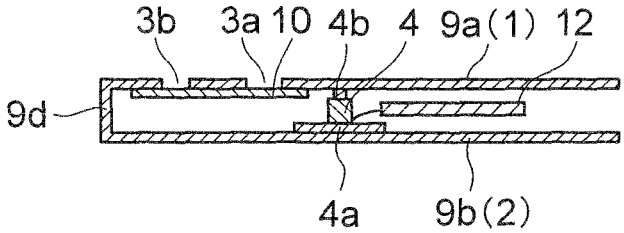
FIG. 28B is a longitudinal sectional view of the portable wireless terminal according to the eleventh exemplary embodiment of the invention sectioned in a long side direction.
Figure 28C:
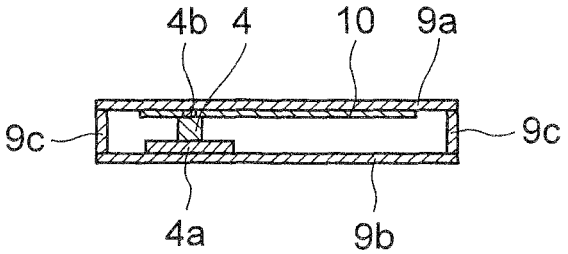
FIG. 28C is a transversal sectional view of the portable wireless terminal according to the eleventh exemplary embodiment of the invention sectioned in a short side direction.
Figure 29A:
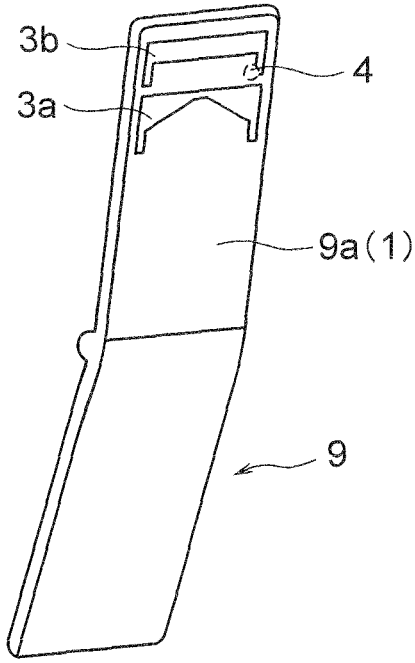
FIG. 29A is a perspective view of a portable wireless terminal according to the eleventh exemplary embodiment of the invention viewed from its back surface side.
Figure 29B:
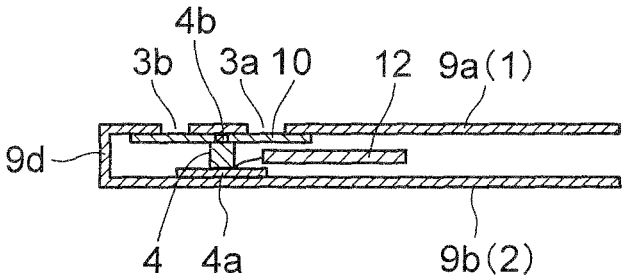
FIG. 29B is a longitudinal sectional view of the portable wireless terminal according to the eleventh exemplary embodiment of the invention sectioned in a long side direction.
Figure 29C:
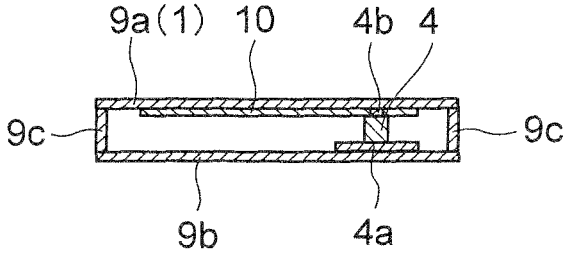
FIG. 29C is a transversal sectional view of the portable wireless terminal according to the eleventh exemplary embodiment of the invention sectioned in a short side direction.
Figure 30A:
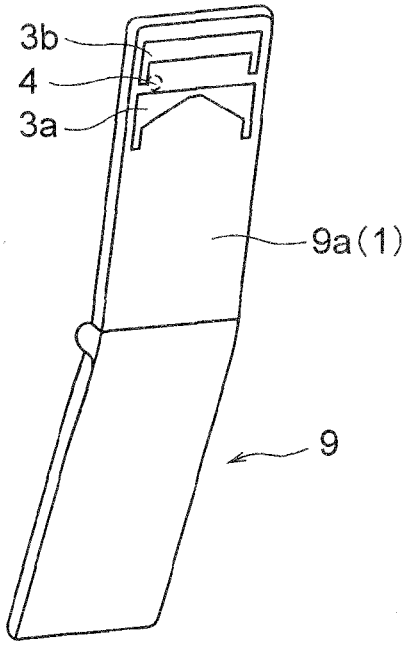
FIG. 30A is a perspective view of a portable wireless terminal according to the eleventh exemplary embodiment of the invention viewed from its back surface side.
Figure 30B:
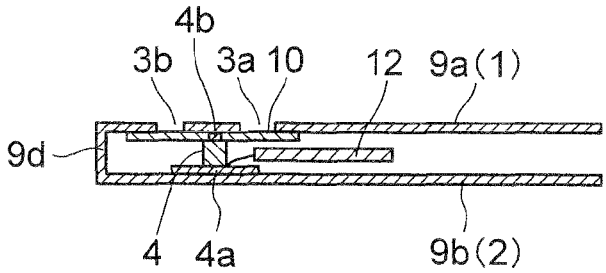
FIG. 30B is a longitudinal sectional view of the portable wireless terminal according to the eleventh exemplary embodiment of the invention sectioned in a long side direction.
Figure 30C:
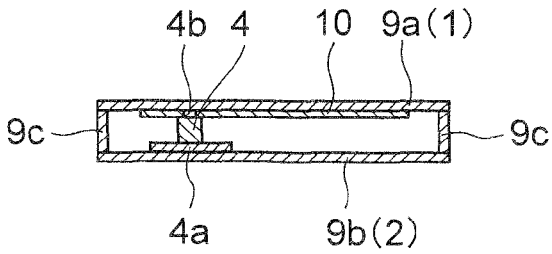
FIG. 30C is a transversal sectional view of the portable wireless terminal according to the eleventh exemplary embodiment of the invention sectioned in a short side direction.
Figure 31A:
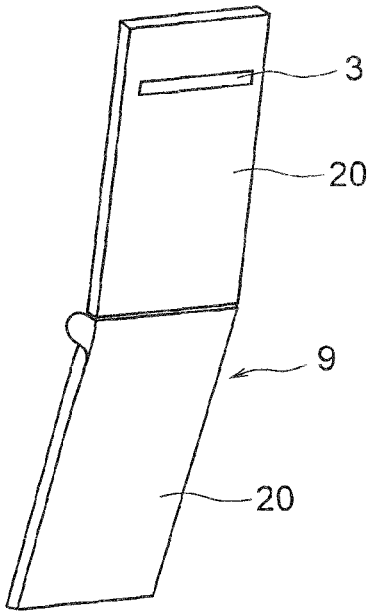
FIG. 31A is a perspective view of a portable wireless terminal according to the twelfth exemplary embodiment of the invention viewed from its back surface side.
Figure 31B:
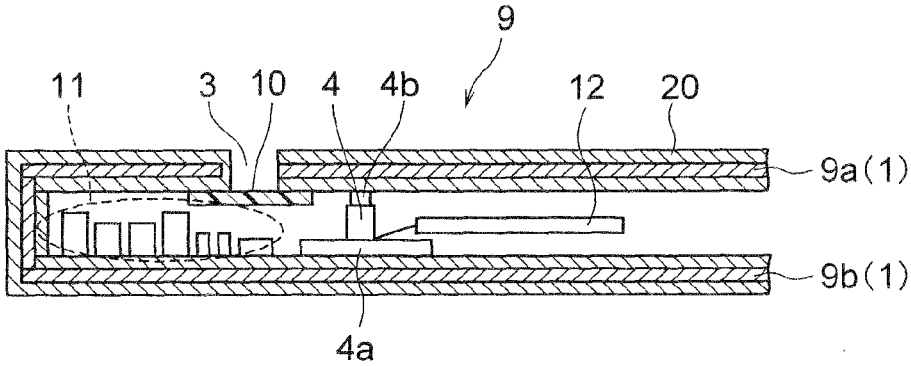
FIG. 31B is a longitudinal sectional view of the portable wireless terminal according to the twelfth exemplary embodiment of the invention sectioned in a long side direction.
Figure 32A:
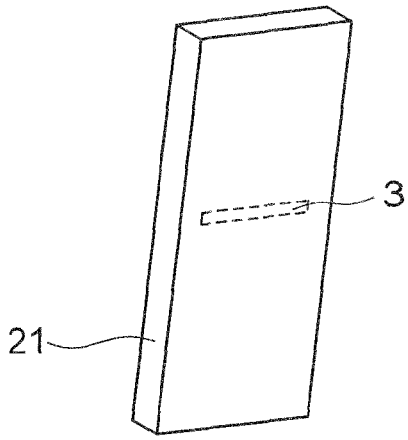
FIG. 32A is a perspective view of a portable wireless terminal according to the twelfth exemplary embodiment of the invention viewed from its back surface side.
Figure 32B:
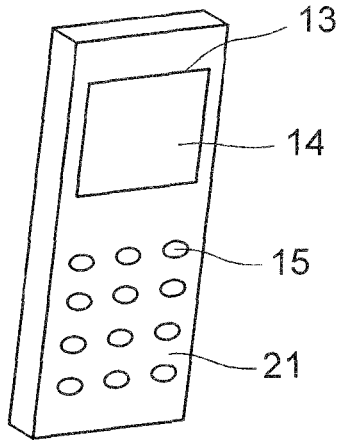
FIG. 32B is a perspective view from its front surface side.
Figure 32C:
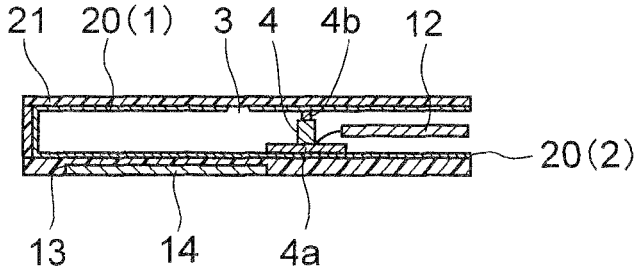
FIG. 32C is a longitudinal sectional view of the portable wireless terminal according to the twelfth exemplary embodiment of the invention sectioned in a long side direction.
Figure 32D:
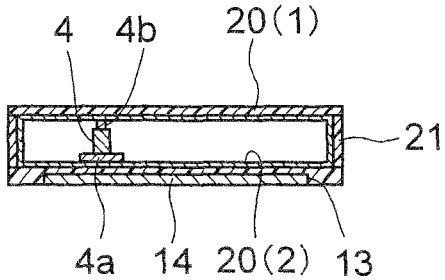
FIG. 32D is a transversal sectional view of the portable wireless terminal according to the twelfth exemplary embodiment of the invention sectioned in a short side direction.
Figure 33A:
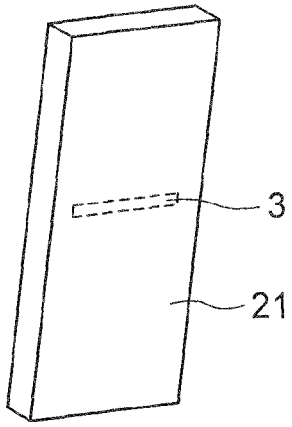
FIG. 33A is a perspective view of a portable wireless terminal according to the twelfth exemplary embodiment of the invention viewed from its back surface side.
Figure 33B:
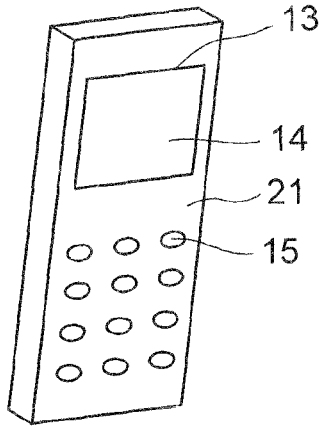
FIG. 33B is a perspective view from its front surface side.
Figure 33C:
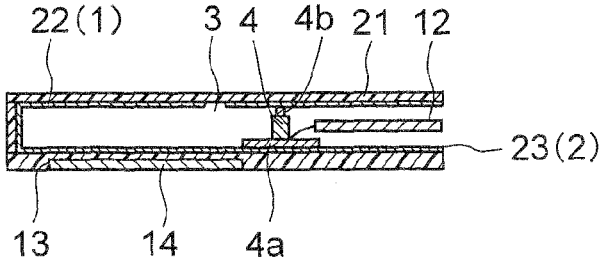
FIG. 33C is a longitudinal sectional view of the portable wireless terminal according to the twelfth exemplary embodiment of the invention sectioned in a long side direction.
Figure 33D:
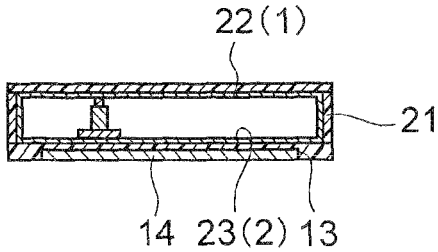
FIG. 33D is a transversal sectional view of the portable wireless terminal according to the twelfth exemplary embodiment of the invention sectioned in a short side direction.
Figure 33E:
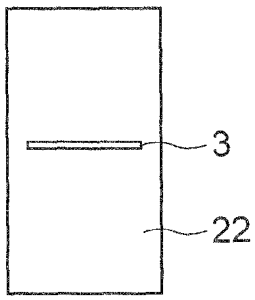
FIG. 33E is a diagram showing a printed substrate having a slot pattern.
Figure 33F:
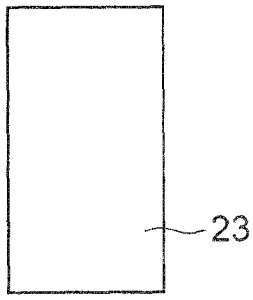
FIG. 33F is a printed substrate having a solid GND pattern.
Figure 34A:
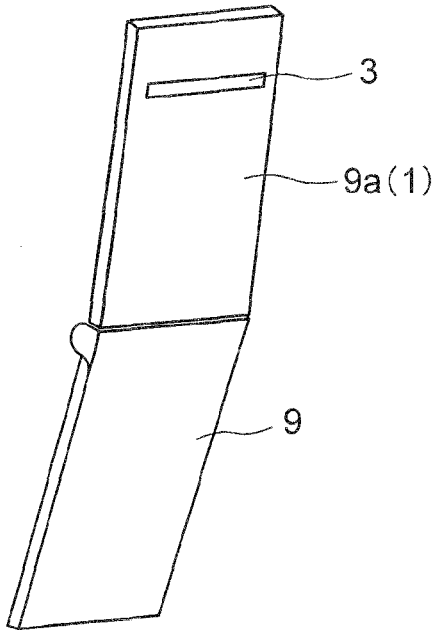
FIG. 34A is a perspective view of a portable wireless terminal according to the thirteenth exemplary embodiment of the invention viewed from its back surface side.
Figure 34B:
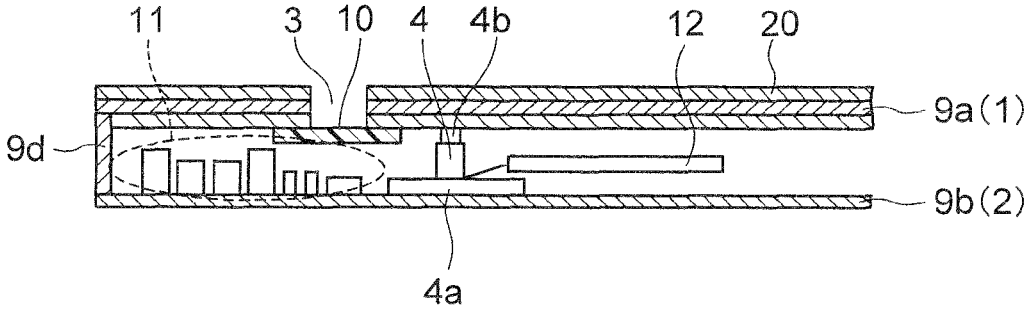
FIG. 34B is a longitudinal sectional view of the portable wireless terminal according to the thirteenth exemplary embodiment of the invention sectioned in a long side direction.
Figure 35A:
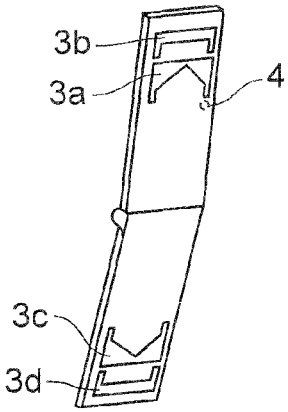
FIG. 35A is a perspective view showing a portable wireless terminal according to the fourteenth exemplary embodiment of the invention.
Figure 35B:
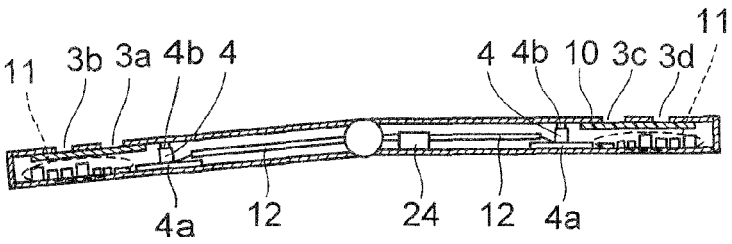
FIG. 35B is a longitudinal sectional view of the portable wireless terminal according to the fourteenth exemplary embodiment of the invention sectioned in a long side direction.
Figure 35C:
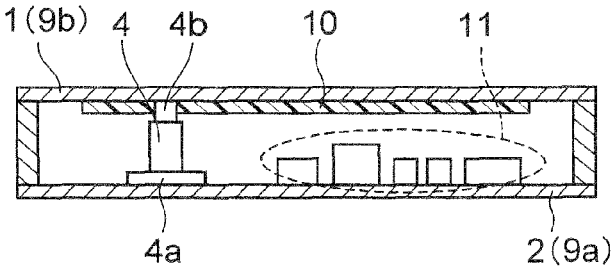
FIG. 35C is a transversal sectional view of the portable wireless terminal according to the fourteenth exemplary embodiment of the invention sectioned in a short side direction.
Figure 35D:
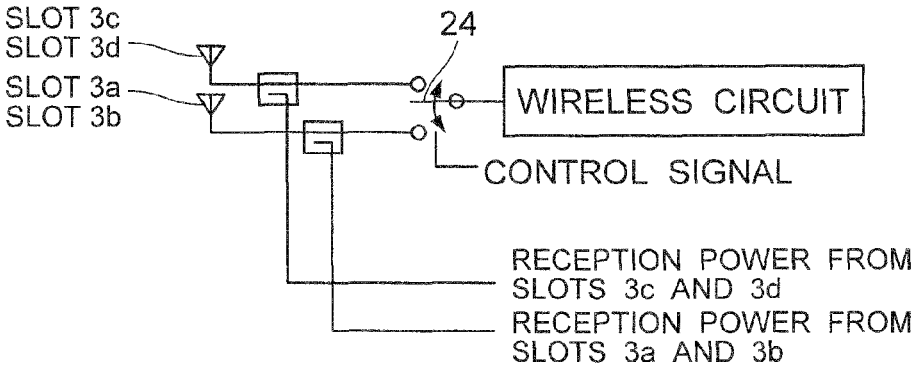
FIG. 35D is a schematic view showing antenna connections in the portable wireless terminal.
Figure 36A:
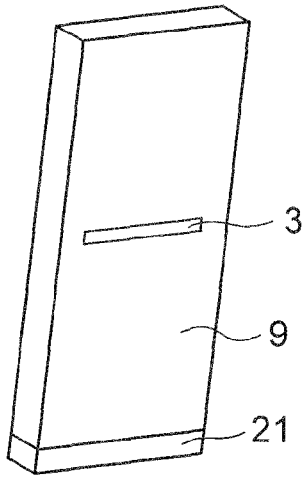
FIG. 36A is a perspective view of a portable wireless terminal according to the fifteenth exemplary embodiment of the invention viewed from its back surface side.
Figure 36B:
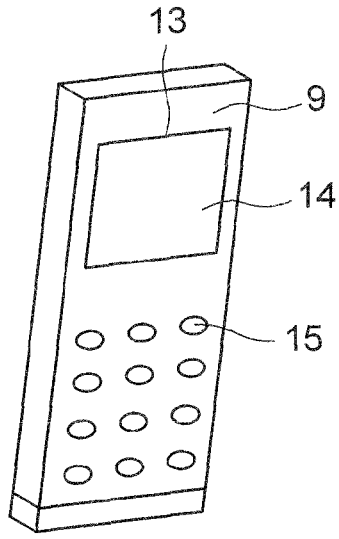
FIG. 36B is a perspective view from the front surface side.
Figure 36C:
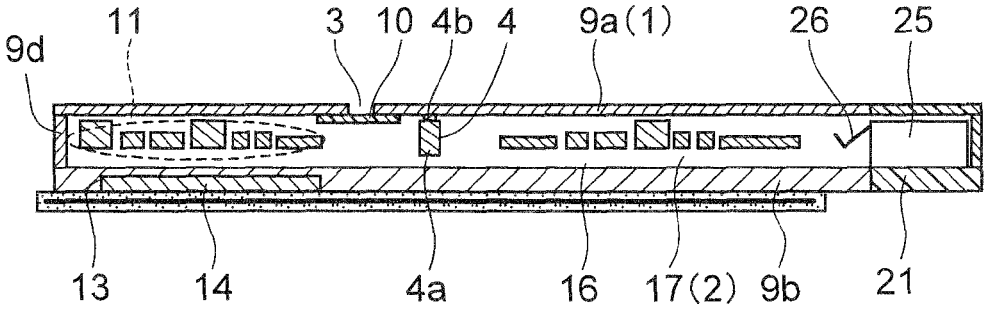
FIG. 36C is a longitudinal sectional view of the portable wireless terminal according to the fifteenth exemplary embodiment of the invention sectioned in a long side direction.
Figure 36D:
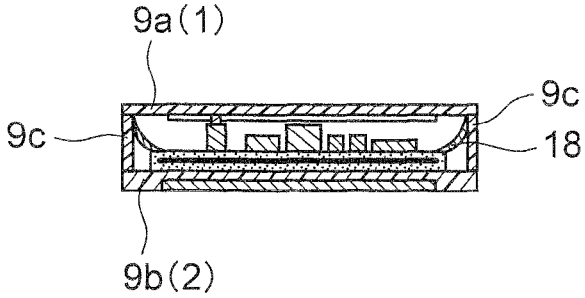
FIG. 36D is a transversal sectional view of the portable wireless terminal according to the fifteenth exemplary embodiment of the invention sectioned in a short side direction.
Figure 37A:
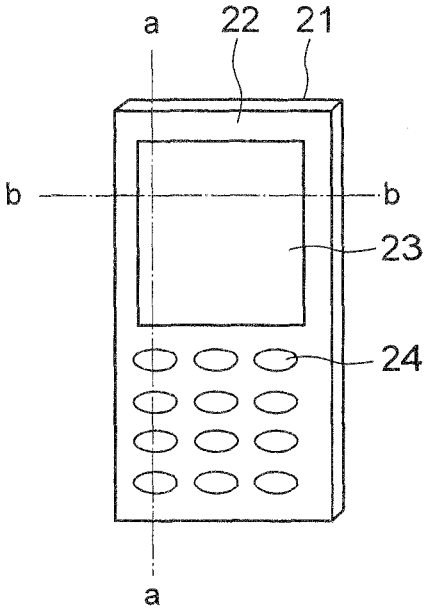
FIG. 37A is a perspective view from a front surface side showing a portable wireless terminal according to the sixteenth exemplary embodiment of the invention adopting the slot antenna shown in FIG. 12.
Figure 37B:
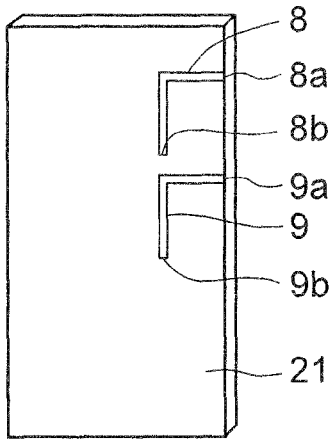
FIG. 37B is a perspective view from a back surface side.
Figure 37C:
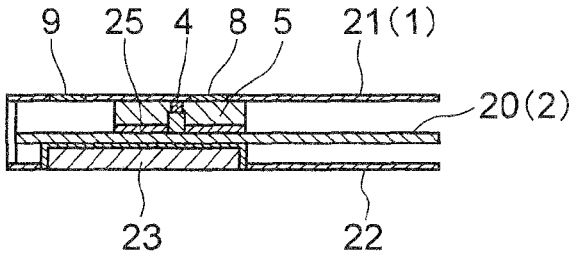
FIG. 37C is a cross-sectional view of FIG. 37A taken along line a-a.
Figure 37D:
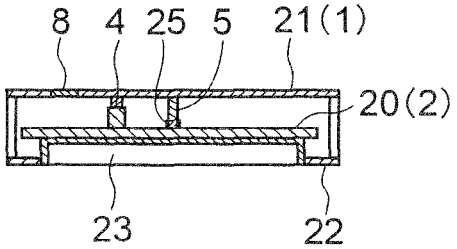
FIG. 37D is a cross-sectional view of FIG. 37A taken along line b-b.
Figure 38A:
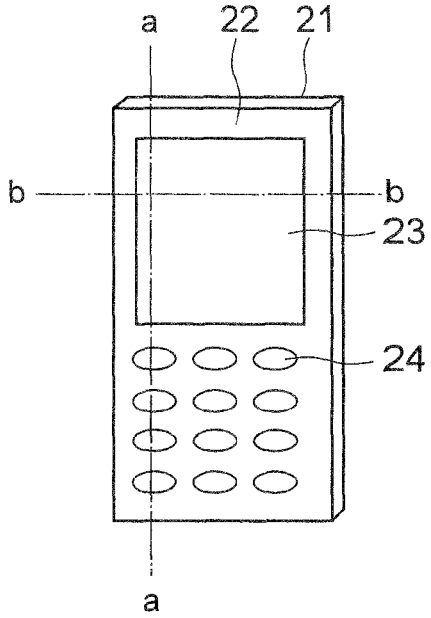
FIG. 38A is a perspective view from a front surface side showing a modified example of the portable wireless terminal according to the sixteenth exemplary embodiment of the invention adopting the slot antenna shown in FIG. 12.
Figure 38B:
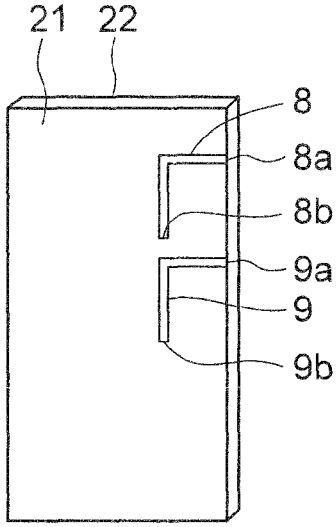
FIG. 38B is a perspective view from a back surface side.
Figure 38C:
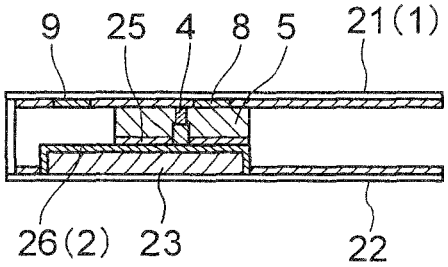
FIG. 38C is a cross-sectional view of FIG. 38A taken along line a-a.
Figure 38D:
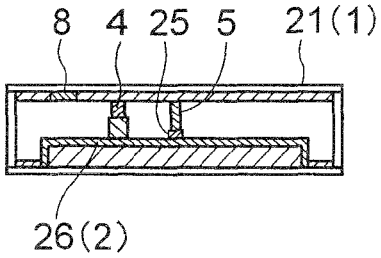
FIG. 38D is a cross-sectional view of FIG. 38A taken along line b-b.
Figure 39A:
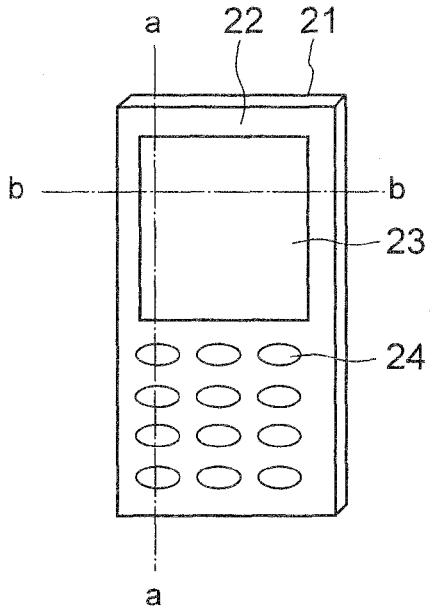
FIG. 39A is a perspective view from a front surface side showing a modified example of the portable wireless terminal according to the sixteenth exemplary embodiment of the invention adopting the slot antenna shown in FIG. 12.
Figure 39B:
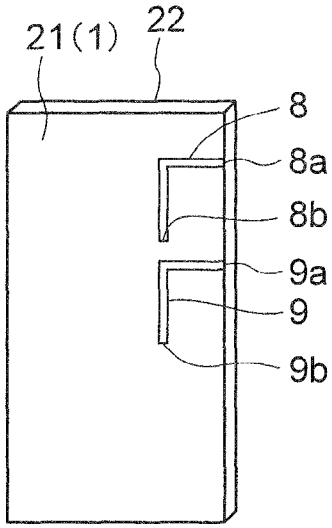
FIG. 39B is a perspective view from a back surface side.
Figure 39C:
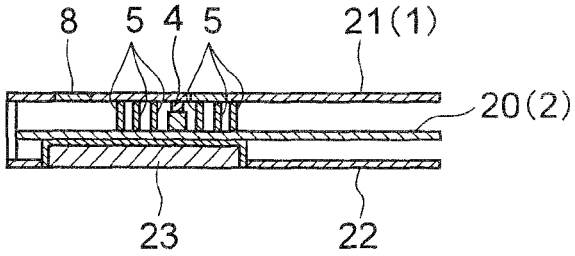
FIG. 39C is a cross-sectional view of FIG. 39A taken along line a-a.
Figure 39D:
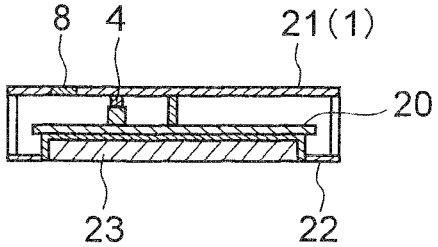
FIG. 39D is a cross-sectional view of FIG. 39A taken along line b-b.
Figure 40A:
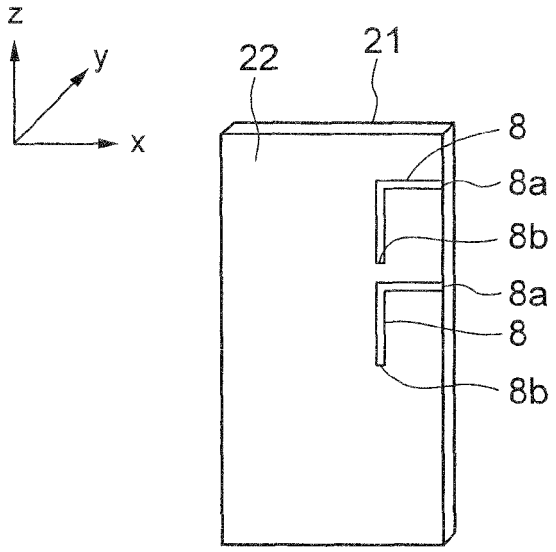
FIG. 40A is a perspective view showing antenna directivity in a portable wireless terminal according to the eighteenth exemplary embodiment.
Figure 40B:
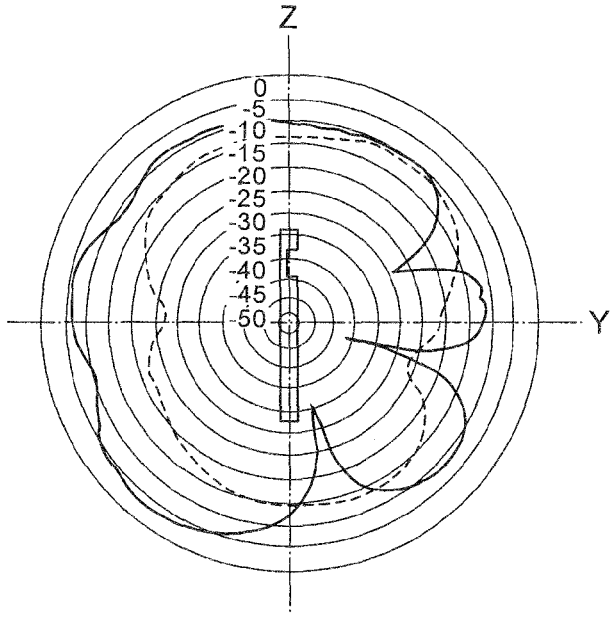
FIG. 40B is a diagram showing radiation patterns with portable wireless terminals according to the eighteenth and nineteenth exemplary embodiments.
Figure 41A:
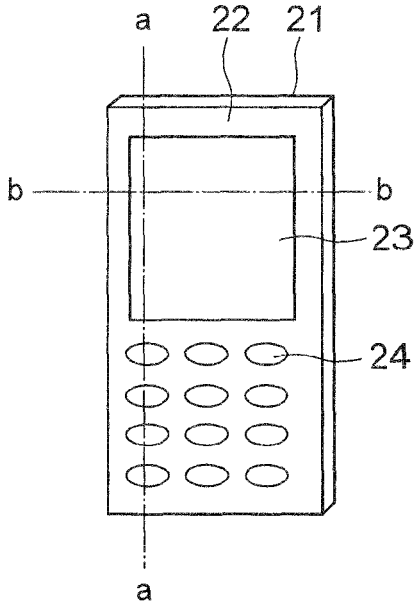
FIG. 41A is a perspective view from a front surface side showing the portable wireless terminal according to the nineteenth exemplary embodiment of the invention adopting the slot antenna shown in FIG. 16.
Figure 41B:
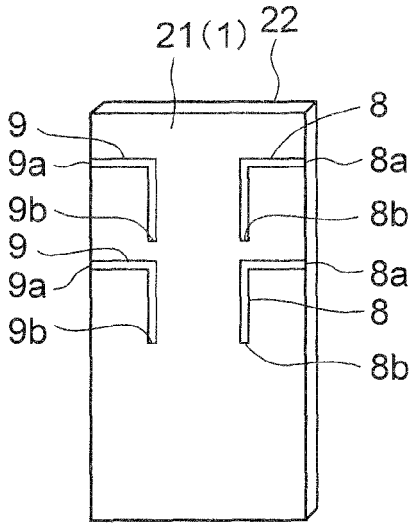
FIG. 41B is a perspective view from a back surface side.
Figure 41C:
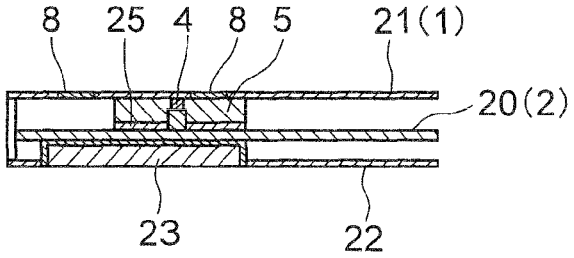
FIG. 41C is a cross-sectional view of FIG. 41A taken along line a-a.
Figure 41D:
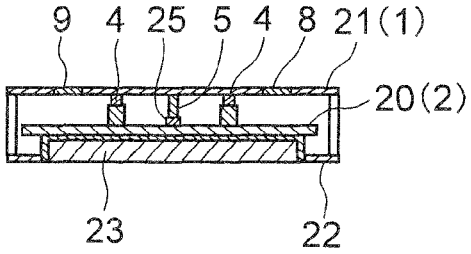
FIG. 41D is a cross-sectional view of FIG. 41A taken along line b-b.
Figure 42A:
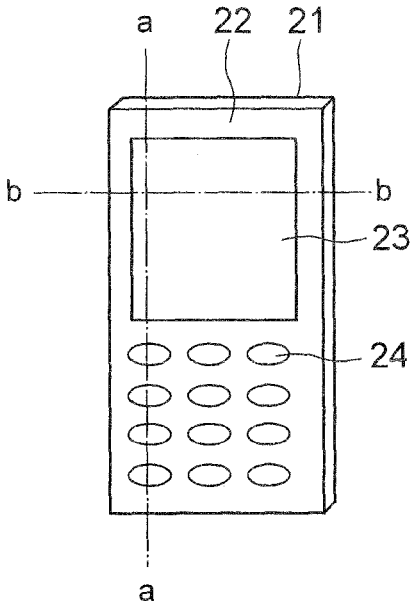
FIG. 42A is a perspective view from a front surface side showing a modified example of the portable wireless terminal according to the nineteenth exemplary embodiment of the invention adopting the slot antenna shown in FIG. 16.
Figure 42B:
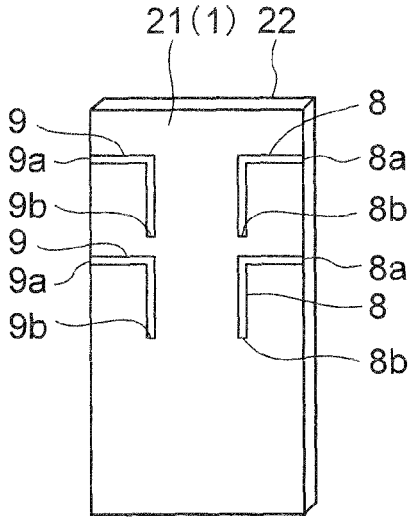
FIG. 42B is a perspective view from a back surface side.
Figure 42C:
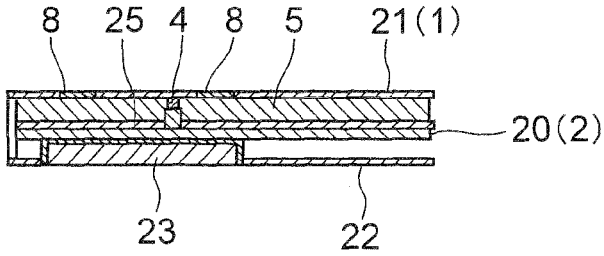
FIG. 42C is a cross-sectional view of FIG. 42A taken along line a-a.
Figure 42D:
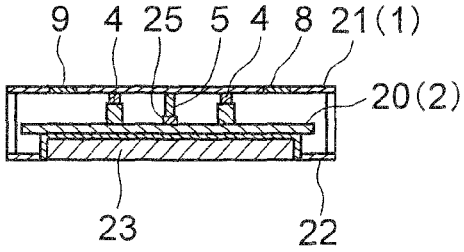
FIG. 42D is a cross-sectional view of FIG. 42A taken along line b-b.
Figure 43A:
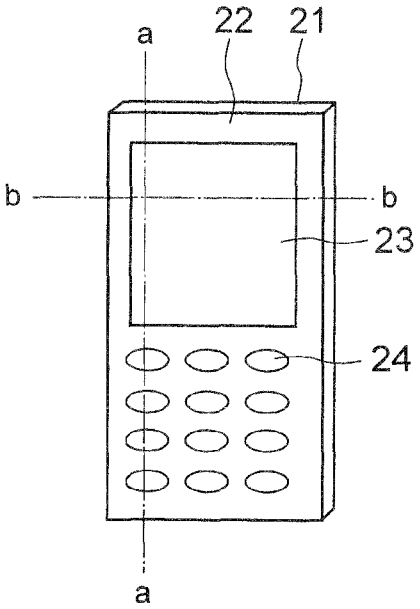
FIG. 43A is a perspective view from a front surface side showing a modified example of the portable wireless terminal according to the nineteenth exemplary embodiment of the invention adopting the slot antenna shown in FIG. 16.
Figure 43B:
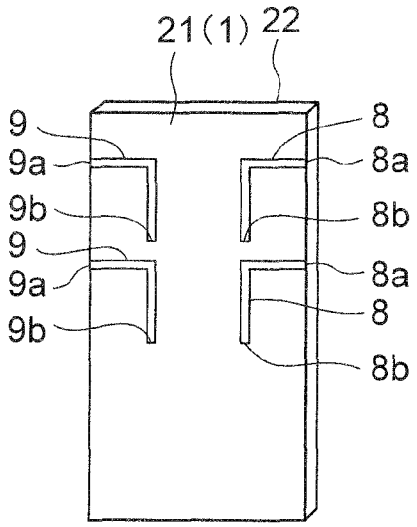
FIG. 43B is a perspective view from a back surface side.
Figure 43C:
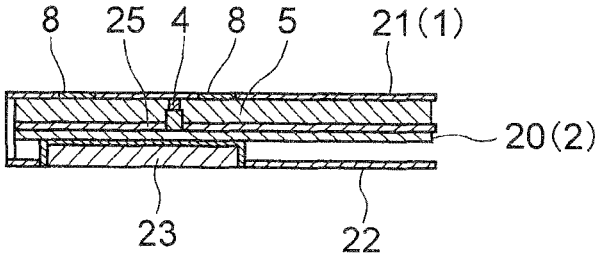
FIG. 43C is a cross-sectional view of FIG. 43A taken along line a-a.
Figure 43D:
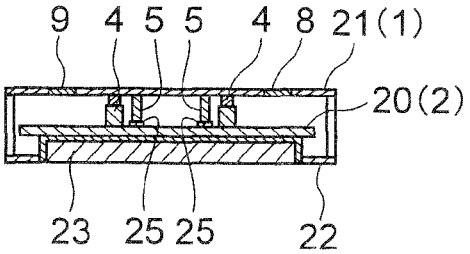
FIG. 43D is a cross-sectional view of FIG. 43A taken along line b-b.
Figure 44A:
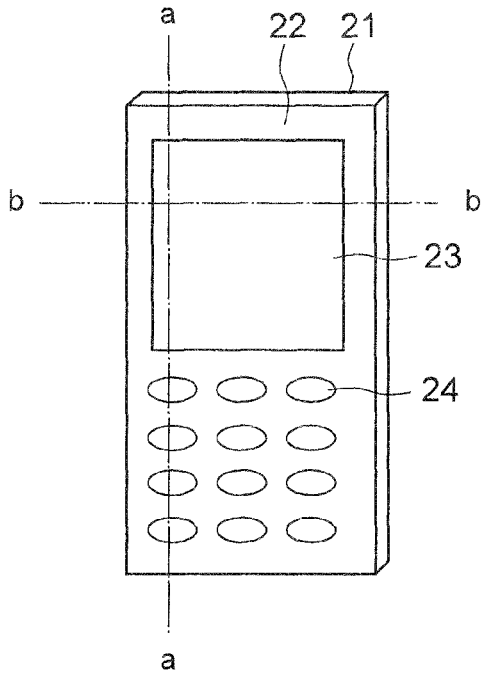
FIG. 44A is a perspective view from a front surface side showing a modified example of the portable wireless terminal according to the eighteenth exemplary embodiment of the invention adopting the slot antenna shown in FIG. 37.
Figure 44B:
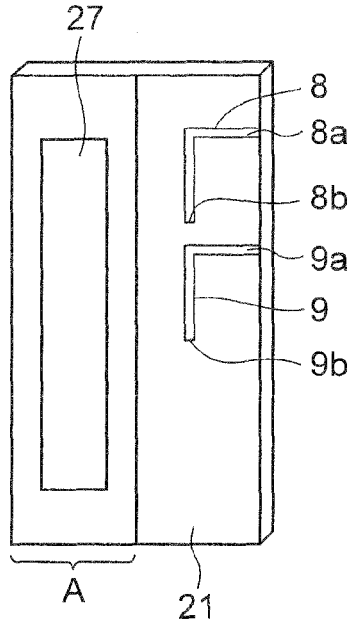
FIG. 44B is a perspective view from a back surface side.
Figure 44C:
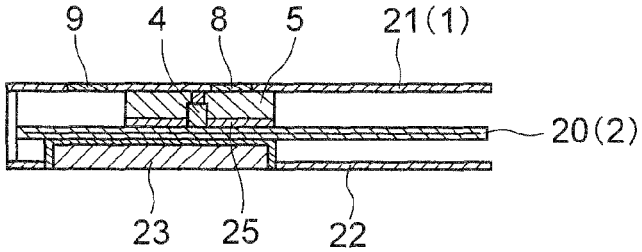
FIG. 44C is a cross-sectional view of FIG. 44A taken along line a-a.
Figure 44D:
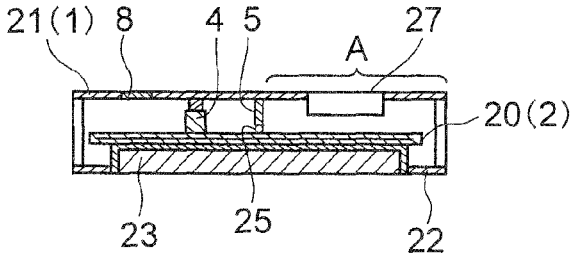
FIG. 44D is a cross-sectional view of FIG. 44A taken along line b-b.
Figure 45:
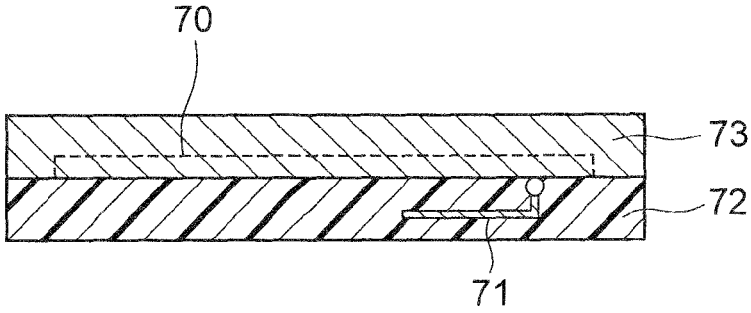
[FIG. 45] FIG. 45 A longitudinal sectional view showing a basic construction example of a wireless terminal device in a related art (Patent Document 1)
Figure 46A:
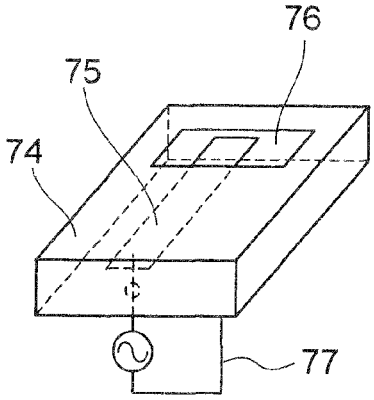
FIG. 46A is a perspective view showing a basic construction example of a wireless terminal device in a related art (Patent Document 2)
Figure 46B:
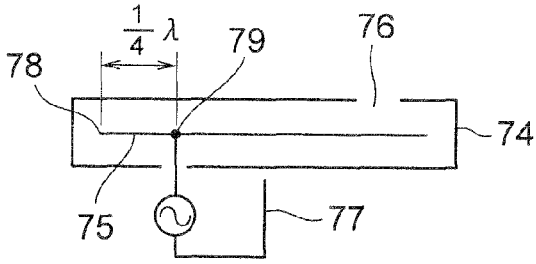
FIG. 46B is a longitudinal sectional view for the same.
Figure 46C:
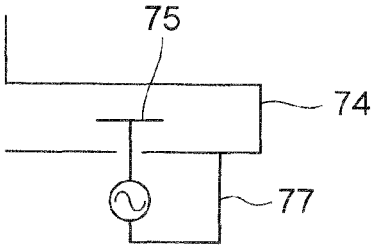
FIG. 46C is a transversal sectional view for the same.
Figure 47A:
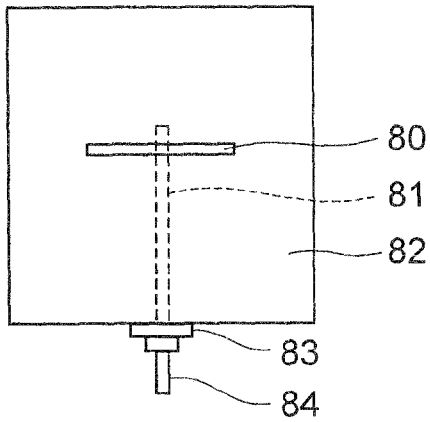
FIG. 47A is a plan view showing a basic construction example of a small basic wireless antenna in a conventional art (Patent Document 3)
Figure 47B:
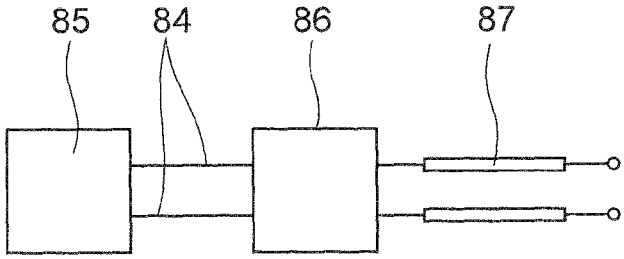
FIG. 47B is a schematic view showing antenna connections in the small basic wireless antenna.
Figure 48A:
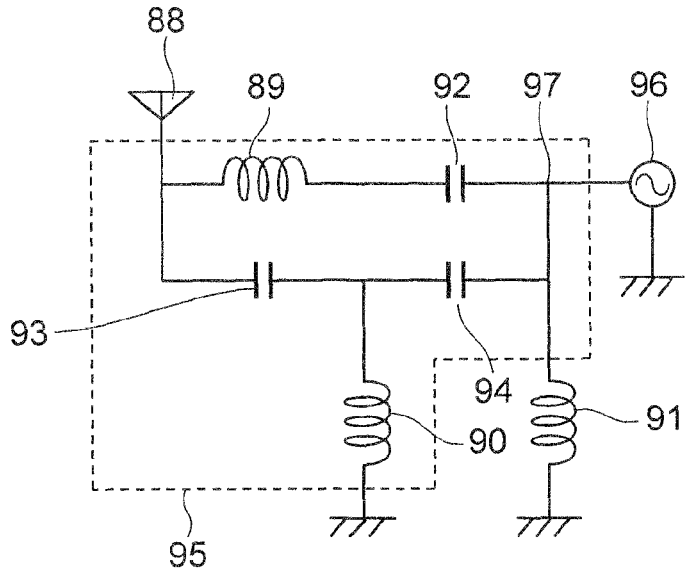
FIG. 48A is a circuit diagram showing a dual resonant antenna device in a related art (Patent Document 4) and FIG. 48B is a frequency characteristic obtained by the dual resonant antenna device.
Figure 48B:
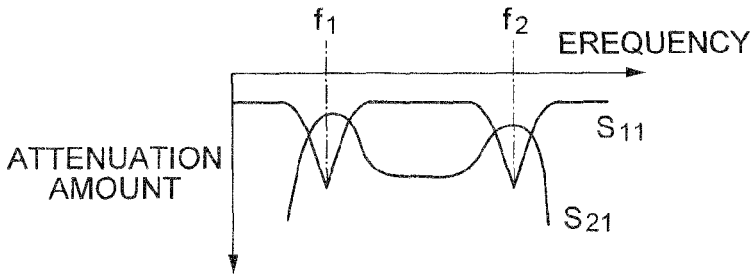
Figure 49:
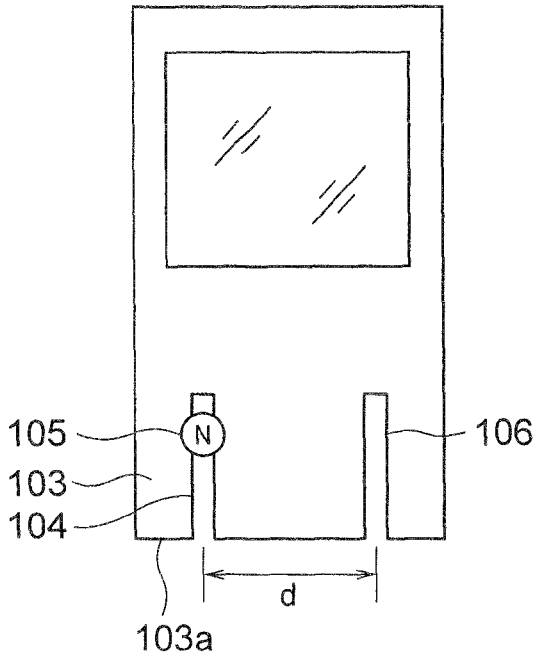
[FIG. 49] A diagram showing an antenna construction example of a related portable wireless terminal.

FIRST CONDUCTIVE PLATE
2 SECOND CONDUCTIVE PLATE
3 SLOT
4 FEED UNIT
5 METAL PLATE
6 METAL FILM
7 PLASTIC PLATE
8 IMPEDANCE MATCHING AREA
9 CASE
9*a*, 9*b* METAL FRAME
12 FEED LINE

The invention claimed is:

1. A slot antenna, comprising:

at least two conductive plates facing each other, at least one of said conductive plates having a plurality of slots formed therein;

a plurality of feed units connected electrically and physically to each of the facing conductive plates; and a metal wall, electrically and physically connecting said at least two conductive plates, and electromagnetically separating said at least two conductive plates into a plurality of areas, wherein each of the slots is an elongated opening extending from a first end to a second end, each of said first and second ends of the opening terminating within an area inside a periphery of the at least one conductive plate, wherein each of the slots is arranged in one of the plurality of areas electromagnetically separated by the metal wall, and wherein each of the plurality of feed units for feeding the slots is located in an impedance matching area of the at least one conductive plate.

2. The slot antenna as claimed in claim 1, wherein the conductive plate is a metal film laid on a plastic plate.

3. The slot antenna as claimed in claim 1, wherein the conductive plate is a metal film laid on a metal plate.

4. The slot antenna as claimed in claim 2, wherein a thickness of the metal film is equal to or more than a skin depth specified by a usable frequency and a material of the metal film.

5. The slot antenna as claimed in claim 1, wherein a metal wall matches the impedance between the slots and the feed units.

6. The slot antenna as claimed in claim 5, wherein the metal wall is disposed near the feed units, and an interval between the feed units and the metal wall is equal to or less than an electrical length corresponding to a 1/10 wavelength of a usable frequency of the antenna.

7. The slot antenna as claimed in claim 1, wherein the openings of the slots arranged in the plurality of areas separated by the metal wall are different from each other in length.

8. The slot antenna as claimed in claim 1, wherein the metal wall is disposed on the conductive plates entirely in a longitudinal direction, so that the conductive plates are electromagnetically separated into two in right and left by the metal wall.

9. The slot antenna as claimed in claim 8, wherein one end of the metal wall is extended to short sides of the conductive plates to be arranged thereat.

10. The slot antenna as claimed in claim 8, wherein both ends of the metal wall are extended to short sides of the conductive plates to be arranged thereat.

11. The slot antenna as claimed in claim 10, wherein the both ends of the metal wall are extended to short sides of the conductive plates in right and left to be arranged thereat.

12. A portable wireless terminal having the slot antenna of claim 1.

13. A portable wireless terminal, comprising:

at least two conductive plates facing each other, at least one of said conductive plate having a slot formed therein;

a feed unit connected electrically and physically to each of the facing conductive plates; and a metal wall electrically and physically connecting said at least two conductive plates and electromagnetically separating said at least two conductive plates into a plurality of areas, wherein the slot is an elongated opening extending from a first end to a second end, each of said first and second ends of the opening terminating within an area inside a periphery of the at least one conductive plate, the slot being located at one of the plurality of areas electromagnetically separated by the metal wall, wherein the feed unit for feeding the slot is located in an impedance matching area delimited by a semi-elliptical shape centered around a center point of the slot and extending symmetrically with respect to the slot, and wherein the conductive plates form and function as a case of the portable wireless terminal.

14. The portable wireless terminal as claimed in claim 13, wherein the case of the portable wireless terminal formed of the conductive plates comprises a ground pattern formed on a print substrate housed inside the case, and a metal contact arranged at an outer edge section of a whole circumference in the ground pattern, the metal contact electrically connecting the ground pattern with the case.

15. The portable wireless terminal as claimed in claim 13, wherein side walls of the case of the portable wireless terminal formed of the conductive plates are composed of a metal contact and a plastic frame.

16. The portable wireless terminal as claimed in claim 13, wherein a part of the conductive plates is a metal frame, and the metal frame has the slot formed therein.

17. The portable wireless terminal as claimed in claim 13, wherein a part of the conductive plates that form the case of the portable wireless terminal is removed to form a mounting area, and circuit components of the portable wireless terminal are mounted to the portable wireless terminal in said mounting area.

* * * * *

UNITED STATES PATENT AND TRADEMARK OFFICE

CERTIFICATE OF CORRECTION

PATENT NO. : 8,493,274 B2
APPLICATION NO. : 12/094248
DATED : July 23, 2013
INVENTOR(S) : Toru Taura It is certified that error appears in the above-identified patent and that said Letters Patent is hereby corrected as shown below:

On the Title page, left column, the line:

"(75) Inventor: Toru Raura, Tokyo (JP)"

should be replaced with:

--(75) Inventor: Toru Taura, Tokyo (JP)--

Signed and Sealed this
Tenth Day of September, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,493,274 B2
APPLICATION NO. : 12/094248
DATED : July 23, 2013
INVENTOR(S) : Toru Raura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 211 days.

Signed and Sealed this
Eighth Day of September, 2015

Michelle K. Lee

Michelle K. Lee
*Director of the United States Patent and Trademark Office*